US009734693B2

(12) United States Patent
McKinley et al.

(10) Patent No.: US 9,734,693 B2
(45) Date of Patent: Aug. 15, 2017

(54) REMOTE EQUIPMENT MONITORING AND NOTIFICATION USING A SERVER SYSTEM

(71) Applicants: W. Michael McKinley, Corona del Mar, CA (US); Kevin M. Rusin, Laguna Niguel, CA (US)

(72) Inventors: W. Michael McKinley, Corona del Mar, CA (US); Kevin M. Rusin, Laguna Niguel, CA (US)

(73) Assignee: MCKINLEY EQUIPMENT CORPORATION, Irvine, CA (US)

( * ) Notice: Subject to any disclaimer, the term of this patent is extended or adjusted under 35 U.S.C. 154(b) by 0 days.

(21) Appl. No.: 14/795,824

(22) Filed: Jul. 9, 2015

(65) Prior Publication Data

US 2016/0012707 A1 Jan. 14, 2016

Related U.S. Application Data

(60) Provisional application No. 62/092,642, filed on Dec. 16, 2014, provisional application No. 62/022,325, filed on Jul. 9, 2014.

(51) Int. Cl.

*G08B 21/00* (2006.01)
*G08B 21/18* (2006.01)
*G08B 25/10* (2006.01)

(52) U.S. Cl.

CPC ..... *G08B 21/187* (2013.01); *G08B 25/10* (2013.01)

(58) Field of Classification Search

CPC ..... G08B 21/187; G08B 21/00
USPC ..... 340/679, 506, 540, 870.01; 702/188, 702/182, 184, 189
See application file for complete search history.

(56) References Cited

U.S. PATENT DOCUMENTS 6,646,564 B1 * 11/2003 Azieres ..... G08B 25/14 340/506
2004/0095237 A1 * 5/2004 Chen ..... F24F 11/0086 340/506
2009/0289788 A1 * 11/2009 Leblond ..... H04N 7/18 340/540

(Continued)

OTHER PUBLICATIONS

Asay, M., "Why You Need NoSQL for the Internet of Things", 2014, retrieved from http://readwrite.com/2014/11/28/internet-of-things-nosql-data on Feb. 23, 2016, pp. 1-4.

(Continued)

*Primary Examiner* — Toan N Pham
(74) *Attorney, Agent, or Firm* — One LLP

(57) ABSTRACT

Systems, devices, and methods are provided for equipment monitoring comprising monitoring signals created by a PLC and sensors associated with a piece of equipment using a monitoring device comprising hardware communicatively coupled to a PLC and operative to transmit information over a communications network, transmitting signals from the monitoring device over the communications network to one or more databases stored on a server system comprising hardware and software communicatively coupled to the network, analyzing signals created by the PLC to determine the nature of the signals and using the analyzed signals to send alerts to one or more mobile service devices operated by technicians when emergency maintenance is required for the piece of equipment.

20 Claims, 59 Drawing Sheets

(56) References Cited

U.S. PATENT DOCUMENTS

| | | | | |
|---|---|---|---|---|
| 2010/0185416 | A1* | 7/2010 | Furem | E02F 9/267 702/184 |
| 2014/0266755 | A1* | 9/2014 | Arensmeier | F24F 11/0086 340/679 |

OTHER PUBLICATIONS

Barrett, B., "Wi-Fi That Charges Your Gadgets is Closer Than You Think", 2015, retrieved from http://www.wired.com/2015/06/power-over-wi-fi on Feb. 23, 2016, pp. 1-9.

* cited by examiner

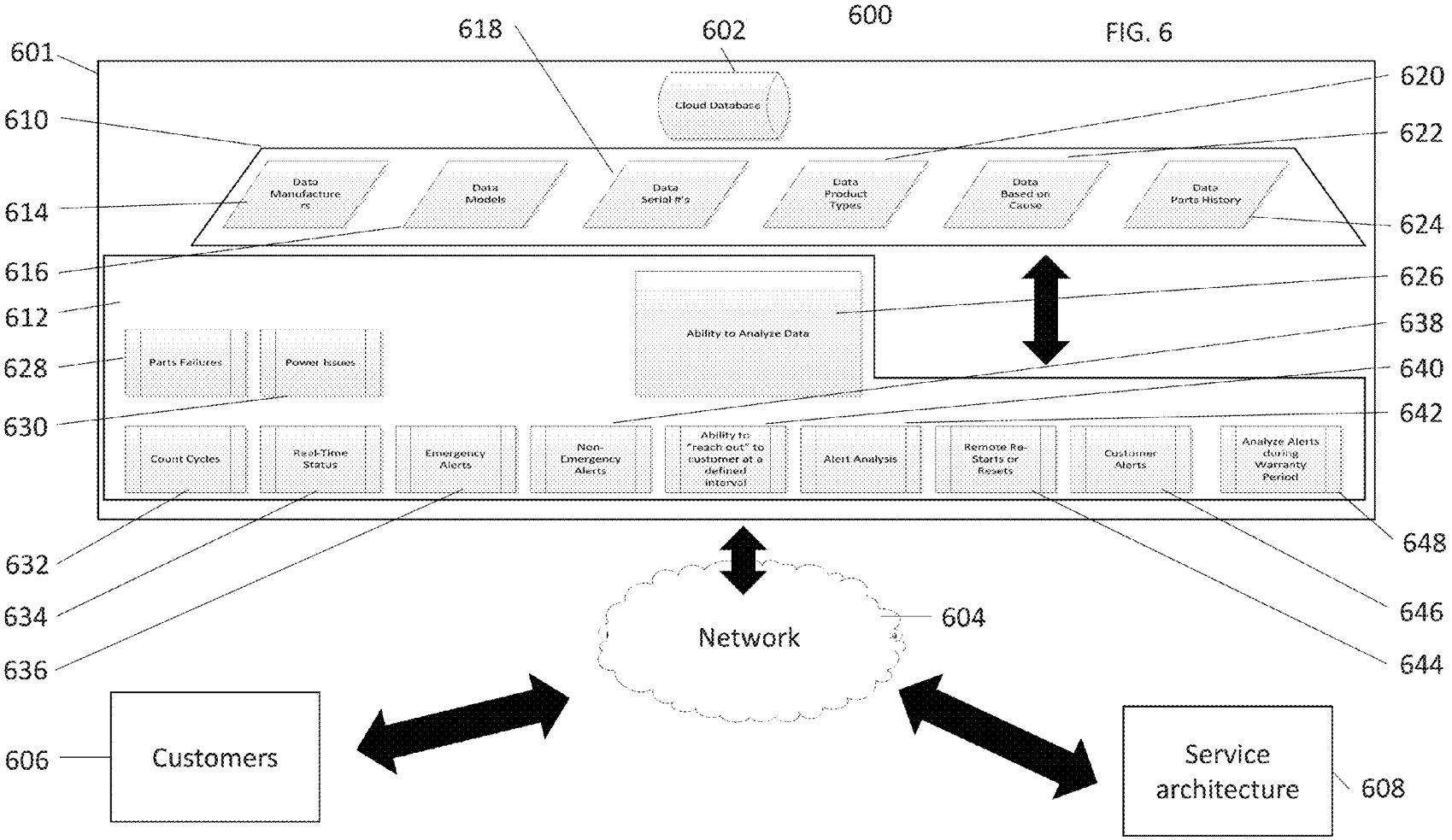
FIG. 6
600
601
602
Cloud Database
610
Data Manufacturers
614
Data Models
616
Data Serial #'s
618
Data Product Types
620
Data Based on Cause
622
Data Parts History
624
612
Ability to Analyze Data
626
628
Parts Failures
Power Issues
630
Count Cycles
Real-Time Status
632
Emergency Alerts
634
Non-Emergency Alerts
636
Ability to "reach out" to customer at a defined interval
638
Alert Analysis
640
Remote Re-Starts or Resets
642
Customer Alerts
644
Analyze Alerts during Warranty Period
646
648
Network
604
Customers
606
Service architecture
608

FIG. 20B 2012 2014 2016 2018 2020 2022 2024

| id | user | name | details | timestamp | created_at | hardware_id | value |
|---|---|---|---|---|---|---|---|
| [illegible] | 3 | PACKETS_LOST | msec=376651.938 buff_size=0 seqno=99 | 2015-04-21 20:19:55 | 2015-04-21 18:39:33 | 49 | 18596.000 |
| 312675 | 3 | ACCELEROMETER_READ | msec=376651.938 buff_size=0 seqno=99 | 2015-04-21 20:19:55 | 2015-04-21 18:39:33 | 49 | 511911.000 |
| 312672 | 3 | BATTERY | msec=376651.938 buff_size=0 seqno=99 | 2015-04-21 20:19:55 | 2015-04-21 18:39:32 | 49 | 3.266 |
| 312673 | 3 | RAM | msec=376651.938 buff_size=0 seqno=99 | 2015-04-21 20:19:55 | 2015-04-21 18:39:32 | 49 | 528.000 |
| 312671 | 3 | TEMPERATURE | msec=376651.938 buff_size=0 seqno=99 | 2015-04-21 20:19:55 | 2015-04-21 18:39:31 | 49 | 20.000 |
| 312669 | 3 | FORK LIFT LEFT-RIGHT G | msec=1017463.812 buff_size=1 seqno=61 | 2015-04-21 23:08:39 | 2015-04-21 18:37:25 | 53 | 0.000 |
| 312670 | 3 | FORK LIFT FORWARD-BACK G | msec=1017463.812 buff_size=1 seqno=62 | 2015-04-21 23:08:39 | 2015-04-21 18:37:25 | 53 | 0.000 |
| 312667 | 3 | FORK LIFT FORWARD-BACK G | msec=1017463.125 buff_size=1 seqno=59 | 2015-04-21 23:08:38 | 2015-04-21 18:37:24 | 53 | 0.250 |
| 312668 | 3 | FORK_LIFT | msec=1017463.812 buff_size=1 seqno=60 | 2015-04-21 23:08:38 | 2015-04-21 18:37:24 | 53 | 0.312 |
| 312665 | 3 | FORK_LIFT | msec=1017463.125 buff_size=1 seqno=57 | 2015-04-21 23:08:38 | 2015-04-21 18:37:23 | 53 | 0.438 |
| 312666 | 3 | FORK LIFT LEFT-RIGHT G | msec=1017463.125 buff_size=1 seqno=58 | 2015-04-21 23:08:38 | 2015-04-21 18:37:23 | 53 | 0.062 |
| 312663 | 3 | FORK LIFT LEFT-RIGHT G | msec=1017462.438 buff_size=1 seqno=55 | 2015-04-21 23:08:37 | 2015-04-21 18:37:22 | 53 | 0.000 |
| 312664 | 3 | FORK LIFT FORWARD-BACK G | msec=1017462.438 buff_size=1 seqno=56 | 2015-04-21 23:08:37 | 2015-04-21 18:37:22 | 53 | 0.062 |
| 312661 | 3 | FORK LIFT FORWARD-BACK G | msec=1017461.750 buff_size=1 seqno=53 | 2015-04-21 23:08:37 | 2015-04-21 18:37:21 | 53 | 0.000 |
| 312662 | 3 | FORK_LIFT | msec=1017462.438 buff_size=1 seqno=54 | 2015-04-21 23:08:37 | 2015-04-21 18:37:21 | 53 | 0.125 |
| 312659 | 3 | FORK_LIFT | msec=1017461.750 buff_size=1 seqno=51 | 2015-04-21 23:08:36 | 2015-04-21 18:37:20 | 53 | 0.375 |
| 312660 | 3 | FORK LIFT LEFT-RIGHT G | msec=1017461.750 buff_size=1 seqno=52 | 2015-04-21 23:08:36 | 2015-04-21 18:37:20 | 53 | 0.000 |
| 312657 | 3 | FORK LIFT LEFT-RIGHT G | msec=1017454.438 buff_size=1 seqno=49 | 2015-04-21 23:08:29 | 2015-04-21 18:37:13 | 53 | 0.000 |
| 312658 | 3 | FORK LIFT FORWARD-BACK G | msec=1017454.438 buff_size=1 seqno=50 | 2015-04-21 23:08:29 | 2015-04-21 18:37:13 | 53 | 0.062 |
| 312655 | 3 | FORK LIFT FORWARD-BACK G | msec=1017453.562 buff_size=1 seqno=47 | 2015-04-21 23:08:28 | 2015-04-21 18:37:12 | 53 | 0.000 |

FIG. 20F

Work Details for Dock #31

| Description | Created Date | Total Amount | Cause |
|---|---|---|---|
| Work Order : Line Detail<br>VERTICAL STEEL FACE BUMPER | 2012-09-24 12:47:29 | $284.00 | Wear & Tear |
| Work Order : Line Detail<br>PUSHBAR | 2012-09-24 12:51:13 | $107.25 | Wear & Tear |
| Work Order : Line Detail<br>PIN CLEVIS | 2012-09-24 12:51:13 | $5.00 | Wear & Tear |
| Work Order : Line Detail<br>service repair completed on new docks locked and secure dock and lip clean all trash out of pit and surroundings and removed damaged push bar and install new push bar including new Clevis pin done functional service and lube all moving parts for proper function; ,,,,, | 2012-09-24 12:51:14 | $880.03 | Wear & Tear |
| Work Order : Line Detail<br>(2) 5/8 CONCRETE ANCHORS | 2012-09-25 09:12:58 | $25.00 | Wear & Tear |
| Work Order : Line Detail<br>FREIGHT | 2012-09-25 09:12:59 | $45.00 | Wear & Tear |
| Work Order : Line Detail<br>WELDING | 2012-09-25 09:12:59 | $50.00 | Wear & Tear |
| Work Order : Line Detail<br>HANGER BRKT, FX | 2013-10-08 16:55:43 | $66.00 | Wear & Tear |
| Work Order : Line Detail<br>LINK ASSY, LH | 2013-10-08 16:55:43 | $38.04 | Wear & Tear |
| Work Order : Line Detail<br>PUSHBAR | 2013-10-08 16:55:43 | $107.25 | Wear & Tear |

Total: $3,684.59

FIG. 20G

Activity History [Log a Call] [Mail Merge] [Send an Email] Activity History Help No records to display

Product Warranty [New Product Warranty] Product Warranty Help

| Action | Warranty ID | Warranty Items | Start Date | End Date | Time % Covered | Material % Covered | Expenses % Covered | Created By | Last Modified By |
|---|---|---|---|---|---|---|---|---|---|
| Edit \| Del | [illegible] | Genesis 2 YR from Purchase Warranty | 3/20/2013 | 3/19/2015 | | 100 | | Kevin Ryan, 3/11/2014 3:46 PM | Kevin Ryan, 3/11/2014 3:46 PM |
| Edit \| Del | [illegible] | 90 L 365P | 4/12/2013 | 4/11/2014 | 100 | 100 | | Kevin Ryan, 3/11/2014 3:49 PM | Tony Cider, 3/15/2015 1:26 PM |

Cases [New Case] Cases Help

| Action | Case Number | Subject | Date/Time Opened | Priority |
|---|---|---|---|---|
| Edit \| Del | 00011067 | Service Call (TEST) | 3/22/2013 10:12 AM | Medium |
| Edit \| Del | 00020066 | Test ServiceMax 13 | 1/14/2014 12:30 PM | Medium |
| Edit \| Del | 00021301 | Elevator | 3/6/2014 5:01 PM | Low |
| Edit \| Del | 00024526 | Service | 6/26/2014 9:55 AM | Medium |
| Edit \| Del | 00027105 | push buttons not working | 8/18/2014 6:21 PM | Medium |
| Edit \| Del | 00027227 | Elevator service request | 8/23/2014 9:52 AM | Medium |
| Edit \| Del | 00028519 | Test for Kevin - Ignore | 11/19/2014 11:44 AM | Medium |
| Edit \| Del | 00029695 | ELV-PM (Dev Safety Mat) | 12/17/2014 5:46 PM | Low |
| Edit \| Del | 00030779 | Service | 2/4/2015 4:28 PM | Medium |

Work Details [New Work Detail] Work Details Help

| Action | Line Number | Work Order | WO Type | PM Schedule | Date | Description | Record Type | Part | Labor Charge | Total Line Price |
|---|---|---|---|---|---|---|---|---|---|---|
| Edit \| Del | WL-00042822 | WO-00018944 | Shop | | | | Products Serviced | | Regular | $0.000 |
| Edit \| Del | WL-00180384 | WO-00017268 | Service | | | | Products Serviced | | Regular | $0.000 |
| Edit \| Del | WL-00275944 | WO-00013813 | Service | | | | Products Serviced | | Regular | $0.000 |
| Edit \| Del | WL-00136588 | WO-00087807 | Service | | | | Usage/Consumption | | Regular | $121.000 |
| Edit \| Del | WL-00383875 | WO-00101143 | Service | | | Installed battery Backup | Usage/Consumption | | Regular | $154.000 |
| Edit \| Del | WL-00383728 | WO-00101143 | Service | | | | Usage/Consumption | | Regular | $0.000 |
| Edit \| Del | WL-00383731 | WO-00101143 | Service | | | | Usage/Consumption | | Regular | $0.000 |
| Edit \| Del | WL-00484837 | WO-00128429 | Service | | | | Usage/Consumption | | Regular | $154.000 |
| Edit \| Del | WL-00484758 | WO-00128429 | Service | | | Found Down: pushbutton does not work, elevator is at top landing. Button bad. Requires replacing. | Usage/Consumption | | Regular | $154.000 |
| Edit \| Del | WL-00484757 | WO-00128475 | Service | | | E-stop. See photo | Estimate | /SA-IMS | Regular | $0.000 |
| Edit \| Del | WL-00484758 | WO-00128475 | Service | | | Replace e-stop | Estimate | | Regular | $0.000 |

FIG. 21A

PLC 1 - Multi-Valued Fields

| | | | | | | | | | | |
|---|---|---|---|---|---|---|---|---|---|---|
| 59 | 184 | 7 | 0 | 6 | 0 | 0 | 12/5/2013 13:05:35 | WP-RMR Hall door open | { Data Sets are blue } | |
| 60 | 184 | 7 | 0 | 8 | 0 | 0 | 12/5/2013 13:14:51 | WP-RMR Elevator Up | Push Button Here | |
| 61 | 184 | 7 | 0 | 6 | 0 | 0 | 12/5/2013 13:14:53 | WP-RMR Elevator Up | | |
| 62 | 184 | 7 | 2 | 8 | 0 | 2 | 12/5/2013 13:14:54 | WP-RMR Elevator Up | | |
| 63 | 184 | 7 | 2 | 6 | 0 | 2 | 12/5/2013 13:14:55 | WP-RMR Elevator Up | | |
| 64 | 184 | 7 | 0 | 0 | 0 | 2 | 12/5/2013 13:14:56 | WP-RMR Elevator Up | | |
| 65 | 184 | 7 | 0 | 0 | 0 | 2 | 12/5/2013 13:14:57 | WP-RMR Elevator Up | | |
| 66 | 184 | 7 | 0 | 0 | 0 | 2 | 12/5/2013 13:14:58 | WP-RMR Elevator Up | | |
| 67 | 254 | 7 | 0 | 134 | 0 | 2 | 12/5/2013 13:14:59 | WP-RMR Elevator Up | Data Sets changed Here | |
| 68 | 254 | 3 | 0 | 134 | 0 | 2 | 12/5/2013 13:15:00 | WP-RMR Elevator Up | | |
| 69 | 255 | 3 | 0 | 134 | 0 | 2 | 12/5/2013 13:15:01 | WP-RMR Elevator Up | | |
| 70 | 254 | 3 | 0 | 6 | 0 | 2 | 12/5/2013 13:15:02 | WP-RMR Elevator Up | | |
| 71 | 254 | 11 | 0 | 6 | 0 | 0 | 12/5/2013 13:15:03 | WP-RMR Elevator Up | | |
| 72 | 254 | 11 | 0 | 6 | 0 | 0 | 12/5/2013 13:15:04 | WP-RMR Elevator Up | | |
| 73 | 252 | 11 | 0 | 22 | 0 | 0 | 12/5/2013 13:15:05 | WP-RMR Elevator Up | | |

FIG. 21B

PLC 2 - Singe-Valued Repeating Fields

2222222222111111111111aaaaaa1111111111kkkkkkkkkk

FIG. 22A

```
Array
(
    [Msg] => Array
        (
            [@attributes] => Array
                (
                    [topic] => 6619/DataPoint/00000000-00000000-00042DFF-FF03BCF7/events
                    [group] => *
                    [operation] => INSERTION
                    [timestamp] => 2014-06-12T22:49:42.263Z
                )

            [DataPoint] => Array
                (
                    [id] => 5597954b-f242-11e3-bf26-fa163e330de8
                    [catId] => 6619
                    [streamId] => 00000000-00000000-00042DFF-FF03BCF7/events
                    [timestamp] => 1402585246900
                    [serverTimestamp] => 1402613382157
                    [data] => 1
                    [description] => Array
                        (
                        )

                    [quality] => 0
                )

        )
)
(END)
```

FIG. 22B

```
[catid] => 6619
[atmospherictime] => 2014-06-12T22:59:48.000Z
[atmospheriload] => Array
    (
        [Payload] => Array
            (
                [DataPoint] => Array
                    (
                        [id] => a94c1c43-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [1] => Array
                    (
                        [id] => a94c1c44-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [2] => Array
                    (
                        [id] => a94c1c45-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [3] => Array
                    (
                        [id] => a94c1c46-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [4] => Array
                    (
                        [id] => a94c1c47-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [5] => Array
                    (
                        [id] => a94c1c48-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [6] => Array
                    (
                        [id] => a94c1c49-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [7] => Array
                    (
                        [id] => a94c1c4a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [8] => Array
                    (
                        [id] => a94c1c4b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [9] => Array
                    (
                        [id] => a94c1c4c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [10] => Array
                    (
                        [id] => a94c1c4d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [11] => Array
                    (
                        [id] => a94c1c4e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [12] => Array
                    (
                        [id] => a94c1c4f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [13] => Array
                    (
                        [id] => a94c1c50-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [14] => Array
                    (
                        [id] => a94c1c51-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [15] => Array
                    (
                        [id] => a94c1c52-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [16] => Array
                    (
                        [id] => a94c1c53-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [17] => Array
                    (
                        [id] => a94c1c54-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [18] => Array
                    (
                        [id] => a94c1c55-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [19] => Array
                    (
                        [id] => a94c1c56-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [20] => Array
                    (
                        [id] => a94c1c57-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [21] => Array
                    (
                        [id] => a94c1c58-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [22] => Array
                    (
                        [id] => a94c1c59-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [23] => Array
                    (
                        [id] => a94c1c5a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [24] => Array
                    (
                        [id] => a94c1c5b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [25] => Array
                    (
                        [id] => a94c1c5c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [26] => Array
                    (
                        [id] => a94c1c5d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [27] => Array
                    (
                        [id] => a94c1c5e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [28] => Array
                    (
                        [id] => a94c1c5f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [29] => Array
                    (
                        [id] => a94c1c60-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [30] => Array
                    (
                        [id] => a94c1c61-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [31] => Array
                    (
                        [id] => a94c1c62-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [32] => Array
                    (
                        [id] => a94c1c63-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [33] => Array
                    (
                        [id] => a94c1c64-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [34] => Array
                    (
                        [id] => a94c1c65-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [35] => Array
                    (
                        [id] => a94c1c66-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [36] => Array
                    (
                        [id] => a94c1c67-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [37] => Array
                    (
                        [id] => a94c1c68-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [38] => Array
                    (
                        [id] => a94c1c69-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [39] => Array
                    (
                        [id] => a94c1c6a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [40] => Array
                    (
                        [id] => a94c1c6b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [41] => Array
                    (
                        [id] => a94c1c6c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [42] => Array
                    (
                        [id] => a94c1c6d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [43] => Array
                    (
                        [id] => a94c1c6e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [44] => Array
                    (
                        [id] => a94c1c6f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [45] => Array
                    (
                        [id] => a94c1c70-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [46] => Array
                    (
                        [id] => a94c1c71-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [47] => Array
                    (
                        [id] => a94c1c72-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [48] => Array
                    (
                        [id] => a94c1c73-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [49] => Array
                    (
                        [id] => a94c1c74-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [50] => Array
                    (
                        [id] => a94c1c75-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [51] => Array
                    (
                        [id] => a94c1c76-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [52] => Array
                    (
                        [id] => a94c1c77-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [53] => Array
                    (
                        [id] => a94c1c78-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [54] => Array
                    (
                        [id] => a94c1c79-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [55] => Array
                    (
                        [id] => a94c1c7a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [56] => Array
                    (
                        [id] => a94c1c7b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [57] => Array
                    (
                        [id] => a94c1c7c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [58] => Array
                    (
                        [id] => a94c1c7d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [59] => Array
                    (
                        [id] => a94c1c7e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [60] => Array
                    (
                        [id] => a94c1c7f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [61] => Array
                    (
                        [id] => a94c1c80-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [62] => Array
                    (
                        [id] => a94c1c81-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [63] => Array
                    (
                        [id] => a94c1c82-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [64] => Array
                    (
                        [id] => a94c1c83-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [65] => Array
                    (
                        [id] => a94c1c84-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [66] => Array
                    (
                        [id] => a94c1c85-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [67] => Array
                    (
                        [id] => a94c1c86-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [68] => Array
                    (
                        [id] => a94c1c87-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [69] => Array
                    (
                        [id] => a94c1c88-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [70] => Array
                    (
                        [id] => a94c1c89-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [71] => Array
                    (
                        [id] => a94c1c8a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [72] => Array
                    (
                        [id] => a94c1c8b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [73] => Array
                    (
                        [id] => a94c1c8c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [74] => Array
                    (
                        [id] => a94c1c8d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [75] => Array
                    (
                        [id] => a94c1c8e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [76] => Array
                    (
                        [id] => a94c1c8f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [77] => Array
                    (
                        [id] => a94c1c90-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [78] => Array
                    (
                        [id] => a94c1c91-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [79] => Array
                    (
                        [id] => a94c1c92-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [80] => Array
                    (
                        [id] => a94c1c93-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [81] => Array
                    (
                        [id] => a94c1c94-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [82] => Array
                    (
                        [id] => a94c1c95-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [83] => Array
                    (
                        [id] => a94c1c96-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [84] => Array
                    (
                        [id] => a94c1c97-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [85] => Array
                    (
                        [id] => a94c1c98-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [86] => Array
                    (
                        [id] => a94c1c99-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [87] => Array
                    (
                        [id] => a94c1c9a-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [88] => Array
                    (
                        [id] => a94c1c9b-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [89] => Array
                    (
                        [id] => a94c1c9c-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [90] => Array
                    (
                        [id] => a94c1c9d-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [91] => Array
                    (
                        [id] => a94c1c9e-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [92] => Array
                    (
                        [id] => a94c1c9f-f243-11e3-bf26-2a163e330de0
                        [catid] => 6619
                        [stationid] => 00000000-0000-0000-0000-000042FF-FF03BCF7/e=0
                        [timestamp] => 1402585910120
                        [serverTimestamp] => 1402613928480
                        [value] => 0
                        [description] => Array
                            (
                            )
                        [quality] => 0
                    )
                [93] => Array
                    (
                        [id] => a94c1ca0-f243-11e3-bf26-2a163e330de0
                        [catid] => 6619
                        [stationid] => 00000000-0000-0000-0000-
```

FIG. 22C

```
[group] => *
[operation] => INSERTION
[timestamp] => 2014-06-12T22:48:40.5358
)
[MacaPoints] => Array
(
[id] => 4463512a-f242-11e3-b426-f4163e330e8
[cstid] => 6615
[sessionid] => 00000000-00000000-00042DEF-FF03BCE7/events
[timestamp] => 1402589218980
[expirtimestamp] => 1402613320479
[0] => 2
[description] => Array
(
)
[quality] => 0
)
)
)
2014-06-12 15:48:40 PM SOURCE: 50.56.12.189 / PUT
Array
(
[Msg] => Array
(
```

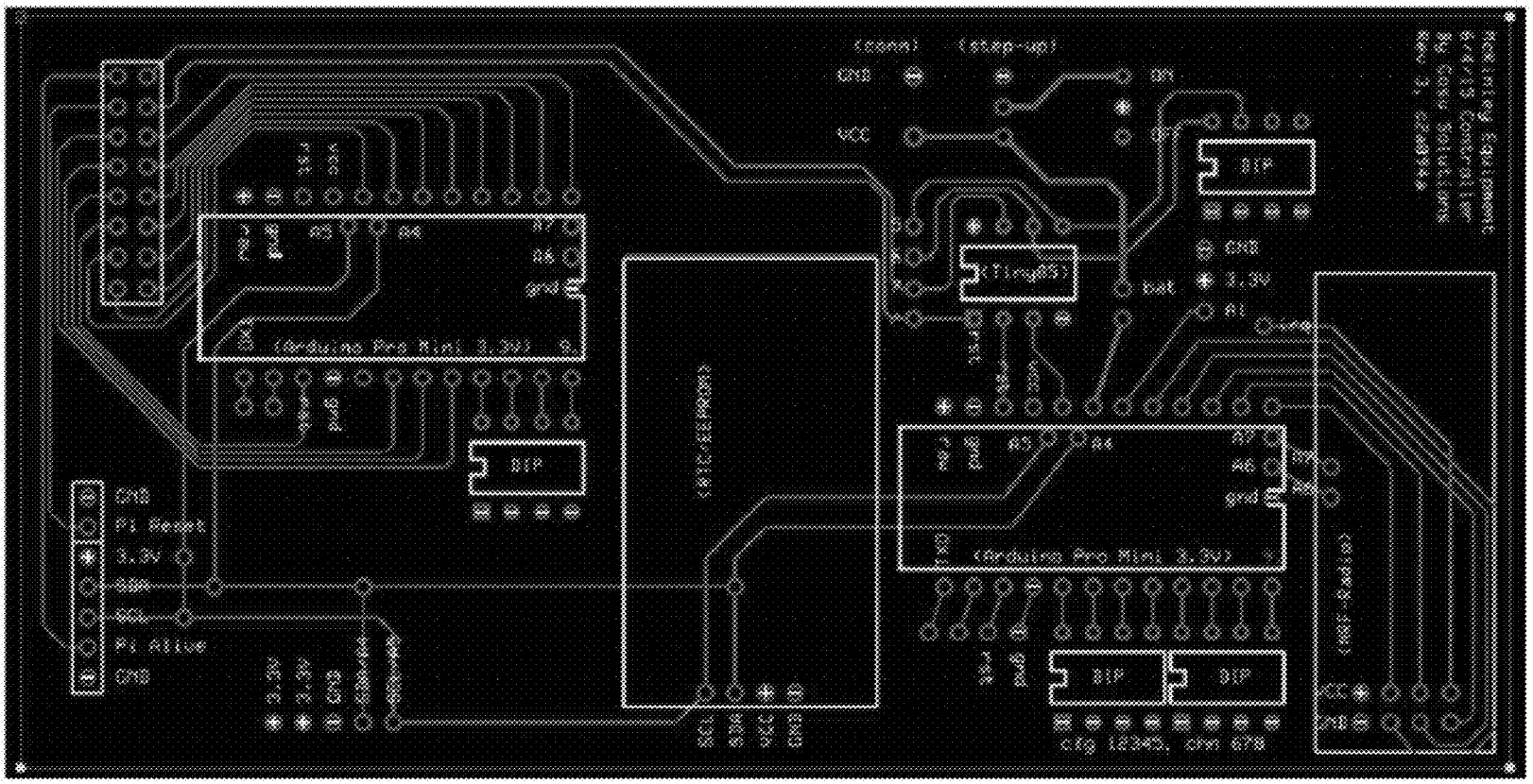
Rockinley Equipment
8/4/15 Controller
By Cosy Solutions
Rev 3, 22a094a
(Arduino Pro Mini 3.3V)
(Arduino Pro Mini 3.3V)
(Arduino Pro Mini 3.3V)
(8MB EEPROM)
(8MB EEPROM)
(RTC)
(Sound)
(Amp-up)
(Amp-down)
(Amp-down)
(Amp-up)
(Amp-down)
(Amp-up)
(Amp-down)
(Amp-up Scenario 1: Camera always on Scenario 2: Event triggers camera

REMOTE EQUIPMENT MONITORING AND NOTIFICATION USING A SERVER SYSTEM

CROSS-REFERENCE TO RELATED APPLICATIONS

This application claims priority to U.S. Provisional Application No. 62/022,325, entitled "REMOTE EQUIPMENT MONITORING AND NOTIFICATION USING A SERVER SYSTEM" filed Jul. 9, 2014 and U.S. Provisional Application No. 62/092,642, entitled "SYSTEMS AND METHODS FOR MONITORING EQUIPMENT STATUS" filed Dec. 16, 2014 which applications are hereby incorporated in their entirety by reference.

FIELD

The subject matter described herein relates generally to systems, devices, and methods for automating equipment health and data monitoring; status logging; service dispatching; remote controlling equipment; updating software remotely for PLC's, sensors and monitoring devices; and data interpretation for improved service, safety and lifespan analysis using sensors and monitoring devices including cameras and video cameras.

BACKGROUND

Various types of mechanical, electro-mechanical, hydraulic, pressurized, chemical, pneumatic and other equipment may be installed by manufacturers, dealers, wholesalers, resellers or other businesses at a customer's desired location. Examples of such equipment may include home elevators, industrial elevators, handicap elevators, specialty elevators, commercial elevators, dumbwaiters, escalators, vertical wheelchair lifts, incline wheelchair lifts, dock levelers, dock lifts, loading docks, industrial lifts, vertical reciprocating conveyors, conveyers, truck restraints, overhead doors, garage doors, high speed doors, HVLS fans, balers, compactors, storefront doors, cart conveyers, coolers doors, freezer doors, heating and air conditioning equipment and others. Although these types of equipment and their individual parts and components may be experimentally tested and rated for a particular lifetime—a length of time the equipment is usable before it is obsolete, breaks or is otherwise retired from common use (such as five years, sixty-thousand uses, etc.)—it is often unknown exactly how long a particular piece of equipment may actually survive in real-world use. Stated another way, the equipment's lifespan may be estimated but not known with a great degree of certainty. Since this process does not use real statistical data based on actual use in the field, in many cases can be incorrect. For instance, a well-maintained and infrequently used residential dumbwaiter may survive significantly longer than an estimated lifespan while a poorly maintained and heavily used hotel dumbwaiter may break long before an estimated lifespan expires. As such, it would be beneficial to accurately monitor the lifespan of equipment including components and parts based on actual usage in the field. This can allow prediction with statistical certainty of when a product must be replaced or repaired before it breaks down. Benefits can range from corporate finance and operations departments having the ability to budget for equipment replacements more accurately and increase up-time for equipment to individual owners not being inconvenienced in their homes and surprised with large repair or replacement bills.

Typically a customer will purchase a piece of equipment, have the equipment installed and then use the equipment as intended. In some instances the customer may have an agreement with a servicer to provide regularly scheduled maintenance for the equipment (such as fixed every ninety days or after an estimated number of usage time in hours, cycles, etc.) and may contact the same entity for broken equipment repair or other emergency maintenance in between scheduled maintenance. When equipment requires emergency maintenance, breaks or otherwise needs fixing the customer may need to contact the servicer and wait for a technician to arrive to diagnose the problem. A common occurrence today is that a technician may not be an expert in the particular equipment he/she is dispatched to diagnose but instead is the only available technician. Once the problem is diagnosed, the customer will need to wait for the technician to order replacement parts. Once the replacement parts are ordered they may need to be shipped to the technician or customer. Once the replacement parts are shipped the customer will wait for the technician to return and install the replacement parts. The emergency maintenance issue may take days, weeks or even months to resolve, all while depriving the customer of the normal use of the equipment. In the case of equipment installed at a business or other enterprise this could mean lost profit and other related problems. As such, the emergency maintenance may cost the customer valuable time, money and other resources before being resolved.

In addition, while some equipment may have manual shutoff and other minimal safety features, they are often not automated in such a way as to protect users from injury when operated in seemingly normal situations. For instance, a child may hide in the bottom of an elevator shaft and could be crushed upon descent of the elevator, even when the elevator is operating normally.

Thus, needs exist for improved techniques by which to proactively monitor equipment health and safety; log equipment status and usage including hours, time, cycles, temperature, humidity, pressure, electrical voltage or current, distance, height, or other relevant information; communicate with customers; dispatch service technicians in times of emergency or for preventative maintenance; and identify trends in equipment health, usage and maintenance that are correlated with equipment and parts breakdowns and product lifetime.

SUMMARY

Provided herein are embodiments of devices, systems, and methods that provide improved equipment health monitoring, equipment status logging, safety, customer communication and service technician dispatching. These embodiments are described in the context of large equipment, although they are not limited to such and can, in fact, be used in a number of other applications. The configurations described in this document detail various embodiments which are only examples.

Also provided are systems, methods and devices configured to monitor, collect, analyze, and utilize actual usage data for equipment including usage times, dates and other information in order to provide improved service and better lifespan product knowledge for each piece of equipment and to provide improved operational efficiency of equipment. This data can then be compared amongst some models, product families and competitive products to determine the true cost of ownership. In many embodiments mechanical equipment without a PLC can be monitored using the systems and methods described herein. In some embodiments the systems and methods described herein related to sensors and monitoring equipment can be used in a complementary fashion with PLC monitoring equipment or as a backup to PLC systems. Also disclosed herein are mobile applications, web applications behind a login screen (portal), email reporting and other analytics. In addition, this document discusses predictive maintenance for parts and components of installed equipment in addition to predicting the life cycle of such equipment that currently data does not exist. This "real-time" analysis of the equipment health is non-existent today.

Other systems, devices, methods, features and advantages of the subject matter described herein will be or will become apparent to one with skill in the art upon examination of the following figures and detailed description. It is intended that all such additional systems, devices, methods, features and advantages be included within this description, be within the scope of the subject matter described herein, and be protected by the accompanying claims. In no way should the features of the example embodiments be construed as limiting the appended claims, absent express recitation of those features in the claims.

BRIEF DESCRIPTION OF THE FIGURES

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

FIG. 1I is a diagram depicting an example embodiment of a system overview with multiple monitors.

FIG. 6 is a diagram depicting an example embodiment of data storage, analysis and usage.

FIGS. 20A-20G are depictions of example embodiments of data log screens for an individual installed product.

FIG. 21A is a depiction of an example embodiment of a first PLC output for a first piece of equipment.

FIG. 21B is a depiction of an example embodiment of a second PLC output for a second piece of equipment.

FIGS. 22A-22C show an example embodiment of monitoring equipment from different views in accordance with the present invention.

FIG. 23B is a diagram depicting an example embodiment of a circuit board for a controller box.

DETAILED DESCRIPTION

Before the present subject matter is described in detail, it is to be understood that this disclosure is not limited to the particular embodiments described, as such may, of course, vary. It is also to be understood that the terminology used herein is for the purpose of describing particular embodiments only, and is not intended to be limiting, since the scope of the present disclosure will be limited only by the appended claims.

Figure 1A:
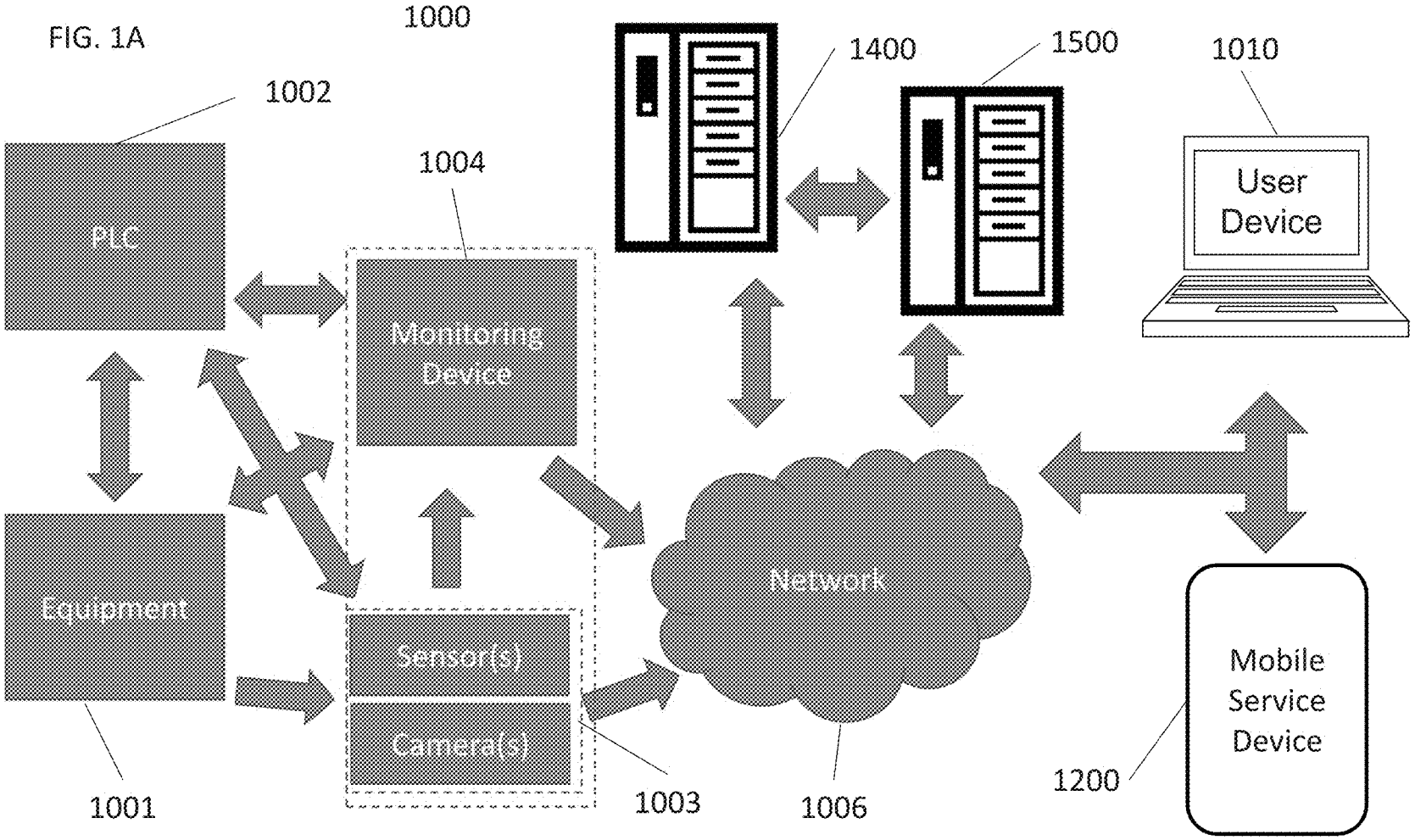
FIG. 1A is a diagram depicting an example embodiment of a network overview.

FIG. 1A shows a diagram of a network overview 1000 with multiple servers 1400, 1500 which may include applications distributed on one or more physical servers, each having one or more processors, memory banks, operating systems, input/output interfaces, and network interfaces, all known in the art, and a plurality of user devices 1010 and mobile service devices 1200 coupled to a network 1006 such as a public network (e.g. the Internet and/or a cellular-based wireless network, or other network), a private network or a combination. Mobile service device 1200*s* include for example mobile devices (e.g. phones, tablets, or others) wearable devices (e.g. watches, bracelets, glasses, etc.), laptop devices, and others, while user devices 1010 may include mobile devices, wearable devices, laptop or desktop devices, other devices with computing capability and network interfaces and so on. Servers 1400, 1500 may be operable to interface with websites, webpages, web applications, and others. Programmable logic controller (PLC) 1002 may be a digital computer used for automation of equipment. Monitoring device 1004 can be a network enabled device with an embedded programming environment that monitors parallel, serial, wireless, and/or other network outputs and accepts and stores data. In some embodiments TCP/IP protocols are used while others are possible in various embodiments. In some embodiments monitoring device 1004 may include transceivers or other devices which allow transmission and reception of data in wireless and/or wired form (such as electromagnetic waves over a transmission medium including cellular data, Wi-Fi, Bluetooth, xbee, zigbee, LoRa, custom protocol, etc. over various wireless spectra such as 430 mhz, 900 mhz, 2.4 ghz, others or data signals transferred over serial or parallel data transmission cables)

In some embodiments monitoring devices may not have integrated transceivers and additional transmission/reception equipment may be communicatively coupled with monitoring devices for connecting with network 1006. Sensors 1003 and monitoring devices 1004 can be mounted by various means. These can include bolting or other permanent fixing, such as adhesives and can also include high power magnets for low impact on equipment and quick deployment.

Sensors 1003 may include a variety of equipment state sensing devices including temperature sensors, mercury type air conditioning thermostat switches, level sensors, accelerometers, gyroscopes, magnetometers, power sensors, position sensors, friction sensors, timing sensors, audio sensors, visual sensors, audiovisual sensors, dark/light sensors, photographic eyes, step sensors, pressure sensors, pressure gauges, pressure switches, pneumatic switches, hydraulic sensors, fluid level sensors, other fluid sensors, flow sensors, magnetic field sensors, humidity sensors, moisture sensors, vibration sensors, impact switches, electrical field sensors, voltage draw switches, amperage draw switches, motion sensors, switches, cameras, video cameras, barometer sensors, GPS sensors, RFID sensors, NFC sensors, voltage sensors, amperage sensors, thermal image sensors, laser sensors, optical sensors, color or spectrum sensors such as ultraviolet sensors, air sensors, proximity switches, distance sensors (sonar, laser), weight sensors, whisker switches, physical switches, AC/DC sensors, opto-couplers and other sensors and detectors.

Some sensors 1003 will include operable transceivers for transmitting to monitoring devices 1004 while others may be wired directly to monitoring devices 1004. Additionally a still camera or video camera can be mounted to a piece of equipment (e.g. an elevator). The camera(s) can be installed in a location so as to determine a cause for a system alert. If an alert is received from a PLC or sensor, the camera can capture an image of the equipment, including the problem. A system operator can be notified of the alert and receive the image over a network. If a video camera is installed, the video camera can be constantly recording footage. The recorded footage can be stored for a short period of time, for example 60 seconds. Then, when an alert is generated, the recorded footage can provide the system operator the footage of the short time period to document the problem. For example, this could be 30 seconds before the alert and 30 seconds after. This can provide additional information to a repair technician in order to quickly identify event triggers and provide appropriate repairs as quickly as possible for an equipment operator, such as a customer. The system operator then has an opportunity to provide a high First Call Fix (FCF) rate—a quick and accurate response without having to make multiple trips to the equipment location. The system can also identify issues such as equipment misuse by individual operators. As proof of misuse is not currently practiced in the industry this has significant advantages for training purposes, loss prevention, equipment longevity, and other business aspects.

These embodiments can have broad applications. One example is installing cameras on four sides of an automobile. An insurance company can then have a "black box" of video to view circumstances around the automobile before, during and after an accident. This could be in combination with sensors installed in the car panels which measure impact and speedometer sensors. As such, a comprehensive record of circumstances inside and outside the vehicle could be instantly sent over a network to a database for automatic review based on specific circumstances algorithms and then for review by system operators.

In the example embodiment equipment 1001 may be controlled by PLC 1002 and thus be communicatively coupled. Monitoring device 1004 can read signals on PLC 1002 and forward them over network 1006 to servers 1400, 1500. Monitoring device 1004 can communicate with a linked PLC in order to control the linked equipment.

This control can be accomplished via serial communication with the equipment. Alternatively or additionally, signals can be generated and sent to the PLC as if it were sent by the equipment. Also signals that the PLC sends to the equipment can be identified and recorded. Communication back and forth with PLCs 1002 can be achieved without writing to PLC memory or otherwise affecting PLCs 1002. Rather, Monitoring device 1004 can be a passive device which merely listens or reads and records data communicated by PLCs 1002. Monitoring device 1004 can also receive and/or read signals (such as state signals) from sensors 1003 which may actively or passively sense operation parameters of equipment 1001.

On equipment 1001 with a PLC 1002, as shown in FIG. 1A the equipment 1001 can be monitored by a monitoring device 1004 reading data from the PLC 1002 as mentioned above. In addition, input lines to the PLC 1002 can be read via a sensor 1003 such as an opto-coupler in addition to or instead of the monitoring device 1004 reading the PLC 1002. In addition, some embodiments can include a combination where data from the PLC 1002 and the inputs to the PLC 1002 are read. As an example, on some elevators, a PLC 1002 may only include information regarding whether a door is open after 6 seconds. If the PLC 1002 is read and used and a sensor 1003 such as an optocoupler is used to read the input (a passive implementation), a system operator can acquire the PLC 1002 data and instance information on the door usage over a network 1006.

On some equipment 1001, control of the equipment 1001 can be accomplished with an AC/DC relay switch (not shown). In this case monitoring and control is not passive but instead is active. Lines can also be read (e.g. voltage present or not present) to determine when a user presses a button or performs some other activity, rather than reading a PLC 1002, or monitored in conjunction with reading the PLC 1002.

Figure 1B:
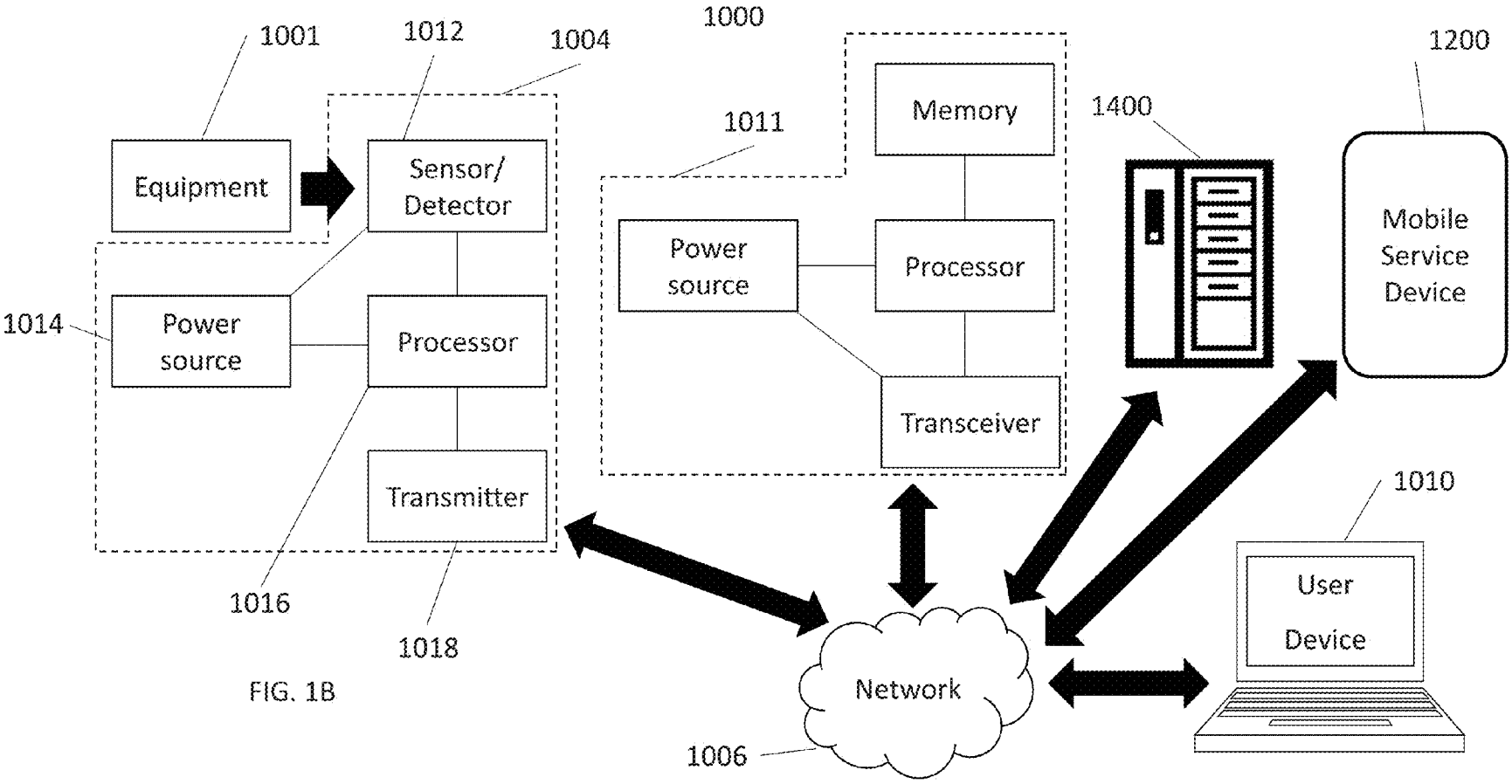
FIG. 1B is a diagram depicting an example embodiment of a network architecture in accordance with the present invention.

On equipment 1001 without a PLC 1002, as shown in FIG. 1B, the equipment can be monitored using a sensor/detector 1012 such as an opto-coupler or other sensor (as described above), which can be coupled with a power source 1014, processor 1016 and transmitter 1018 to read the presence of voltage on specific lines that drive the equipment 1001. Other example embodiments can include measuring temperature, humidity, g-force, movement and other data from different sensors designed to measure different values on non-PLC based equipment.

Servers 1400, 1500 may store event signals received from monitoring devices 1004 in a database as described with reference to FIG. 1B below. Server 1400 may send automatic notifications to mobile service devices 1200 in the form of status updates or when precautionary or emergency events are triggered in programmable logic in some embodiments. In some embodiments alerts or status updates can be customized to customer needs, desires and requests. Alternatively or additionally, servers 1400, 1500 may send automatic notifications to user devices 1010 which may then send notifications to mobile service devices 1200. In other embodiments servers 1400, 1500 may or may not communicate directly with mobile service devices 1200 over network 1006 and may also communicate with server 1500. Server 1500 can include service database 1510 as further described below in the description of FIG. 1E.

Figure 1C:
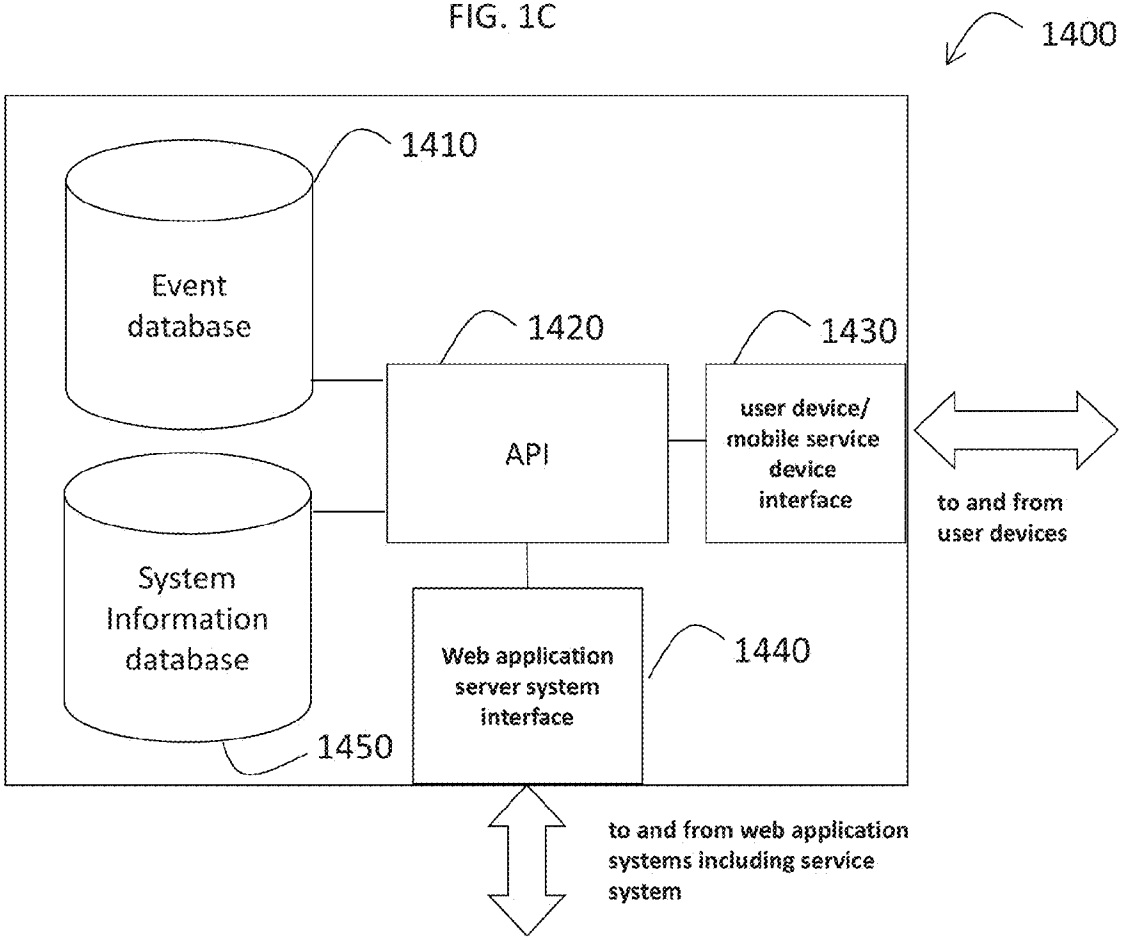
FIG. 1C is a diagram depicting an example embodiment of a server architecture.

FIG. 1C shows a diagram of a server architecture 1400 according to an embodiment of the invention including at least one user device/mobile service device interface 1430 implemented with technology known in the art for communication with user devices. The server architecture 1400 also includes at least one web application server system interface 1440 for communication with monitoring devices over networks, web applications, websites, webpages, social media platforms, and others. The server architecture 1400 may further include an application program interface (API) 1420 that is coupled to an event database 1410 and may communicate with interfaces such as the user device/mobile service device interface 1430 and web application server system interface 1440, or others. The API 1420 may instruct the database to store (and retrieve from the database) information such as link or URL information, user account information, associated account information, installed product specific data, or others as appropriate. The event database 1410 may be implemented with technology known in the art such as relational databases and/or object oriented databases, NoSQL databases or others. In NoSQL instances, it can be common for the types of data described herein to be stored in non-relational databases. An article that explains the difference can be found at: http://readwrite.com/2014/11/28/internet-of-things-nosql-data which is incorporated herein by reference in its entirety.

Figure 1D:
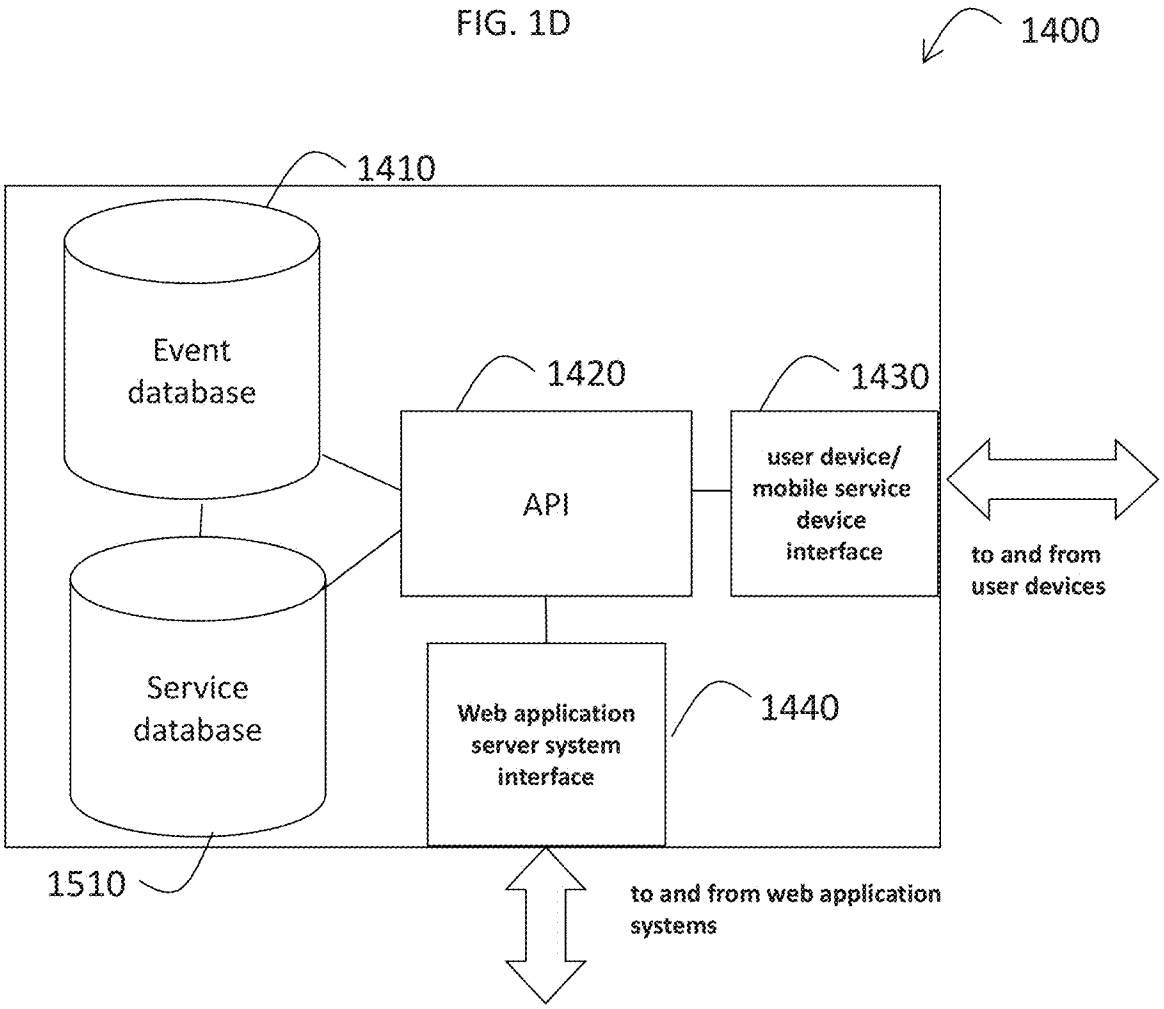
FIG. 1D is a diagram depicting an example embodiment of a server architecture.
Figure 1E:
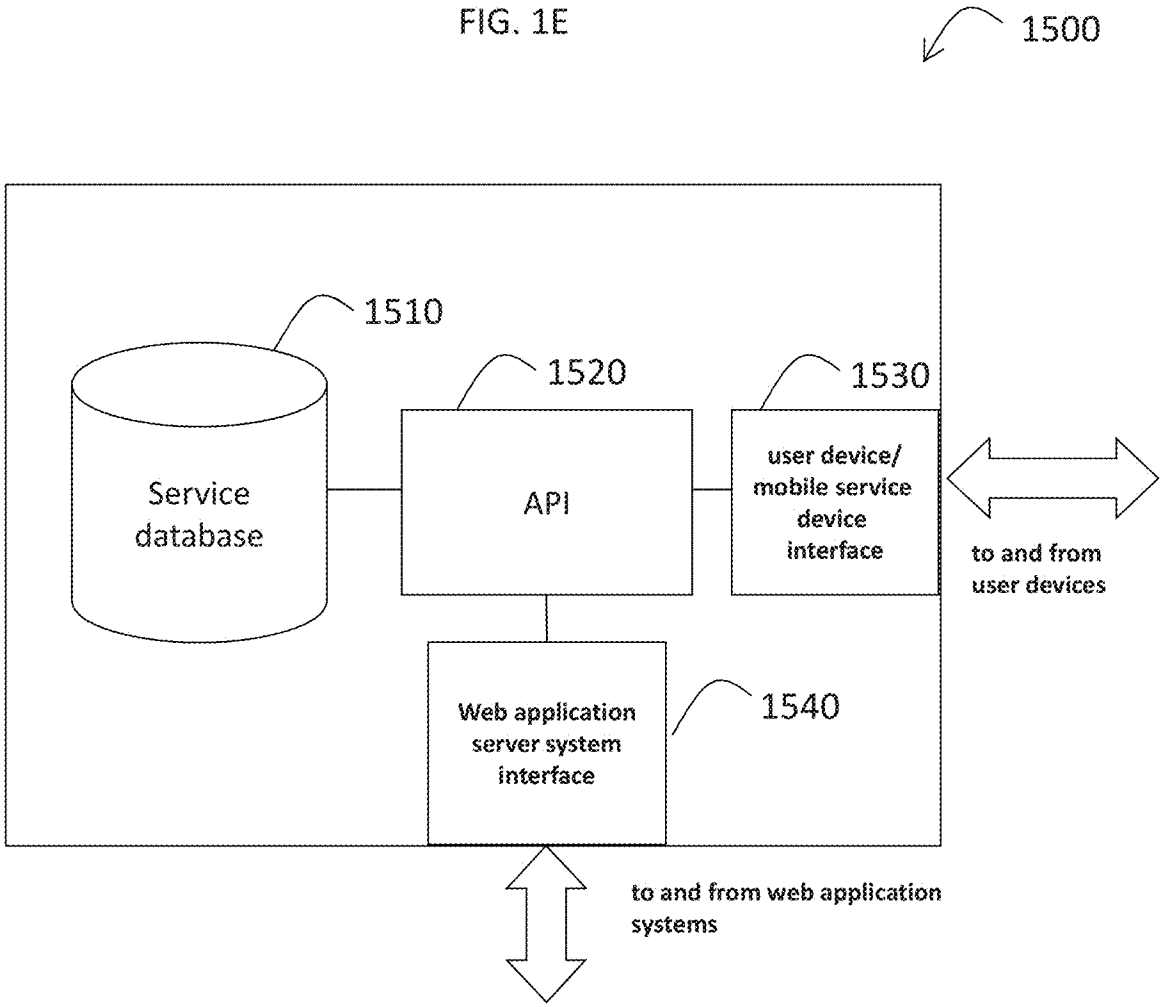
FIG. 1E is a diagram depicting an example embodiment of a server architecture.

FIGS. 1D-1E show diagrams of a server architecture 1400 according to an embodiment of the invention including at least one user device/mobile service device interface 1430 implemented with technology known in the art for communication with user devices. The server architecture 1400 also includes at least one web application server system interface 1440 for communication with monitoring devices over networks, web applications, websites, webpages, social media platforms, and others. The server architecture 1400 may further include an application program interface (API) 1420 that is coupled to an event database 1410 and may communicate with interfaces such as the user device/mobile service device interface 1430 and web application server system interface 1440 or others. The API 1420 may instruct the databases to store (and retrieve from the database) information such as link or URL information, user account information, associated account information, inventory information, geographical information, qualification information, error tracking information or others as appropriate. The event database 1410 and system information database may be implemented with technology known in the art such as relational databases and/or object oriented databases or others. In many embodiments event databases 1410 may store recorded event signals received via networks from monitoring equipment. These event signals may be associated with particular make/model/unique identifier information for customer equipment and may be stored in chronological order or otherwise logical schemes. The system information database 1450 shown in FIG. 1C can be used to store component information that may be used by a prediction modeler to make recommendations, as shown in an example embodiment in FIG. 1D.

In some embodiments high priority event triggers may cause server 1400 to send notifications and/or alerts to user devices and/or mobile service devices. For example if a monitoring device monitors an equipment jammed or stuck between states, this may trigger an urgent service required alert in the server 1400 and cause the server 1400 to send the alert to a mobile service device, system operator, and/or dispatcher in addition to equipment operators and owners of record.

In many embodiments event databases 1410 may store recorded event signals received via networks from monitoring equipment. These event signals may be associated with particular make/model/unique identifier information for customer equipment and may be stored in chronological order or otherwise logical schemes. Data collected in the form of event signals can be used to analyze patterns on equipment as described elsewhere herein.

It should be understood that servers and databases are not limited to single, fixed locations but can be distributed over many devices that may be geographically diverse and mobile. In some embodiments a van or work truck carrying particular inventory may locally track its own inventory and location but not update other vans or work trucks or a central database with this information unless polled by centralized equipment or other distributed equipment. In other embodiments information may be updated periodically or frequently based on various parameters. For example, information may be updated immediately after a change occurs, such as immediately after a service call. Alternatively or additionally, information may be updated only after a workday is complete. Alternatively or additionally, information may be updated hourly. Various other rules or requirements can also be implemented.

In some embodiments high priority event triggers may cause servers 1400, 1500 to send notifications and/or alerts to user devices and/or mobile service devices. For example if a monitoring device monitors a PLC signal indicating an elevator is stuck between floors, this may trigger an urgent service required alert in the server and cause the server to send the alert to a mobile service device and/or dispatcher.

In some cases, a system operator can lock down or disable a piece of broken equipment until a special passcode is entered by a technician at the broken equipment site based on a detected event and a trigger in a server. For example, an elevator monitor or sensor could detect a human in an elevator pit. The elevator could be stopped immediately and an image could be captured with a camera. The image and alert can be transmitted to a server via a network, which can be forwarded to user devices and/or mobile devices of different parties such as the equipment operator or customer, system operator, technician or others. Then a technician can be dispatched after a review of the image and alert. The technician can be forwarded a generated "enable" code as stored in memory or elsewhere. The technician can repair the problem or otherwise address the issue and enable the equipment by entering the enable code into the monitoring device 1004.

Additionally, on a portal, application or both a "countdown" to service for a device can be implemented as a timer or other clocking mechanism with a threshold. Currently, service is scheduled based only on time, such as once every three months, without a function of use measurement. A countdown can provide timing for service to the equipment as needed based on actual use of the equipment. If a company has many pieces of equipment and a countdown shows it is time to service a particular piece of equipment and not others, this could possibly demonstrate that the "load" of work is not being spread evenly over all the equipment. This can cause damage to one piece of equipment more quickly than others. The countdown can allow operational teams or management to evaluate their practices and change operations to spread the work load evenly over all pieces of equipment. As such, the company can better schedule by planning to have all their equipment "countdowns" come due at the same time. The system can recommend these operational recommendations based on automated analysis of equipment use, including historical trends for the individual piece of equipment as well as equipment lines. The countdown to service can be added to a chart on a user or operator dashboard. This can indicate a customer name and lists of equipment types as well as dates for service based on usage. This can allow system operators to draft legal disclaimers and other documents for equipment operators that do not schedule service for their equipment based on recommendations which can allow system operators insulation from liability for accidents. This is in direct contrast to current systems which are based on time rather than actual use.

As mentioned above, in some embodiments, a video or still frame camera can be mounted near or on the equipment and trigger a photo or video when a sensor alert is generated. Then a captured image or video can be transmitted to a web server so system operators can view the equipment. This too can be included with mobile services.

Triggers can also be related to GPS data in various embodiments. Information such as the latitude and longitude of equipment, or accurately monitoring moving equipment such as fork lifts as they drive around a facility can be gathered and stored. This data can be stored in a spatial database for analysis and create triggers that are based on spatial information. GPS data of technicians based on tracking carried devices can be matched with GPS data of equipment for fast and accurate deployment of resources.

Databases 1410, 1450 can be updated via an API 1420 so that when a technician arrives or even before arrival at the customer site, they can view information that an equipment operator is able to view through a portal. This can allow the technician to provide or reinforce recommendations based on the data.

Each time an event trigger is sent, it can be stored in a service database 1510, as shown in FIG. 1E so that system operators can generate an equipment history profile and note issues that equipment operators can find informative. Examples include uptime, downtime, frequency of use, frequency of maintenance, types of part replacements, upcoming maintenance issues, replacement recommendations, and many others. One real world example is in the case of a residential home elevator. Today when a prospective home buyer wishes to purchase a home a buyer must pay an inspector to come and inspect the property. Consider if there is a problem with the roof. In many cases, that roof could cost $30,000 to replace and the prospective resident could negotiate that repair into the purchase price of the home. However, today if a prospective resident wishes to purchase a home with an elevator there is no historical data for them to rely on to make that decision. A residential elevator can be an expensive device (around $30,000) and if there is a problem, the prospective purchaser may never know and it could be costly. The current system can be installed on these residential elevators and realtors and prospective home buyers can pay a subscription service or a per use fee to obtain the records of the equipment to help inform them in the purchase process.

Other examples of triggers for some equipment (both emergency and lower priority) include open car gate switches, open hall door locks, hall door not closed, bottom floor switch errors, operating on emergency power, operating in learn mode, encoder faults, shorted car gate switches, car safety circuit open, safety circuit is open, open car stop switch, stuck door zone relay, drive faults, elevator over speed, governor faults, PLC low battery, special reset sequence on, door zone switch failed to open and others. Other examples of stored information that can be monitored are wide-ranging and including (non-exhaustively):

Historical duration inconsistencies—for example, the system can monitor how it long it takes an elevator to go from a first floor to a second floor. On average it could take 10 seconds. On a particular day it may take 30 seconds. This can trigger an alert. Another example can include a high speed door slowing down. System operators and computer implemented algorithms can monitor data averages and signal subtle or drastic changes. Another example is an historical operating temperature average which has a drastic change. As described, historical data can be an important indicator when viewing triggered outlier events.

Expected normal use of equipment—The average time based on historical data can indicate misuse of equipment in specific instances. For example, the time for a dock leveler lip to go down during normal use can be identified based on historical data and can indicate misuse if drastic changes appear in the data.

Earthquake or other natural disaster impacts to equipment—For example, accelerometers can measure actual movement of the equipment during earthquakes. This can trigger automatic locking of equipment. System operators can be notified such that they can inspect equipment for damage before unlocking equipment for normal use again by equipment operators. This can prevent further damage to equipment, injury and loss of life.

Operation outside of manufacturer specified recommendations—Equipment specifications can be stored based on manufacturer recommendations and triggers can indicate when a sensor detects a piece of equipment is operating outside of recommended ranges. This can include comparing actual usage to recommended use stored in a database to indicate equipment overload or failure. For example, if a manufacturer specification indicates a piece of equipment should pull between 250-400 Amps and the equipment is pulling 600 Amps, this can indicate that a motor is malfunctioning or an elevator overloaded. Another example is a manufacturer specification of an operational temperature where monitored data from sensors on the equipment indicate that the equipment is exceeding a threshold. This can trigger an alert. This can be important in the example embodiment of a vertical reciprocating conveyers measuring a pressure valve, internal pressures, and other important information or similarly on a hydraulic elevator.

Usage during off time/date—System operators can store customer expected time of usage and the system can trigger an alert if the equipment is used during times when it is not expected to be in use. For example, a school wheel chair lift being used at 2 am or a dock door or high speed door in a factory is raised at 3 am when the facility should be closed or shut down. In other embodiments equipment can be locked out or programmed to be nonfunctional during particular time periods.

Other examples include high voltage or low voltage, a human or a living thing is sensed in a dangerous position with respect to equipment, power outage detection, and more. FIG. 3B and its associated description below show example embodiments of monitored data.

Examples of other parts which may be monitored include drive and lift chains, pillow block bearings, chain tensioners (upper and lower), wheelblock wheels, wheelblock guide rollers, wheelblock safety cams, chain sprockets, brakes, reducers, enclosures, gate interlocks, gates, geared couplings and others. While many of these parts are currently maintained with regularity frequency on the order of months—such as three, six, nine, twelve, twenty-four or others—the current system allows for more precise knowledge of actual operation statistics and proactive determination of maintenance scheduling. Conditions such as extreme temperatures, outdoor locations, corrosive and/or contaminated environments and others may affect normal operation and sometimes require use of particular lubricants or other treatments in order to provide optimal performance and knowledge of these variables is greatly enhanced using the system described herein. While standard industry recommendations such as "check oil levels and quality every 5000 hours of operation", "change oil every 10,000 hours of operation or two years", etc. may be manufacturer recommendations, these types of statements are used more as suggestions than precise guidelines because actual usage guidelines are currently unknown. Event database 1410 provides much more specific knowledge of actual operating parameters, event triggers and frequency, standard operating abilities and other equipment specific information.

Symptoms such as gate open/ajar, main disconnect off, thermal overload tripped, control fuse blown, power circuit between disconnect and starter is dead, slack lift/tensioner chain, broken lift/tensioner chain, safety gate open, object encountered, drive component interference, jammed relay, travel limit switch failure, brake failures, mechanical interference, debris in pit, interference between chain guards or guides, shaft/idler sprocket bearings problems, wheel guide rollers worn, slide shoe rubbing main beams, carriage not level, load exceeding capacity, single phasing, and other problems may be monitored and logged in database 1410. Pattern analysis can then be performed by processors running on the server in order to analyze the data.

In some embodiments if a triggering event occurs an alert may be sent to a separate service system including at least one service database where a case may be created and then sent to a user mobile device.

FIG. 1E shows a diagram of a server architecture 1500 according to an embodiment of the invention including at least one user device/mobile service device interface 1530 implemented with technology known in the art for communication with user devices. The server architecture 1500 also includes at least one web application server system interface 1540 for communication with monitoring devices over networks, web applications, websites, webpages, social media platforms, and others. The server architecture 1500 may further include an application program interface (API) 1520 that is coupled to a service database 1510 and may communicate with interfaces such as the user device/mobile service device interface 1530 and web application server system interface 1540, or others. The API 1520 may instruct the database 1510 to store (and retrieve from the database 1510) information such as link or URL information, user account information, associated account information, service data or others as appropriate. Service data may include and is not limited to cases including information about service requirements, technician needed, parts examined, parts required, parts fixed, and others. The service database 1510 may be implemented with technology known in the art such as relational databases and/or object oriented databases or others. In many embodiments service databases 1510 may store recorded service event signals received via networks from event databases. These service event signals may be associated with particular make/model/unique identifier information for customer equipment and may be stored in chronological order or otherwise logical schemes.

Figure 1F:
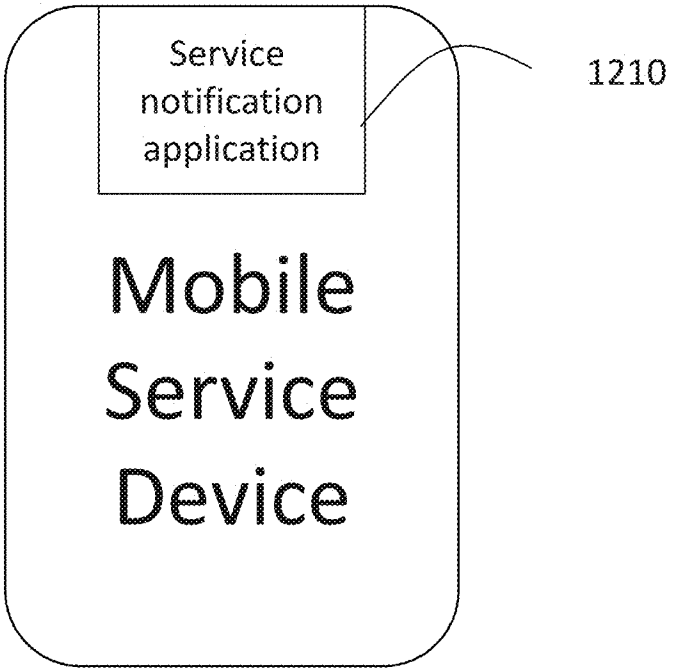
FIG. 1F is a diagram depicting an example embodiment of a mobile service device.

FIG. 1F shows a diagram of a mobile service device 1200 according to an embodiment of the invention that includes a network connected service notification application 1210 that is installed in, pushed to, or downloaded to the mobile service device. In many embodiments mobile devices 1200 are touch screen devices.

In various embodiments service notification application 1210 will notify a technician or other user that urgent service is required on a particular piece of equipment for a particular customer at a particular location. Mobile Service Device can communicate the technician's location to the server and the urgent notification can notify technician(s) closest to the equipment with the correct skillset to make the repair. Service notification application 1210 may display contact information and prompt the technician or other user to contact the customer by telephone, email, SMS, social media message or other communication means. Application 1210 can also indicate to a technician the cause of a malfunction and determine the probability of necessary parts based on a repair description and usage of the equipment in addition to the correct parts to bring to repair the equipment. This can allow the technician to repair the equipment faster for an equipment operator in order to minimize downtime and other costs associated with non-operation.

In various embodiments service notification application 1210 can notify a technician or other user that urgent service is required on a particular piece of equipment for a particular customer at a particular location. Service notification application 1210 may display contact information and prompt the technician or other user to contact the customer by telephone, email, SMS, social media message or other communication means. In some embodiments service notification application 1210 can notify the customer directly.

Figure 1G:
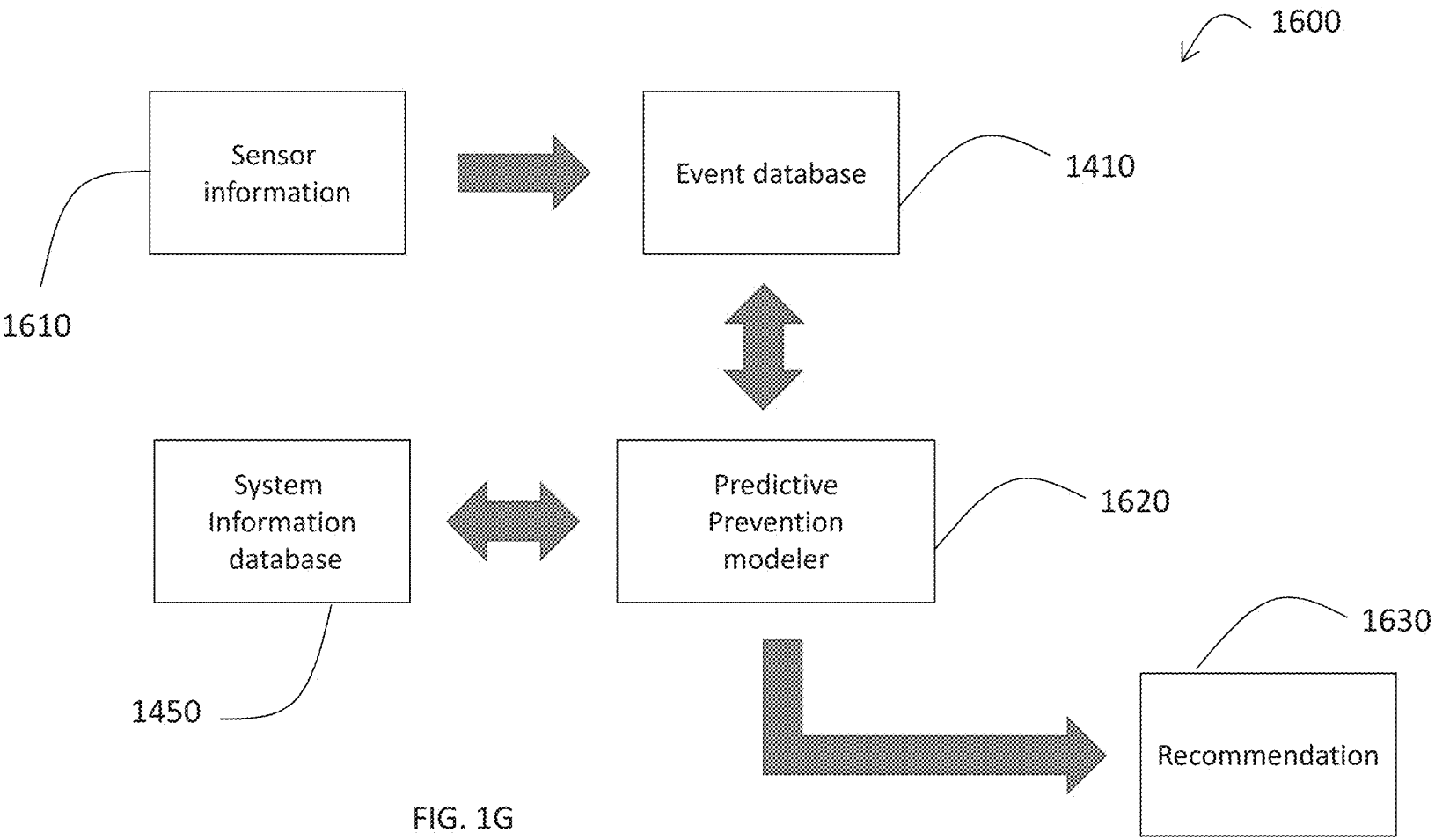
FIG. 1G is a flowchart depicting an example embodiment of data flow in a system.

FIG. 1G shows a flowchart of an example embodiment of data flow 1600 in the present system. In the example embodiment sensor information 1610 can be sent to event database 1410. A predictive prevention modeler 1620 can access or otherwise receive data from event database 1410 and system information database 1450 before processing the data to determine a recommendation 1630 for a particular piece of equipment. Recommendation 1630 can be sent to one or more locations and devices, such as to a central coordinator or dispatcher and one or more drivers or technicians. Alternately, recommendation 1630 can be sent to a single device for a technician to accept or reject and customer specific rules can be created for different models based on similar models for future use.

Service notifications can be pushed to a user device of a particular technician. In some embodiments service notifications can include an itemized list of the equipment service history in a logical order such as most recent event to least recent event. Additionally, any captured pictures or video and probable solutions to a current problem, issue or event can be pushed to the user device based on predictive or other learned knowledge stored in a database of the system for the particular piece of equipment, equipment line, family of products or manufacturer. Probable solutions stored in the database can be manually updated or can be automatically updated in various embodiments. Fixing equipment in a single trip saves customers money and knowing these probable solutions prior to arrival is one key to great service. In some embodiments service notifications can include preventative maintenance suggestions based on previously measured qualities of similar equipment. For instance, if a particular brand of loading dock is known for having a particular part that has a tendency to break after 10,000 cycles and the loading dock at a particular location has run 9,000 cycles then the system may recommend preventative maintenance or replacing the part before it can break. This recommendation can be provided in addition to a recommendation for currently required maintenance.

Figure 1H:
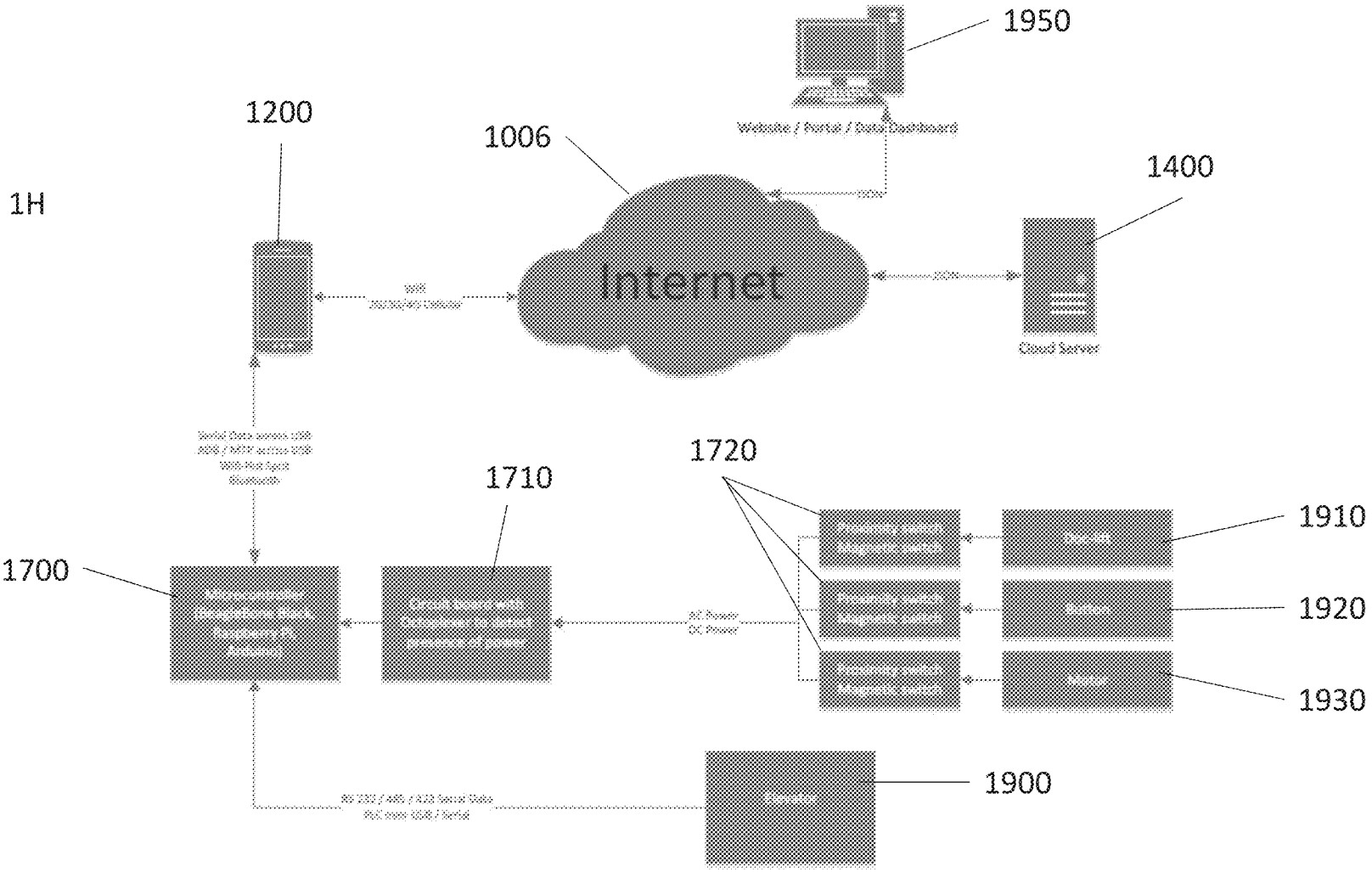
FIG. 1H is a diagram depicting an example embodiment of a system overview.

FIG. 1H shows an example embodiment of a system overview in accordance with the present invention. In the example embodiment multiple pieces of equipment 1910, 1920, 1930 can be monitored by equipment monitors 1720. An elevator 1900 with serial data monitored over RS 232, RS 485 or RS 422 connector attachments to a PLC is being monitored by microcontroller 1700 or larger microcontroller board setup such as BeagleBone Black by TI, Raspberry Pi or Arduino over USB or serial connection. Additionally, states of dock lifts, buttons, and other motors can be sensed by switches 1720 such as proximity switches or magnetic switches. These switches can generate binary 1 or 0 signals indicating power or no power as switch closed or open. Additionally or alternatively, switches or monitors creating non-binary signals can also be used. For example, an accelerometer measuring an elevation angle of a dock to determine a position of operation. A circuit board 1710 receives the signal from the switches or monitors and may perform processing such as multiplexing before sending the data to the microcontroller 1700 or microcontroller board setup. After processing, serial data may be sent across USB ADB/MTP and additionally or alternatively over Wi-Fi, Bluetooth or a variety of RF technology, including LORA, Zigbee, XBEE, and raw communication over open RF spectrum (915 MHz and 2.4 GHz), or any future developed protocols to a monitoring device 1200 such as a smartphone, tablet or other computer. Additional processing may be performed before sending data over Wi-Fi, 2G, 3G, or 4G cellular networks and the internet 1006 before being transferred over JSON to a cloud server 1400 and additionally or alternatively to a website portal or data dashboard 1950.

FIG. 1I shows an example embodiment of a system overview with multiple monitors in accordance with the present invention. In the example embodiment sensors or switches 1730 monitor dock lifts 1940. While one switch is shown as monitoring one dock lift, in some embodiments multiple switches can be used to monitor a single dock lift. Output from a defined set of switches is sent to a circuit board 1710 with a multiplexer to detect states of the dock lifts. Each circuit board is in communication (which can be wireless through Wi-Fi, Bluetooth, LoRa, Zigbee, Xbee, or others) with one or more microcontrollers 1700 which can send data over Bluetooth or other networking protocols to a computing device 1200 such as a smartphone, tablet, modem or other computer. This information can then be sent over Wi-Fi or cellular networks such as 2G, 3G or 4G and the internet 1006 before being transferred over JSON to a cloud server 1400 and additionally or alternatively to a website portal or data dashboard 1950. This data will then be related to service repairs and maintenance of the equipment as well as a service record.

Figure 2A:
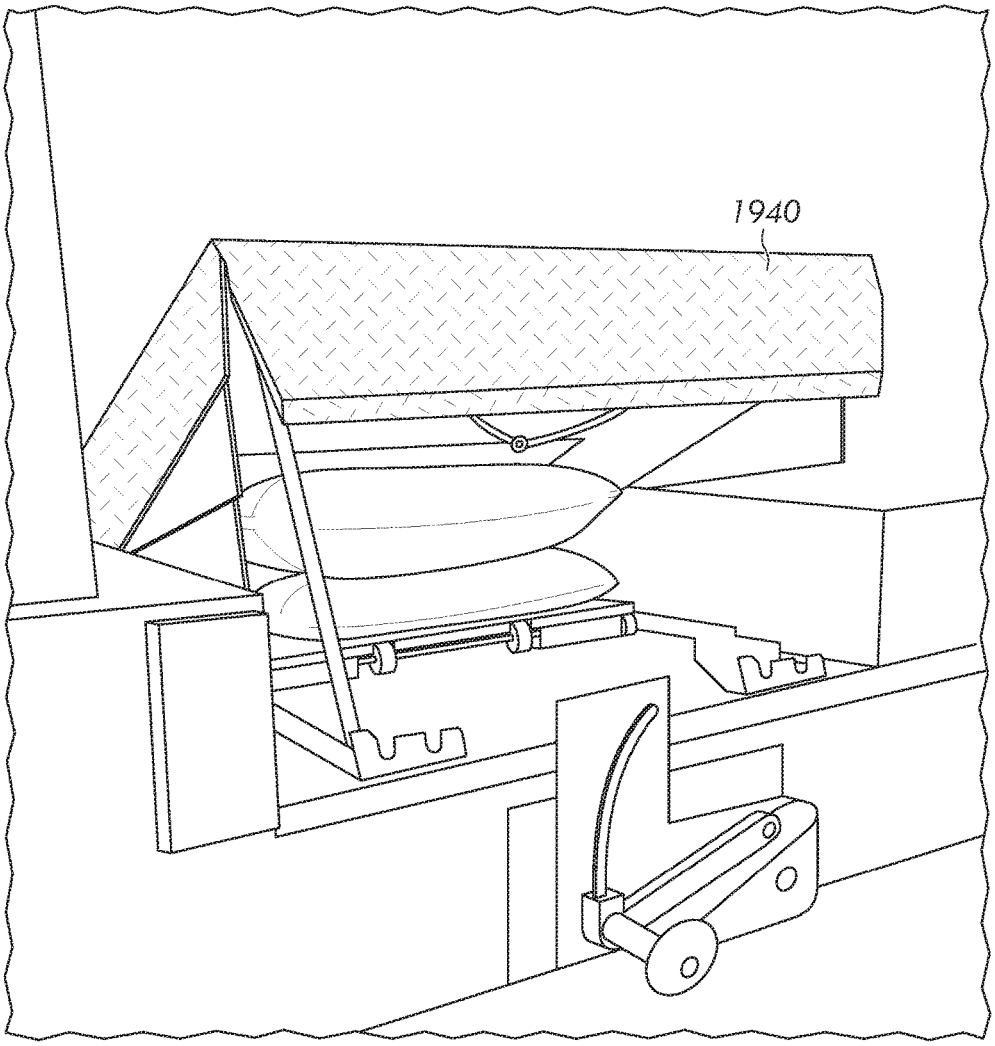
FIG. 2A is a view of an example embodiment of a loading dock lift.

Turning to FIG. 2A an example embodiment of a dock lift 1940 is shown. Dock lifts 1940 are commonly used in receiving bays at warehouses, retail stores and other locations where shipping cargo from large trucks is unloaded. The dock lift 1940 can serve as a ramp in some embodiments to create a gradual incline or decline from the loading bay floor to the floating floor of a shipping truck. Dock lifts 1940 in some instances can also be platforms which maintain a level surface parallel with the ground to move cargo up and down from the interior of a shipping truck to a desired level. In the example embodiment shown in FIG. 2A the dock lift 1940 is shown in a raised position.

Figure 2B:
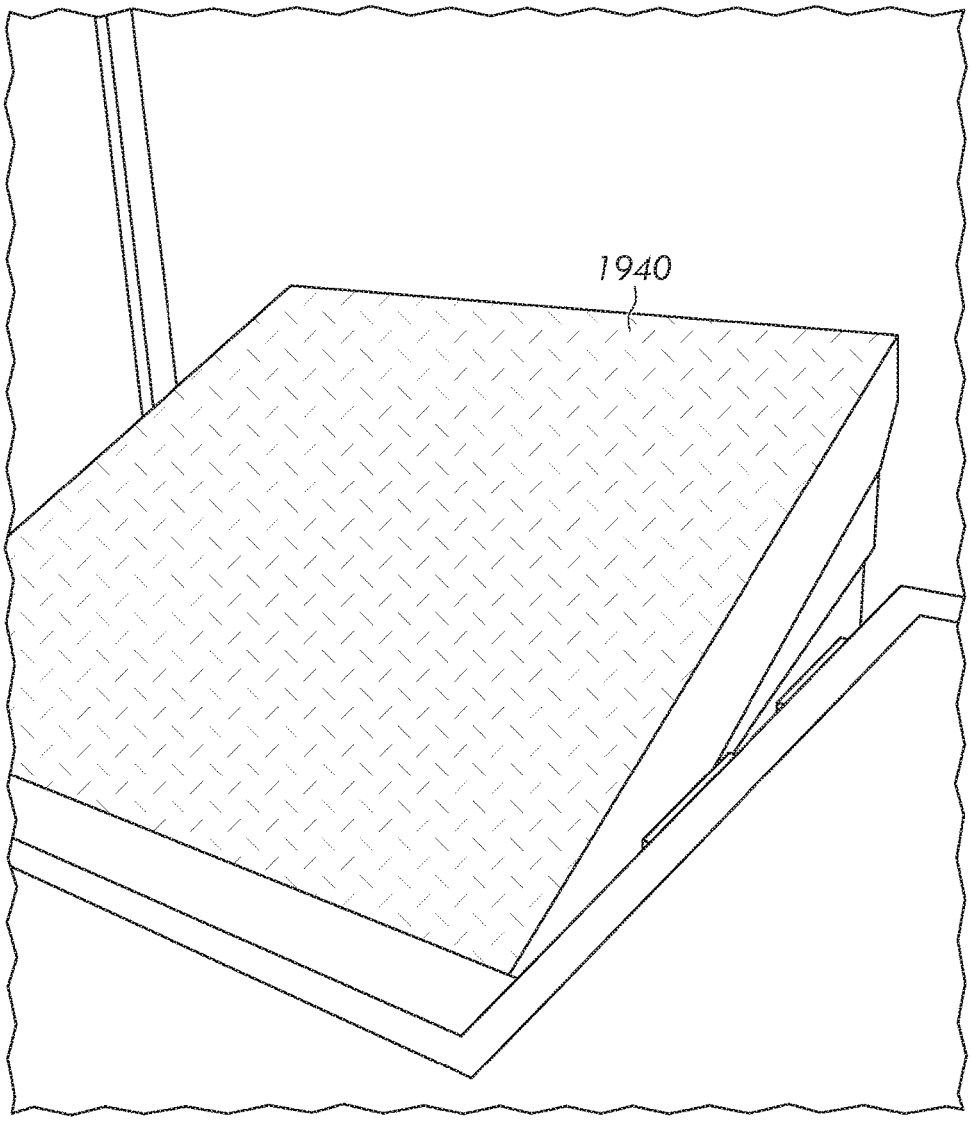
FIG. 2B is a view of an example embodiment of a loading dock lift from inside a loading dock.

Turning to FIG. 2B, a view of a loading dock lift 1940 from inside a loading dock in accordance with the present invention is shown. In the example embodiment the loading dock lift 1940 is shown in a raised position. When the loading dock lift 1940 is in an orientation such as that shown, the system can store data relating to the time in the up or lifted orientation. Cycles can be determined based on calculations such as tracking each up and down movement of the lift 1940. More complicated statistics can also be tracked if equipment does not complete a full cycle. For instance, a lift 1940 may go to different heights for different sized trucks. As such, full lifts, half lifts, one-third lifts, and other distances and variables can be calculated in various embodiments.

Figure 2C:
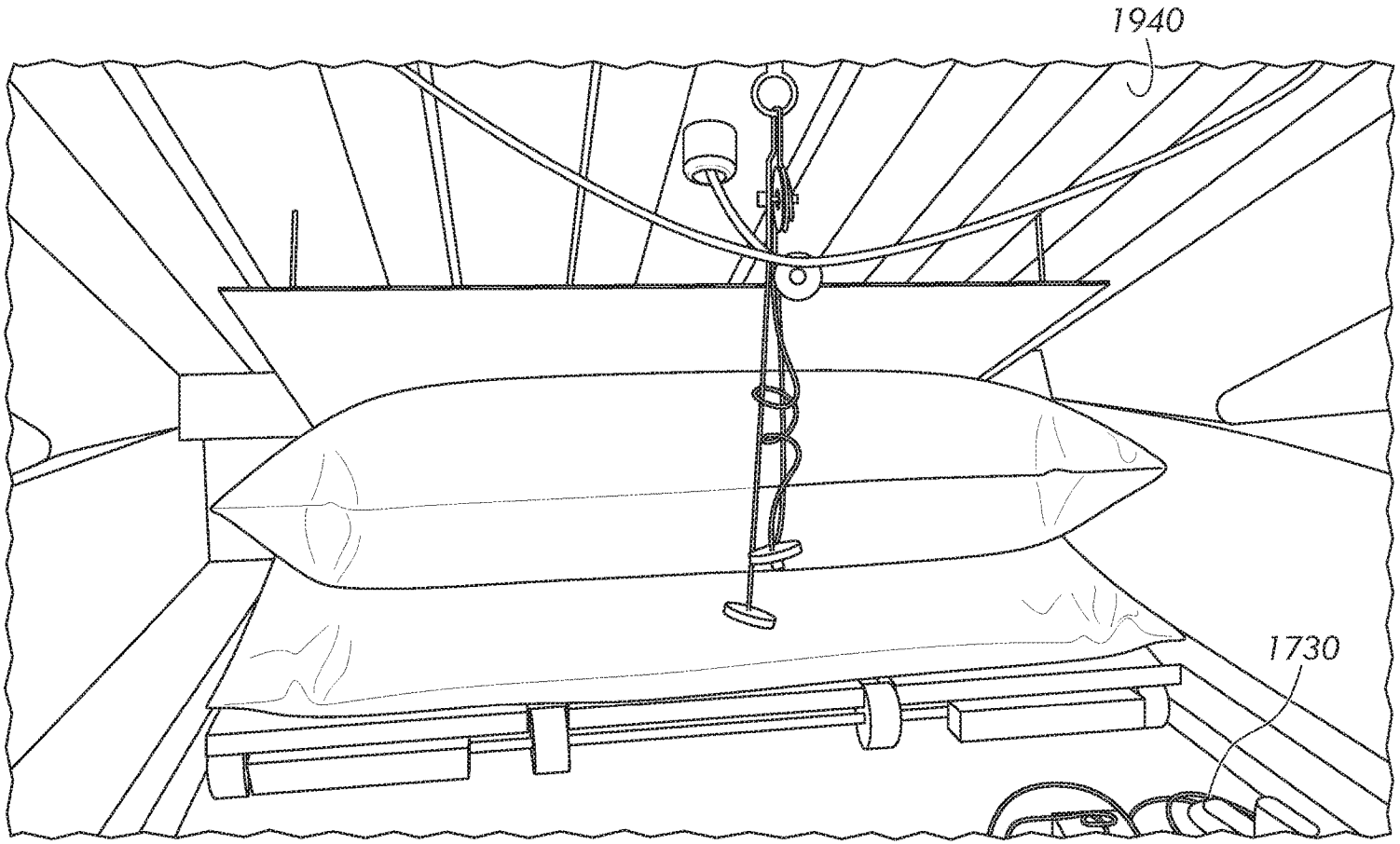
FIG. 2C is a view of an example embodiment of a sensor and associated circuitry for monitoring use of a loading dock lift.

Turning to FIG. 2C, an example embodiment of a sensor device 1730 for monitoring use of a loading dock lift 1940 is shown. In the example embodiment a sensing device 1730 can include one or more sensors or detectors, one or more microcontroller processors, memory, a power source and one or more transmitters.

In some embodiments one or more microcontroller processors can be customized for a particular application or can be general purpose with particular implementation instructions stored in memory and operable to cause the one or more processors to perform specific functions as required by the sensor device to achieve the goals described herein.

In some embodiments a power source for the sensing device can be a battery. In other embodiments the power source for the sensing device can be AC power as from common power infrastructure. In some embodiments solar or other power sources can be implemented. In some embodiments future power sources such as power over fiber optic cables can be used. In some embodiments a primary power source can be a battery while a backup power source can be AC power or vice versa. Another future power source could be wireless power, as described in the article at the link: http://www.wired.com/2015/06/power-over-wi-fi/ which is incorporated herein by reference in its entirety.

In various embodiments one or more transmitters or transceivers can be used to transmit data acquired by the sensing device. While in typical embodiments data transmission can be wireless using various currently used or future developed methods and protocols such as Wi-Fi, Bluetooth, cellular and others. In other embodiments, wired data communications can be used. Either wired or wireless can be used as a backup for each other and multiple protocols can also be used.

Figure 2D:
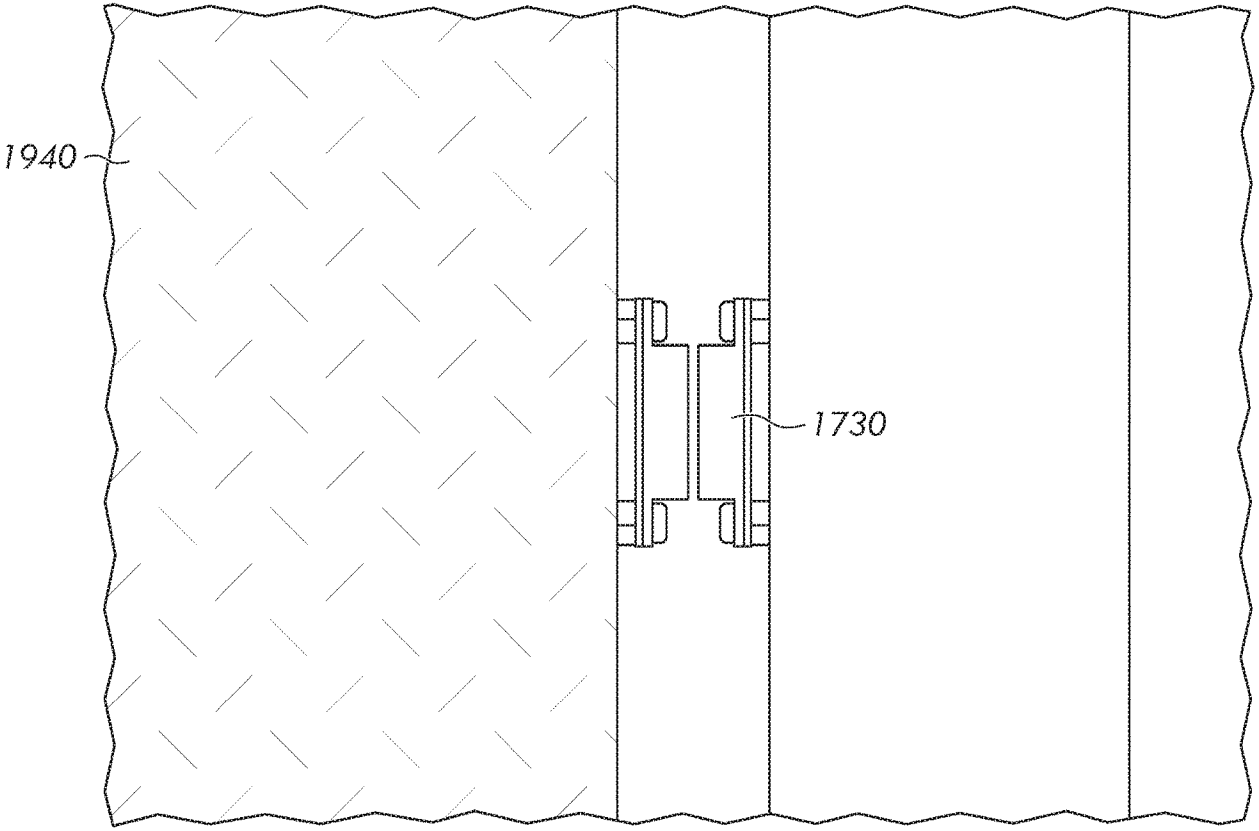
FIG. 2D is an example embodiment of a sensor in accordance with the present invention.

Turning to FIG. 2D, an example embodiment of a sensor or detector 1730 in accordance with the present invention is shown. In the example embodiment the sensor 1730 is a magnetic sensor comprised of two pieces and is placed on two separate but adjacent locations of a dock lift 1940. The first sensor piece is located on a movable portion of the lift 1940. The second sensor piece is located on a stationary portion of the lift. As the lift operates the first sensor piece moves away from the second sensor piece, therefore causing a state change. In this example, this can indicate that the dock lift has been raised. As the dock lift returns to its initial orientation the first sensor piece aligns again with the second sensor piece. This can indicate that the dock lift has been lowered. In some embodiments sensor data can be binary in the form of 1's and 0's such that only two states are monitored. In other embodiments distances or variable sensor data can be monitored such that associated monitoring equipment can determine how the equipment moved, such as how high a dock lift was raised. In the example embodiment a dual or two piece magnetic sensor is used, one sensor piece with a magnetic field affects the other sensor piece to create a state change. Wires are used to connect the sensor pieces to a monitor which processes the data.

Figure 2E:
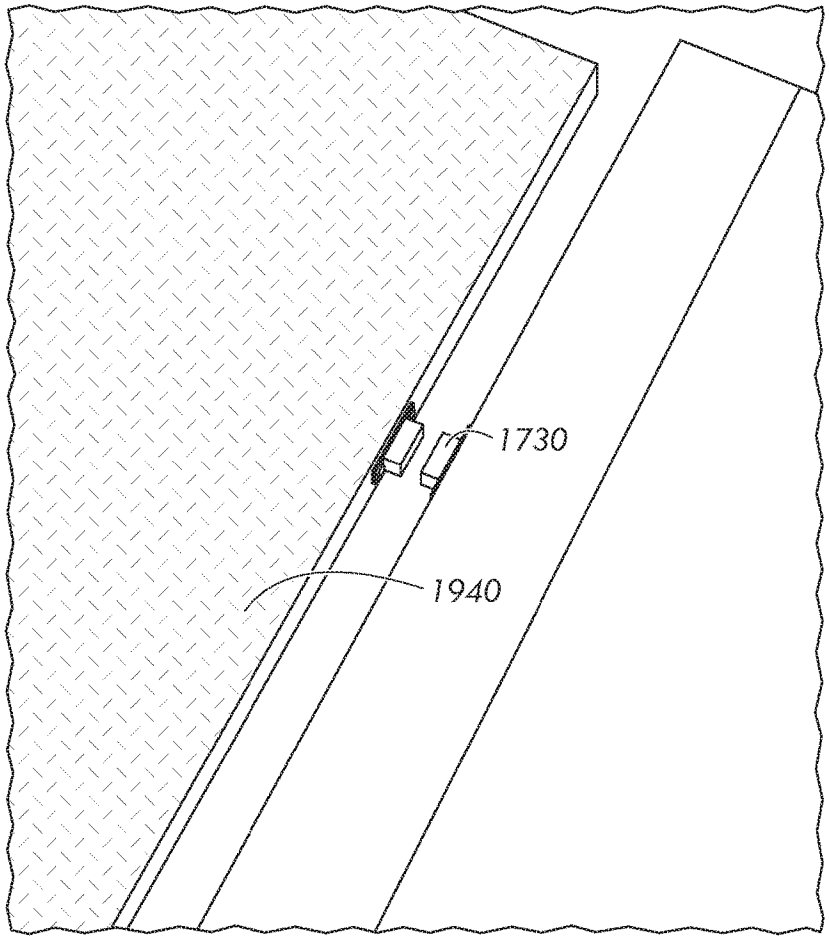
FIG. 2E is an example embodiment of placement of a sensor on a dock lift in accordance with the present invention.

FIG. 2E is an example embodiment showing placement of a sensor 1730 on a dock lift 1940 in accordance with the present invention. The sensor 1730 shown is located near the end portion of the dock 1940 which raises and lowers to meet the rear of the truck. In the example embodiment a single sensor is used to detect a single state change while in other embodiments a single sensor can be used to monitor multiple state changes or multiple sensors can be used to detect multiple state changes.

Figure 2F:
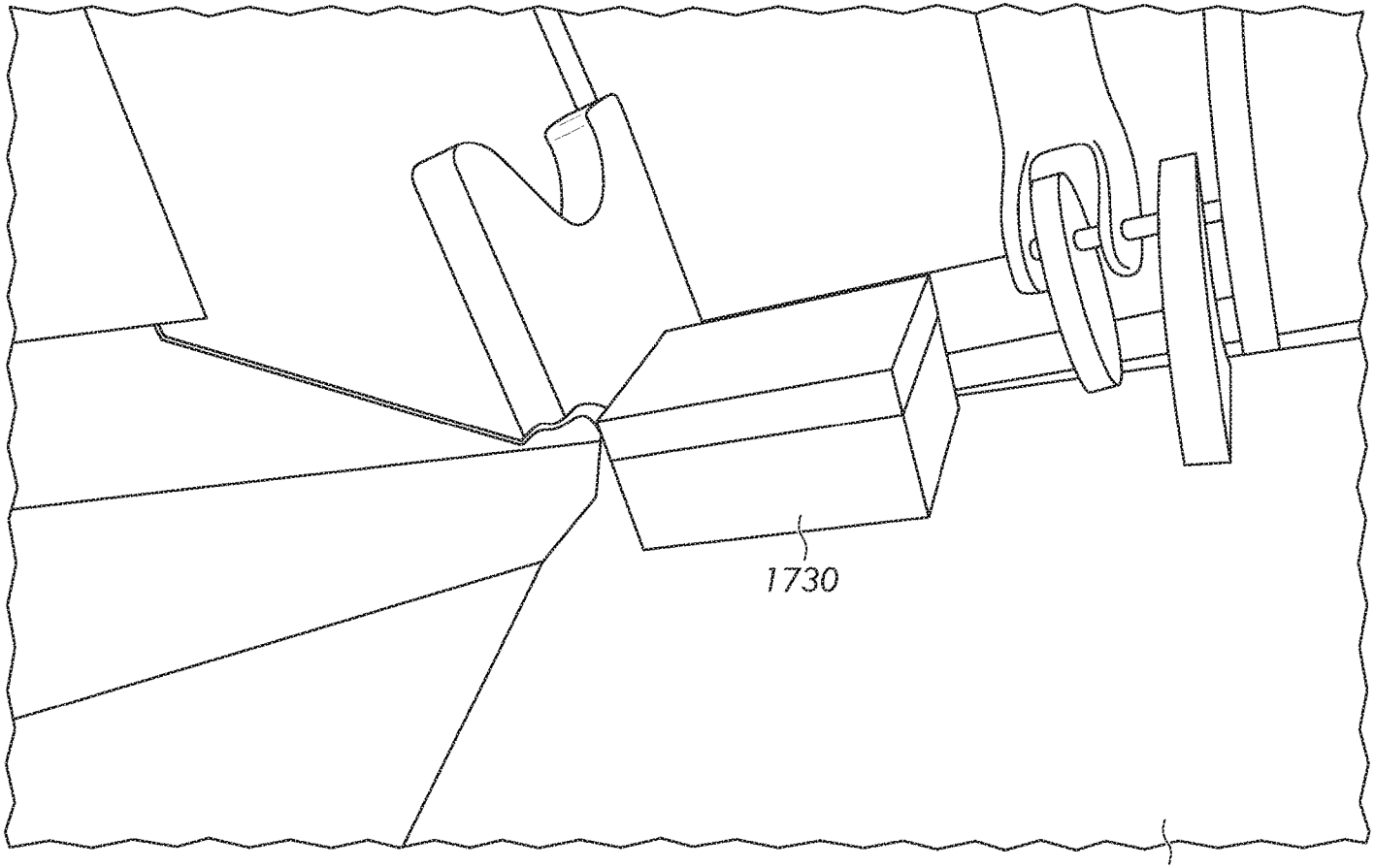
FIG. 2F is an example embodiment of a placement of a sensor on a dock lift in accordance with the present invention.

FIG. 2F is an example embodiment of a placement of a sensor on a dock lift in accordance with the present invention. In the example embodiment the sensor 1730 is located below a dock leveler lift 1940.

Figure 2G:
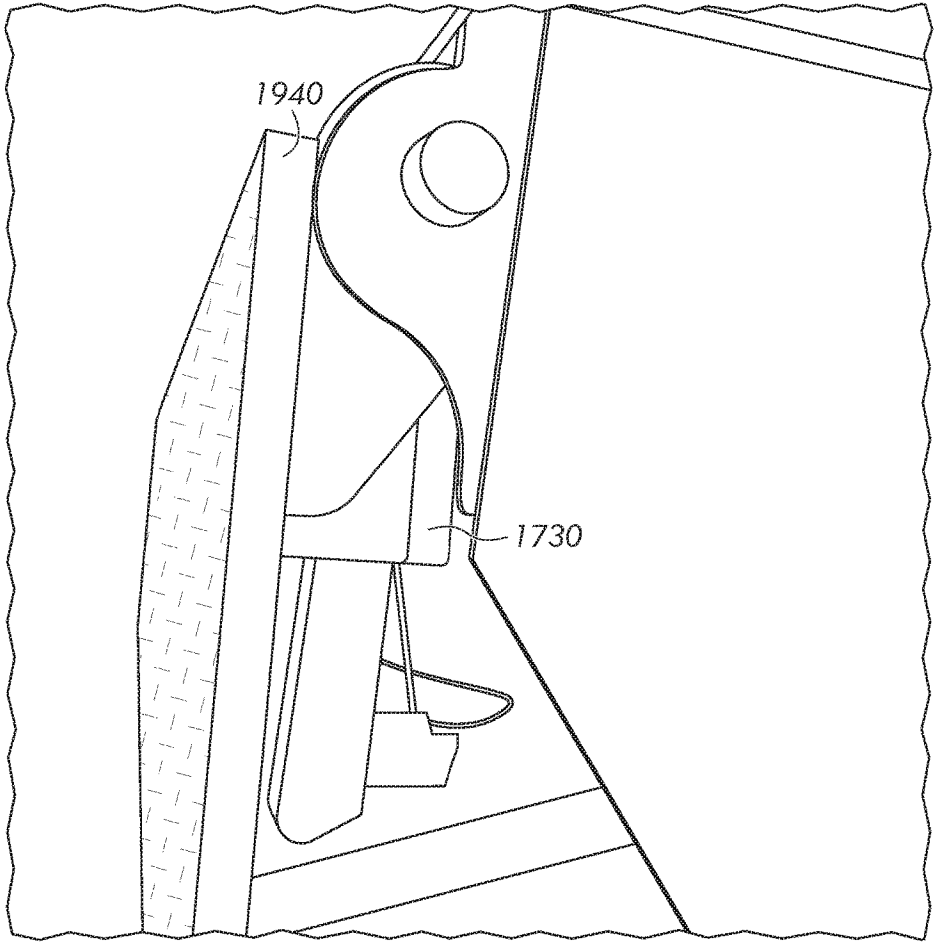
FIG. 2G is an example embodiment of a placement of a sensor on a dock lift in accordance with the present invention.

FIG. 2G is an example embodiment of a placement of a sensor on a dock lift in accordance with the present invention. In the example embodiment the sensor 1730 is located below a dock leveler lift 1940.

Figure 2H:
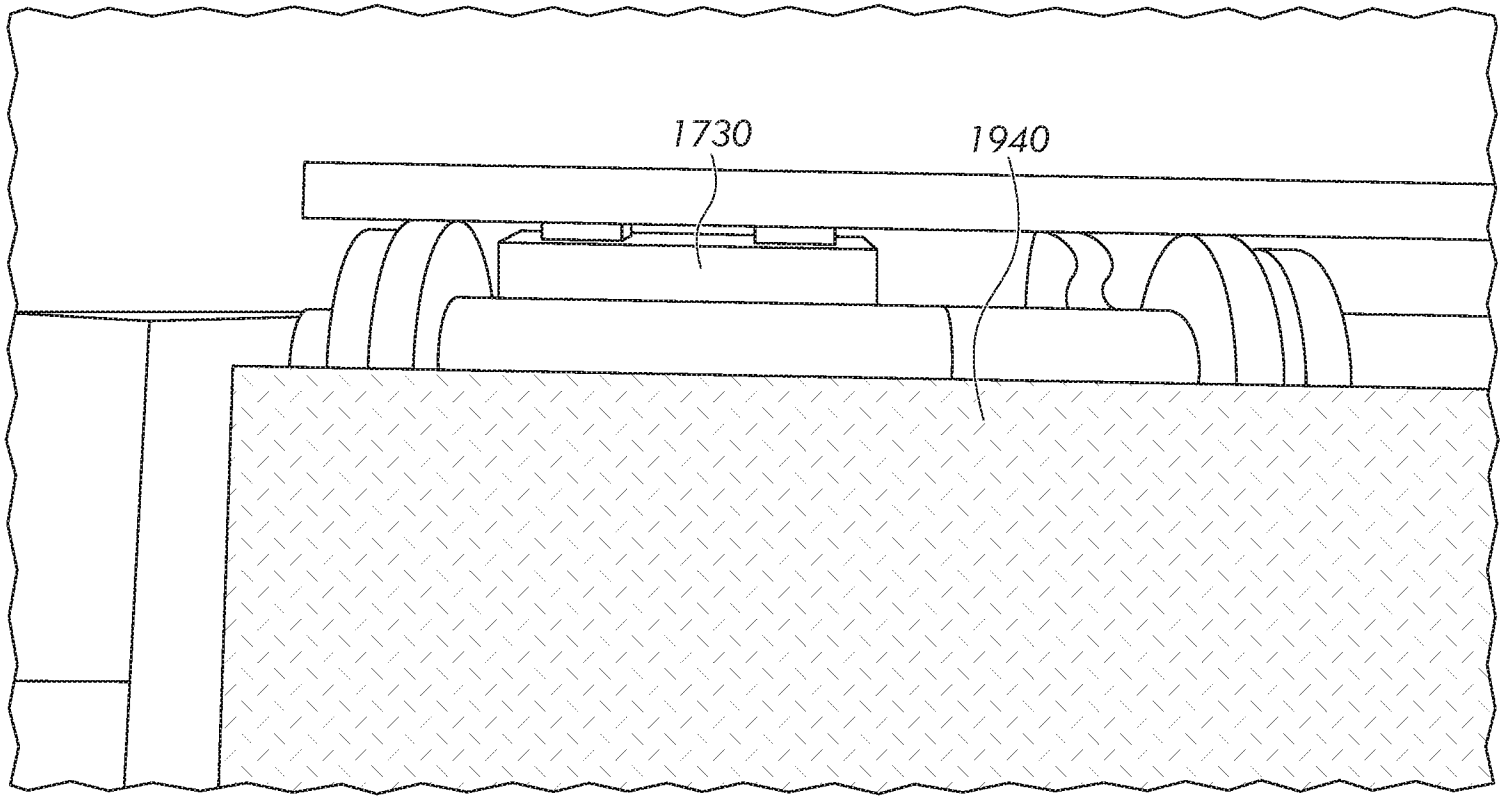
FIG. 2H is an example embodiment of a placement of a sensor on a dock lift in accordance with the present invention.

FIG. 2H is an example embodiment of a placement of a sensor on a dock lift in accordance with the present invention. In the example embodiment the sensor 1730 is located below a dock leveler lift 1940.

Figure 3A:
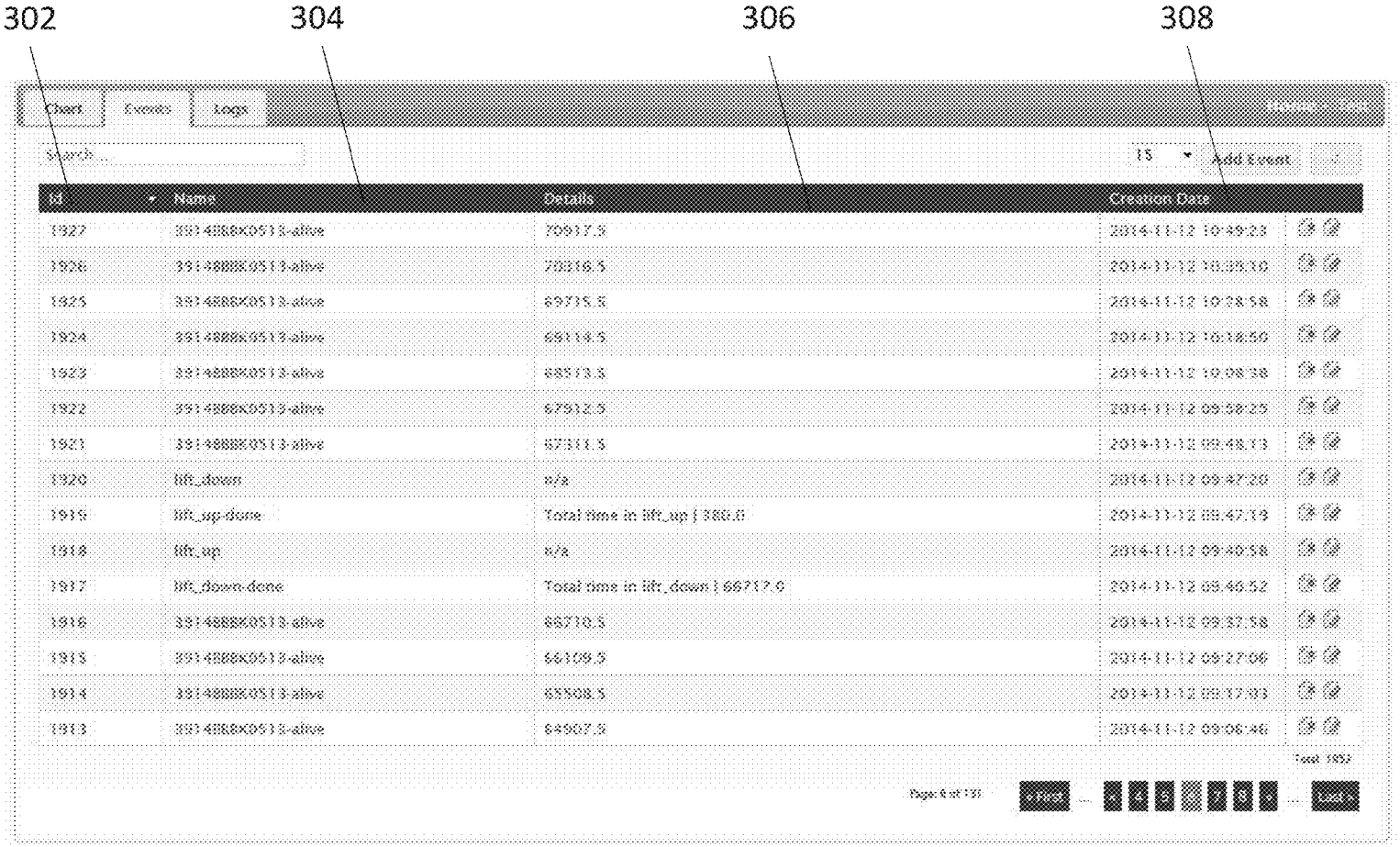
FIG. 3A is an example embodiment of a data screen showing data acquired through use of a sensor in accordance with the present invention.
Figure 3B:
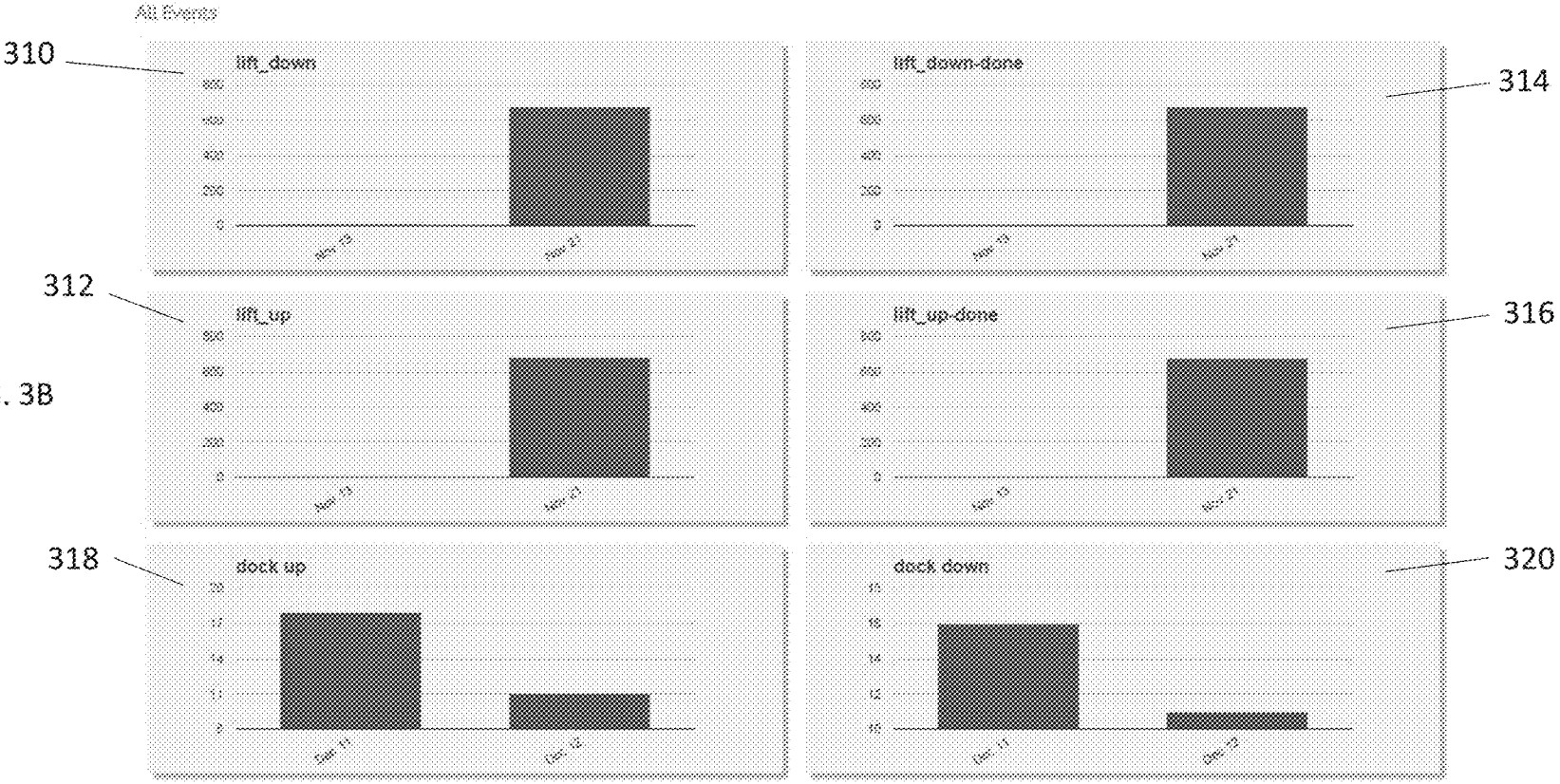
FIG. 3B is an example embodiment of graphical representations of data acquired through use of a sensor in accordance with the present invention.

FIG. 3A shows an example embodiment of a data screen showing data acquired using a sensor in accordance with the present invention. In the example embodiment event identifiers are shown in a left hand column 302 of the interface. Event descriptions are shown in the next column 304 under "Name". Event descriptions can be different in different embodiments based on the particular piece of equipment being monitored. Since the example embodiment shows data for a dock lift there may only be a few machine states which are detected such as lift_up which indicates a lift is moving to the up position, lift_up-done which indicates that the lift has finished moving to and is now set in the up position, lift_down which indicates that the lift is moving to the down position, lift_down-done which indicates that the lift has finished moving to and is now set in the down position, and alive indicating that the sensor is operating properly although no state change has occurred. Details can be found for each event in the next column 306 which gives a more detailed description of the event in the name field. Creation date column 308 can indicate the date and time a particular event notifier was logged.

FIG. 3B is an example embodiment of a graphical representation of data acquired through use of one or more sensors in accordance with the present invention. The graphical information depicted includes state information such as lift_down 310, lift_down-done 314, lift_up 312, lift_up-done 316, dock up 318 and dock down 320. In different embodiments different types of depictions can include averages, ratios, durations, simple state change counting and others and may be depicted in numerous different fashions such as circular pie charts, bar charts, points on a graph, and many others. Total times per operation, number of operations per day, number of operations per hour, length of operations, and many other values can be tracked and correlated in order to provide users with the necessary recommendations and tools to improve service. Additionally, problems and opportunities for improved service can also be analyzed.

Data acquired from use of the monitoring system and methods described herein can be beneficial in determining lifespan information and coordinating the information with other, related information. For instance, equipment facing a particular direction can last longer than equipment facing a different direction. Exposure to elements in the Northeastern United States can cause different lifespan expectancies than in the Southwestern United States. Humid environments can be more corrosive than dry environments. Typical weight usages for dock lifts can be lighter in some applications than in others and can have different effects on the lifespan of the equipment. Numerous other variables can also be monitored and used in calculating efficiency and lifespan expectancies for future equipment development, purchase, service or other considerations.

In some embodiments, monitoring devices can be used to remotely monitor use of devices which require regular testing. For example, in some locations wheelchair lifts are required to be tested at least once a week. In these locations testing is done in person, by hand because no automated or remote system is currently available. In an embodiment of the present invention a monitoring device can be coupled with an automated device operator which runs a program that causes the lift to rise to a heightened position and return to a lower position during a time when no individuals will be using the lift. This can occur at off-peak hours such as at 3 am. The data can be stored in memory in a database and can be reviewed at any point. Alternatively or additionally, the system can send automated notifications to an administrator and a system operator indicating that the test has been performed and is successful or unsuccessful. Many other embodiments of this remote operation and monitoring also exist. Examples can include air conditioner tests run during winter months when air conditioners are not in use, heaters in summer months when the heaters are not in use, backup power generators at times when normal power is operating correctly, motors when not in use for periods of time and other equipment which has down-time but would benefit by being operated on a sporadic or periodic basis. For example, elevators installed at vacation homes. Additionally, a wide variety of industries and corporate compliance department can use this remote testing and operation in order to oversee individual operators of franchises or ensure that equipment is functioning properly at all locations, even if infrequently used.

Figure 3C:
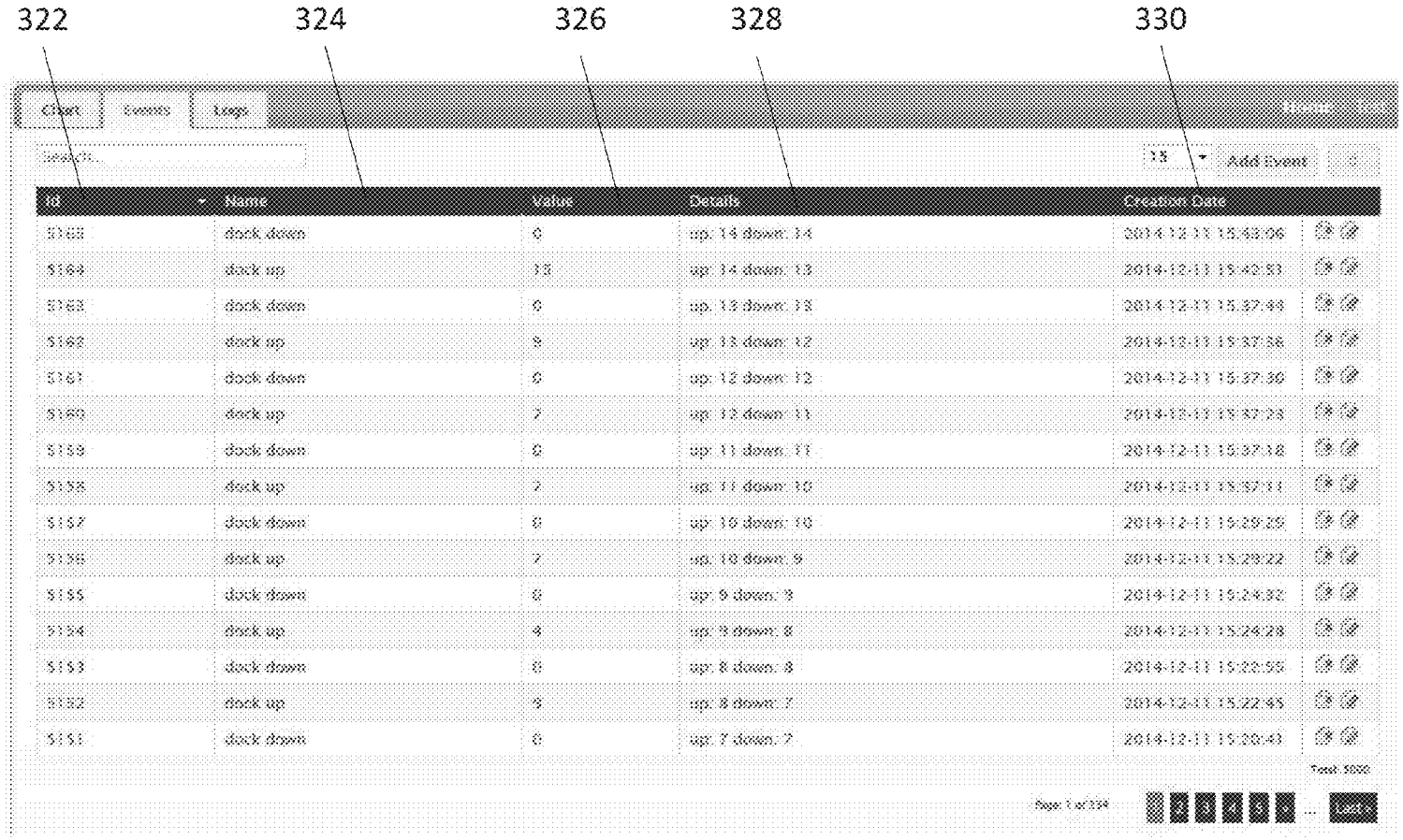
FIG. 3C is an example embodiment of a data screen showing data acquired through use of a sensor in accordance with the present invention.

FIG. 3C is an example embodiment of a data screen showing data acquired through use of one or more sensors in accordance with the present invention. In the example embodiment the Value column 326 in the chart is meant to represent the sensed value of the equipment in a particular state. For example, the second row shows the time the dock up state was sensed, a total of 15 seconds. This occurred on the 14th up cycle and 13 down cycles have occurred previously as indicated in the details section. The Creation Date column 330 indicates the date and time that the event occurred and the ID column 322 indicates the identity of the event. Additional or fewer columns can be added or removed as appropriate.

Figure 4A:
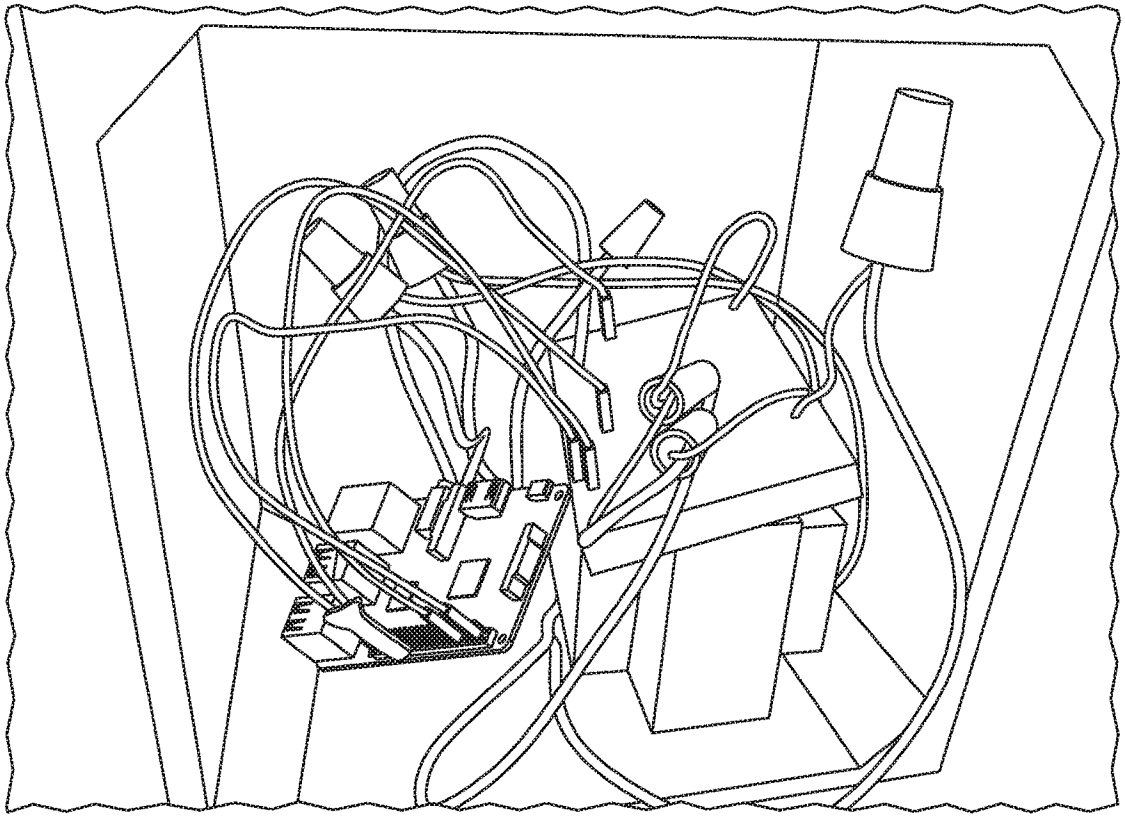
FIGS. 4A-4C are depictions of example embodiments of a transceiver for data.
Figure 4B:
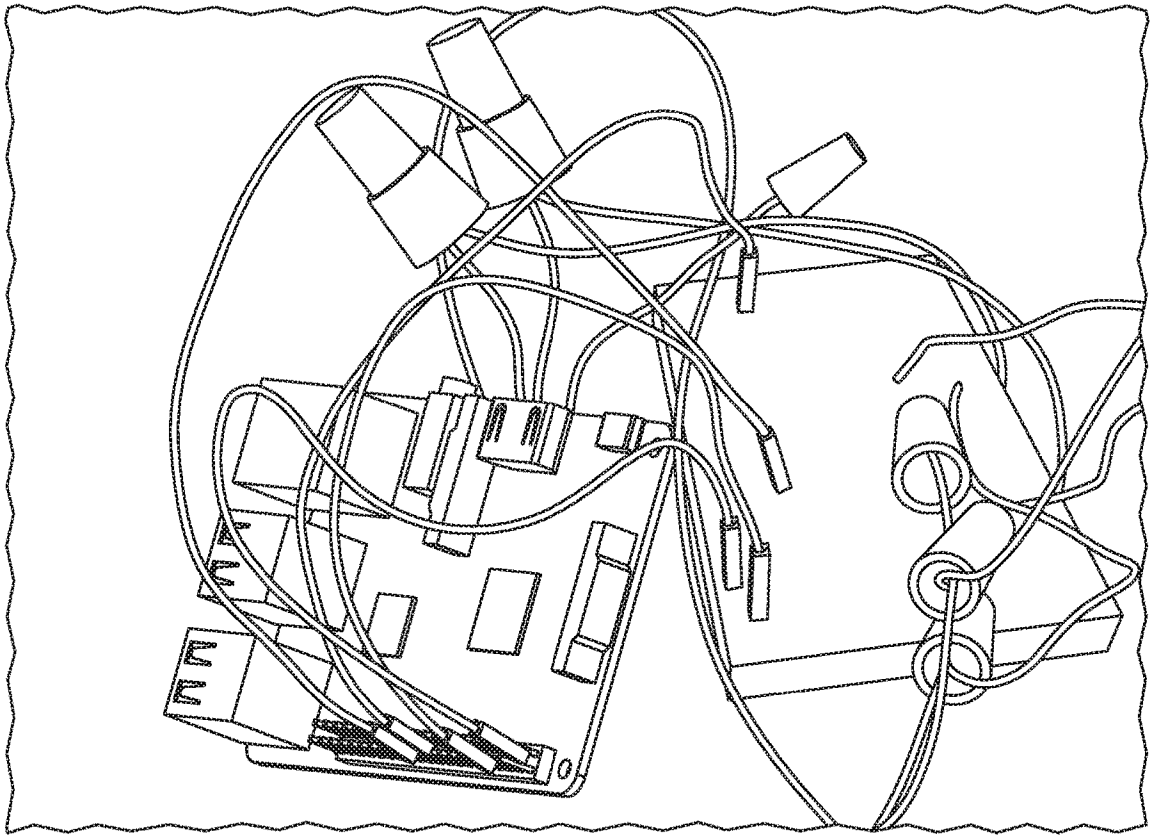
Figure 4C:
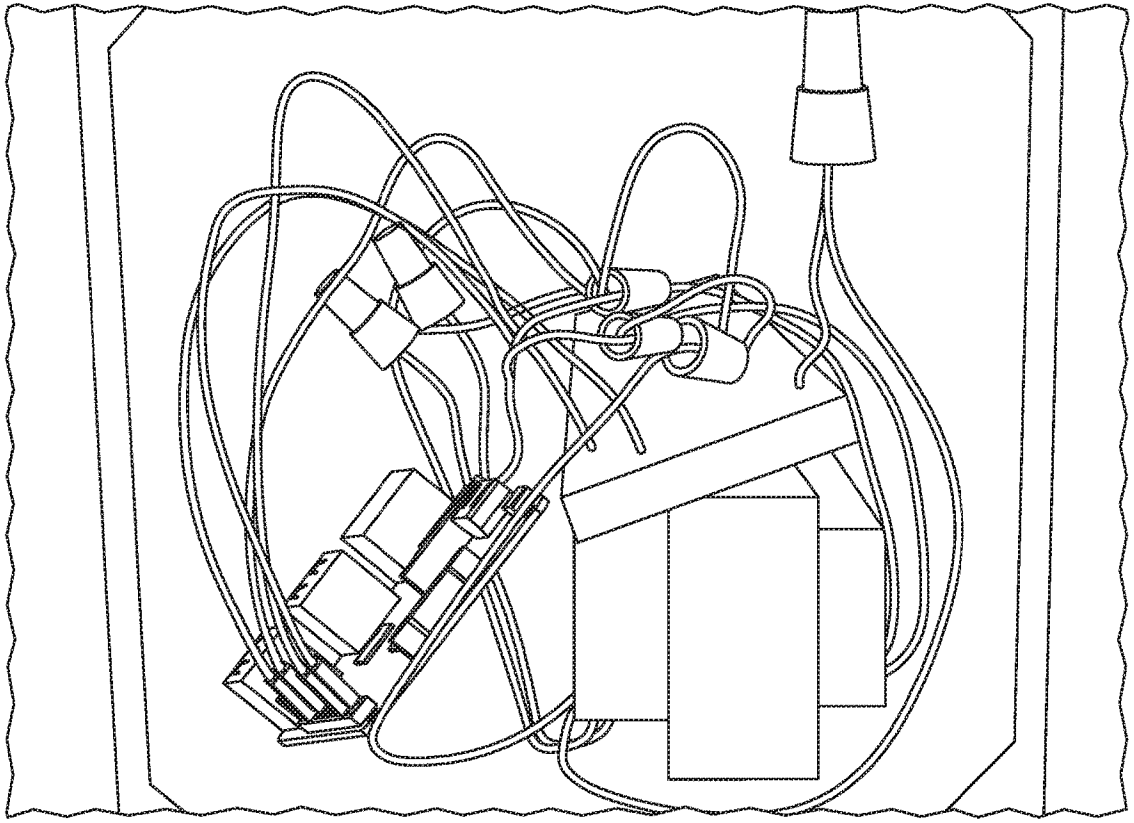

FIGS. 4A-4C show an example embodiment of monitoring equipment from different views in accordance with the present invention. In the example embodiment a microcontroller board is shown which interfaces with the sensor in order to monitor and record data which can be done on local memory or remotely. Communication can be accomplished through wired connections or through wireless connections as described elsewhere herein, using transceivers. A breadboard is included with transistors, resistors and wiring as is a transformer for power to the monitoring equipment. As would be understood by one in the art, arrangement of these components and others including capacitors, diodes, converters, LEDs, connectors, enclosures, regulators, semiconductors, thermal sinks, and many other components can be implemented as appropriate based on different sensors used, environmental conditions, microcontroller requirements, safety, security, power regulating and other considerations. Additionally, while the embodiments shown in FIGS. 4A-4C are not integrated in a single printed circuit board (PCB), additional or alternative embodiments can include components integrated in one or more PCBs. Computing instructions can be stored in the form of software or firmware in memory as required to operate the components described herein and can be editable by a user in some embodiments.

Figure 5:
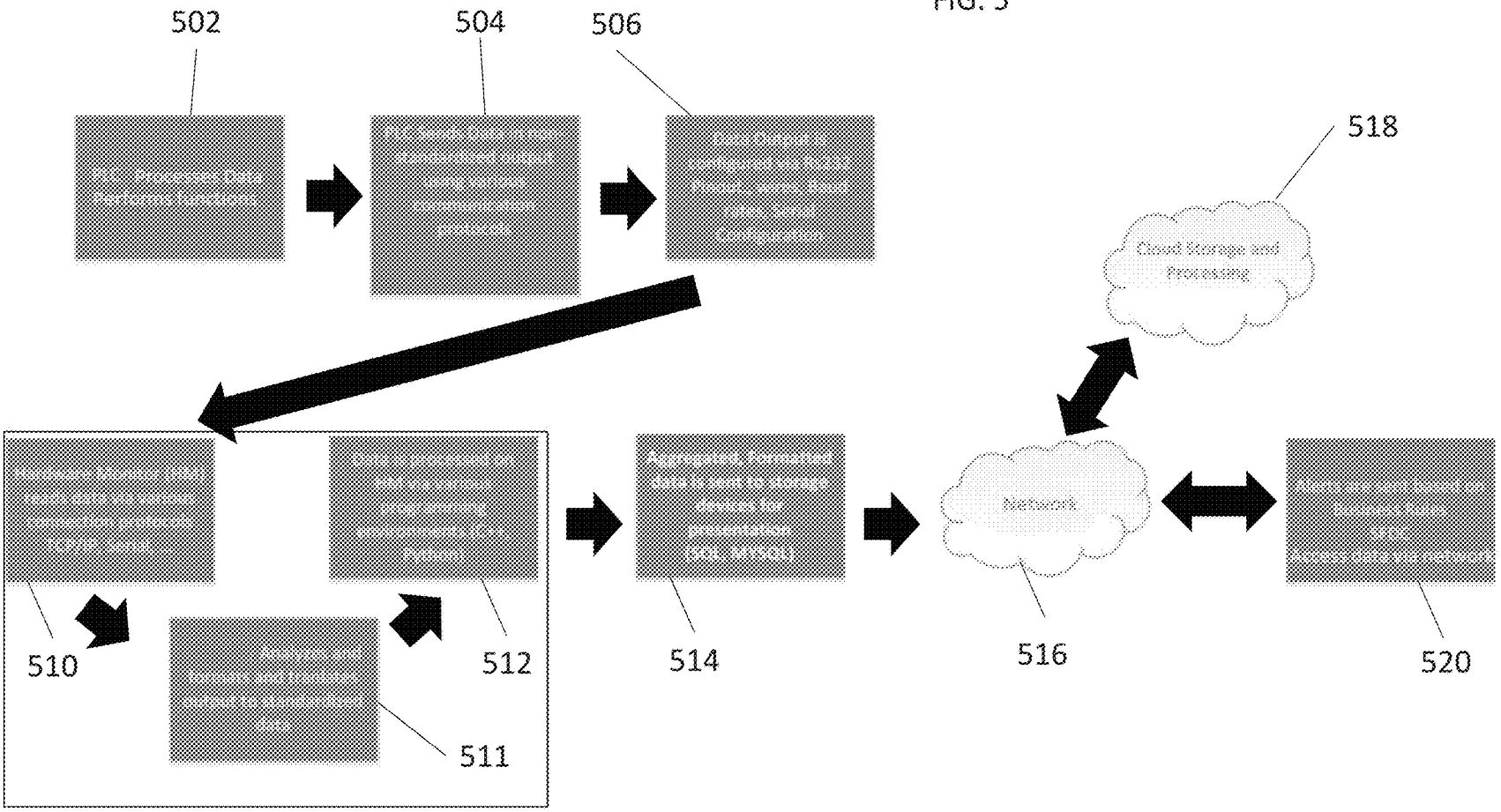
FIG. 5 is a diagram depicting an example embodiment of data flow in a system.

FIG. 5 shows an example embodiment of data flow 500 in a system in accordance with the present invention. In the example embodiment PLC processes data and performs functions relating to a piece of equipment such as an elevator in step 502 to determine changes in status such as button pushes by operators, and other mechanical features that may be equipment dependent. Alerts, triggers, data on parts and other information can all be stored for individual pieces of equipment, product lines and others. Opto-couplers can also be used to read data lines in order to bypass or backup PLC acquired data. Data can be sent from the PLC via a non-standardized output (for instance to the piece of equipment) in step 504 using various communication protocols. This data may be sent in order to begin or end an action by the equipment or to acknowledge a status change in the piece of equipment. As mentioned previously, each PLC may be programmed differently depending on manufacturer, product line, model, associated piece of equipment etc. and may output data differently. Data output may be configured via RS232 pinouts, wires, Baud rates, serial configurations, and many others in step 506. Step 510 hardware monitor (PLC monitoring device) may read data via various connection protocols including and not limited to TCP/IP, Serial, and others when step 504 is occurring in order to monitor the status of the equipment through the PLC using a hardware and/or software engine. Data may then be analyzed, formatted, and translated into a standardized output form of data in step 511. Data from step 511 may be further processed on the hardware and/or software engine using various programming environments including and not limited to C++, Python, basic, and others. Aggregated and formatted data may then be sent to storage devices for presentation to users using SQL, MYSQL and others via a network 516 (in the example embodiment over a cellular carrier). Cloud storage and processing 518 accessible over network 516 may store data and remote and/or local equipment may be used to analyze and format data and translate the output to standardized data format in step 511. Automatic alerts may be sent based on internal business rules such as subscription levels, customer status, and other qualifications in step 520 from a service system such as SFDC (www.salesforce.com) which may be a third party system. Customers may also receive status alerts from cloud storage and processing 518 over network 516 if both the customer and servicer/service provider agree to and implement a dual notification system from cloud storage and processing 518. Cloud storage and processing 518 and/or the service system used in step 520 in many embodiments may communicate and/or otherwise be programmed to dispatch particular technicians for particular equipment types based on the technician's area of expertise.

FIG. 6 shows an example embodiment of a data storage, analysis and usage diagram 600 in accordance with the present invention. In the example embodiment cloud storage database 602 may be implemented in hardware, software or both on one or more network server 601*s* and communicatively coupled with network 604. Raw data 610 and data analysis and usage module 612 may be stored separately or together on network server 601*s*, generally as part of cloud database 602. In the example embodiment raw data 610 may include data about individual manufacturers 614, data models 616, data serial numbers 618, data about product types 620, data based on event causes 622 and data about parts history 624 as an example. Any data may be stored and analyzed for useful information such as lifetime, frequency of maintenance needed, types of maintenance needed, among many others.

Data analysis and usage module 612 may include an ability to analyze data 626, parts failures module 628, power issues module 630, count cycles module 632, real time status module 634, emergency alerts module 636, non-emergency alerts 638, ability to "reach out" to customers at defined intervals module 640, alert analysis module 642, customer alerts module 644 and warranty period alert analysis module 648. In the example embodiment all data transmitted may be stored in a cloud database 602. When an alert is triggered may be the only time that data will be pushed or transmitted without request from cloud database to a service architecture 608. Service architecture 608 may include local or remote databases, programs, technician mobile devices, user devices, data logs, and others. In instances where an alert has not been triggered data may be pulled from cloud database 602 when required by service architecture 608.

Collection of data in raw data 610 allows for additional customizable data analysis and usage module 612 features. In some embodiments operators may wish to analyze what part or component has failed for a particular equipment serial number, manufacturer line, or other level of abstraction. This knowledge may allow operators to predict likelihood of failure of similar parts in the future. Also, in the case of a part failing it allows a technician to bring a replacement part with them to replace the failed part, in turn cutting lost time and productivity by a significant margin. The system provides the operator/administrator the ability to make statistical recommendations to customers regarding replacement parts before anticipated failures based on computer implemented algorithms, thus allowing a proactive role.

Power issues module 630 allows operators to analyze whether steady "clean" power is being delivered to equipment along with any power fluctuations. If any power issues exist then power issues module 630 may discover them and create unique notifications. Count cycles module 632 may allow operators to analyze when service may be necessary on a unique, customer specific basis based upon actual usage rather than temporally or in addition to temporally. Cycle counting and/or hours of usage analysis also helps to analyze true life of a particular piece of equipment or part of a piece of equipment and thus provide customers, manufacturers, sellers, resellers and others associated with equipment with information about when replacement parts may be recommended and/or necessary.

Service architecture 608 allows operators functionality to access information in cloud storage database 602. In some embodiments customers 606 may have access to service architecture 608 via network 604 in order to review equipment service records for equipment the client owns on an individual, product line, or other basis. Service architecture 608 also allows operators the ability to push notifications to customers based on individual customer requirements or service agreements.

FIGS. 7-19 are related to a service architecture and are described below. The equipment being monitored (Installed Product) has a serial number associated with it. When an Alert is sent from the equipment 1001 to the system 1410, the serial number is included. This allows a an automatic search of the system database for that serial number. When the search finds the serial number, it automatically creates a Case that is directly associated with that serial number and references the error with any pictures and/or video captured. The case is automatically sent to at least one appropriate dispatchers queue so they can triage the case by calling the associated customer or equipment operator. The customer may not be aware of any problems with their equipment. All the current details about that customer and unit are displayed on the screen for the dispatcher when they call the customer.

Figure 7:
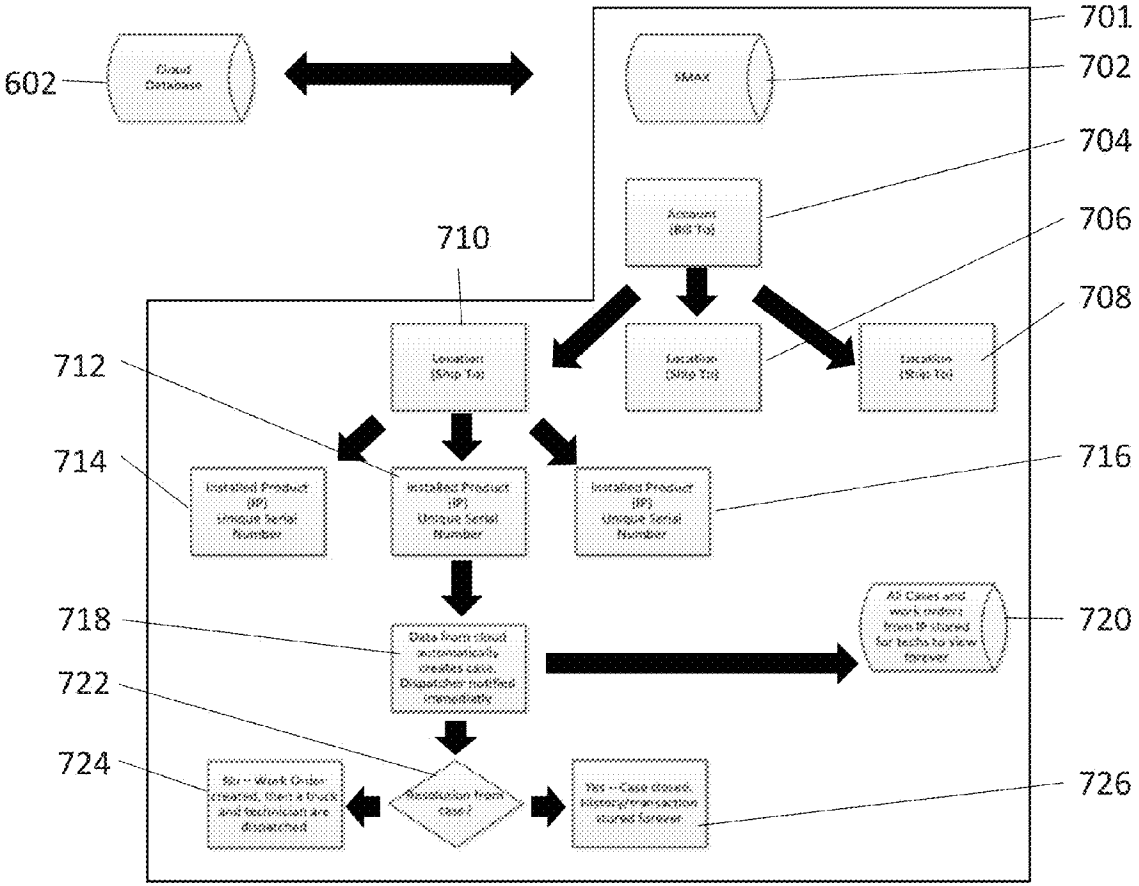
FIG. 7 is a diagram depicting an example embodiment of a service architecture.

FIG. 7 shows an example embodiment of data storage in a service database 602 and access by a service system 701. In the example embodiment, a cloud database 602 can be accessed and share information back and forth with a service system 701 including a service database 702. Included can be a bill to account 704 which can include multiple ship to locations 706, 708, 710. A ship to location can include numerous installed product identifiers 712, 714, 716 such as unique serial numbers. Data from the cloud database 602 can then be used in order to automatically create a case 718, which can also automatically notify a dispatcher. Cases and work orders from the installed product can be saved at this point for technicians to view in database 720. Once the dispatcher has been notified in 718, a decision engine can determine if the case is resolved in 722. If the answer is no, a work order can be created and a truck and technician dispatched to resolve the issue in 724. If the answer is yes, the case can be closed in 726 and the history and transaction can be stored in memory.

Figure 8:
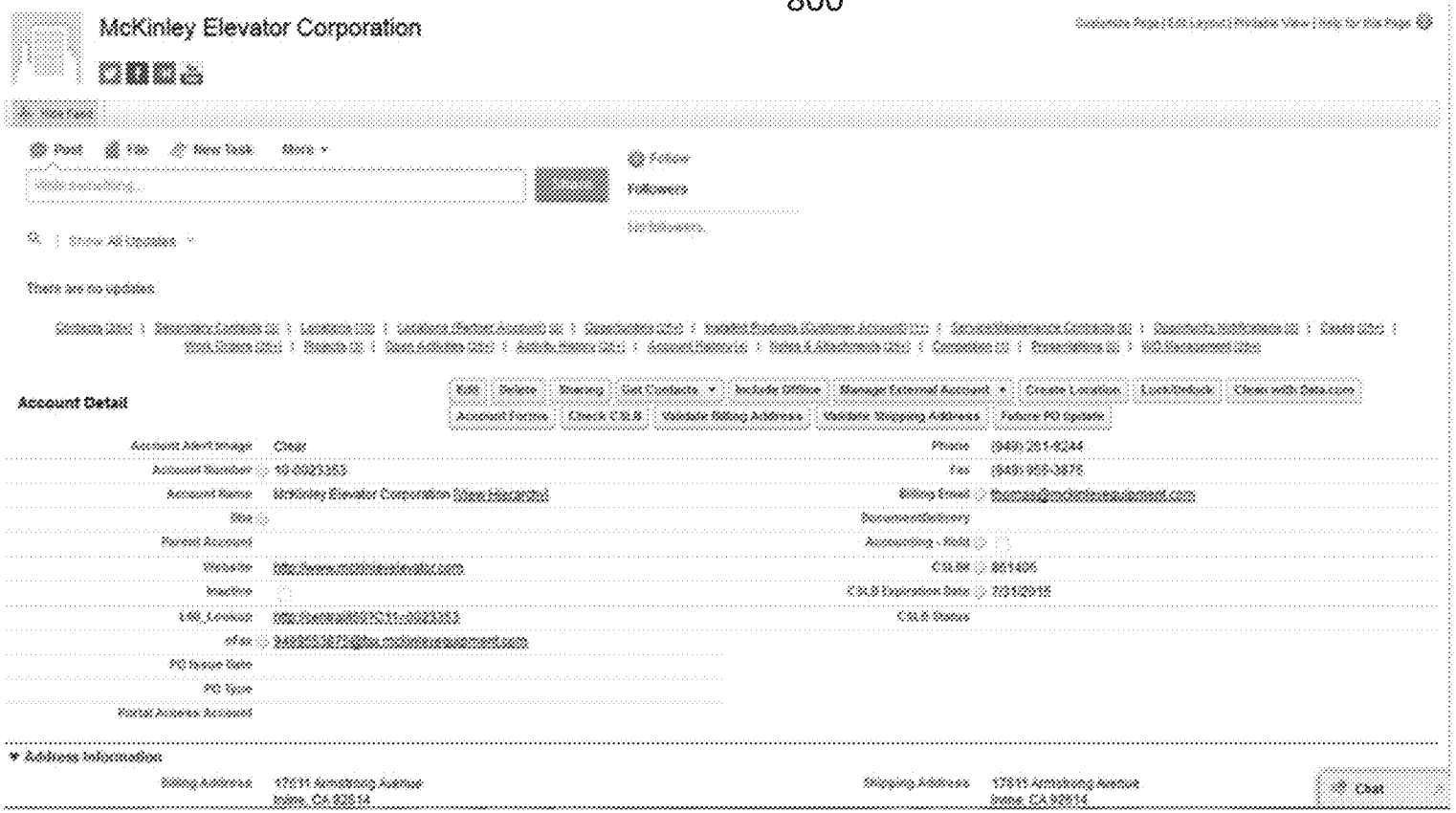

FIG. 8 shows an example embodiment of an Account Detail screen 800 which can include Bill To information. This can include contact telephone numbers, fax numbers, eFax numbers email addresses, physical addresses, customer names, account numbers, websites, purchase order issues types, purchase order types, portal access account identifiers, activity levels, Dba's, parent accounts, child accounts, CSLB #'s, CSLB Expiration dates, CSLB statuses, accounting-hold information, document delivery types, shipping addresses, billing addresses, and other information. In addition, the Account can be at the top of a data organization pyramid for all related items. The Installed Product is tied to a Location which is tied to an Account, as shown in FIG. 7.

Figure 9:
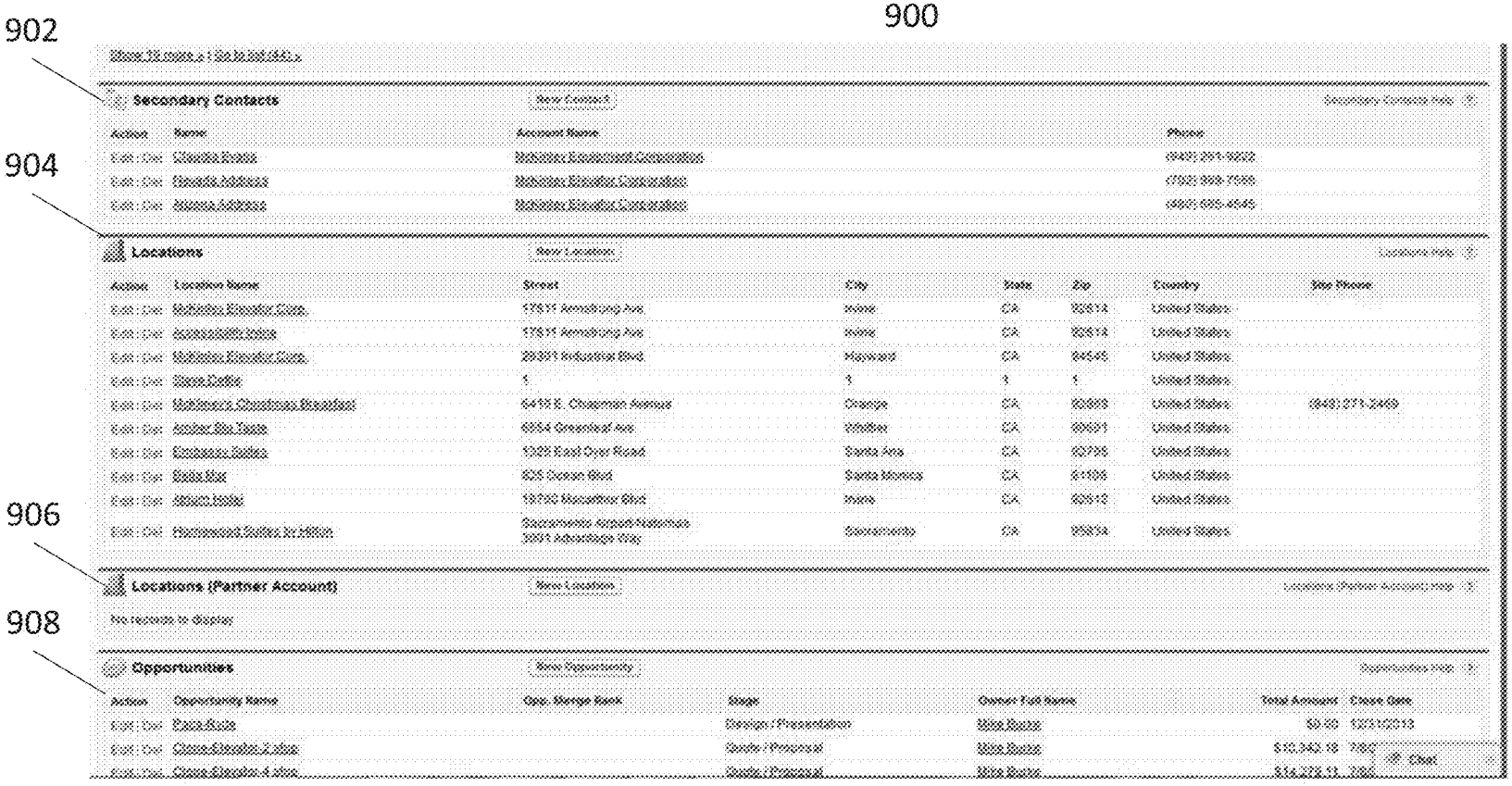

FIG. 9 shows an example embodiment of Locations which can be Ship To addresses associated with an Account. An Account can have a virtually unlimited number of Locations, limited only by the size of the customer. Services can be performed at the Location and all invoicing can be sent to the Account. As shown in the example embodiment, a secondary contacts field 902 can include contact names, account names, and phone numbers for individuals at the account. Locations field 904 can include location names, street addresses, cities, states, zip codes, countries, counties, and site phone numbers. Locations for partner accounts field 906 can include location addresses for partner accounts. Opportunities field 908 can include opportunity names, Opportunity merge ranks, stages, owner names, total amounts, close dates, and others.

Figure 10:
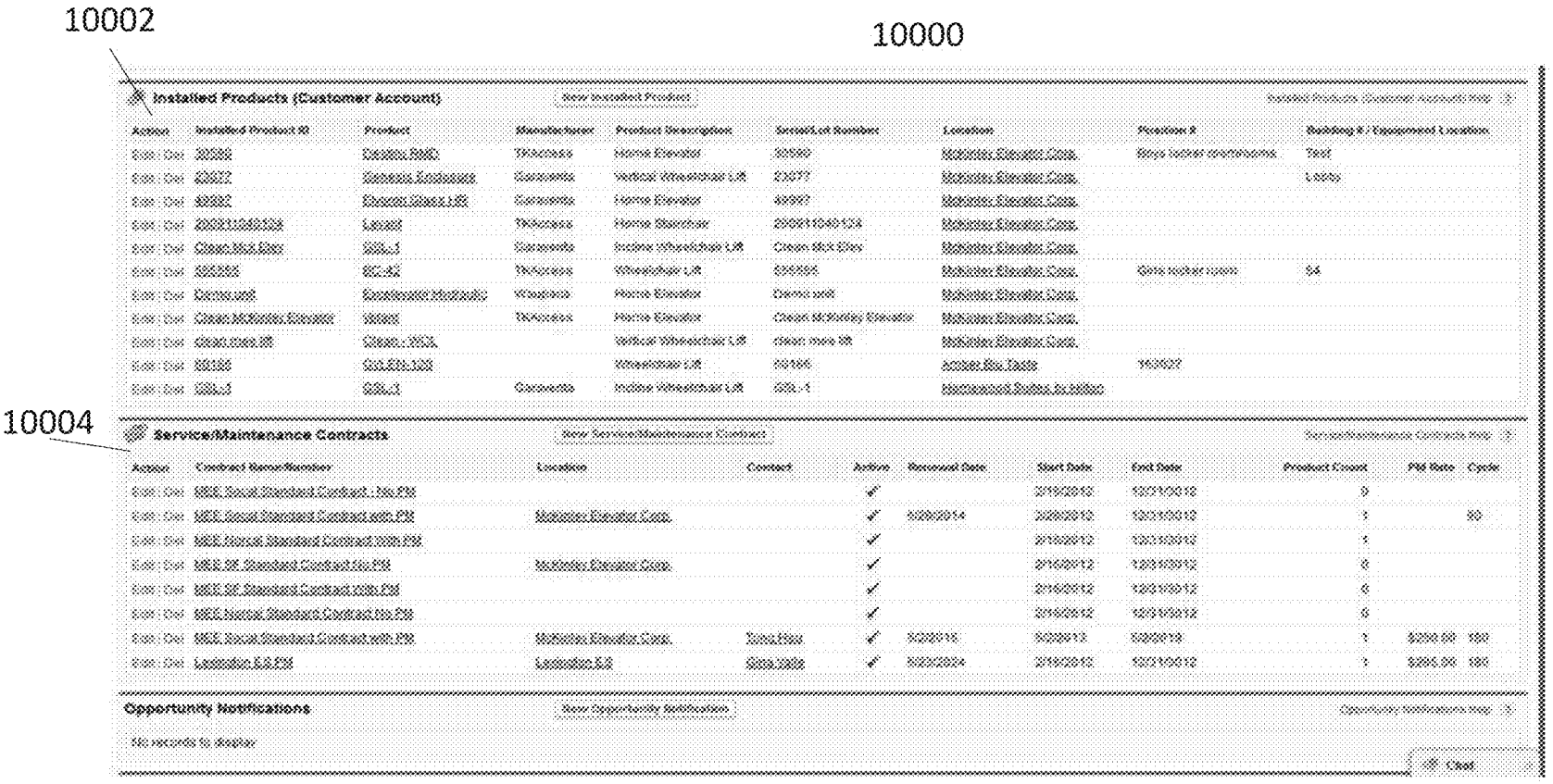
Figure 11:
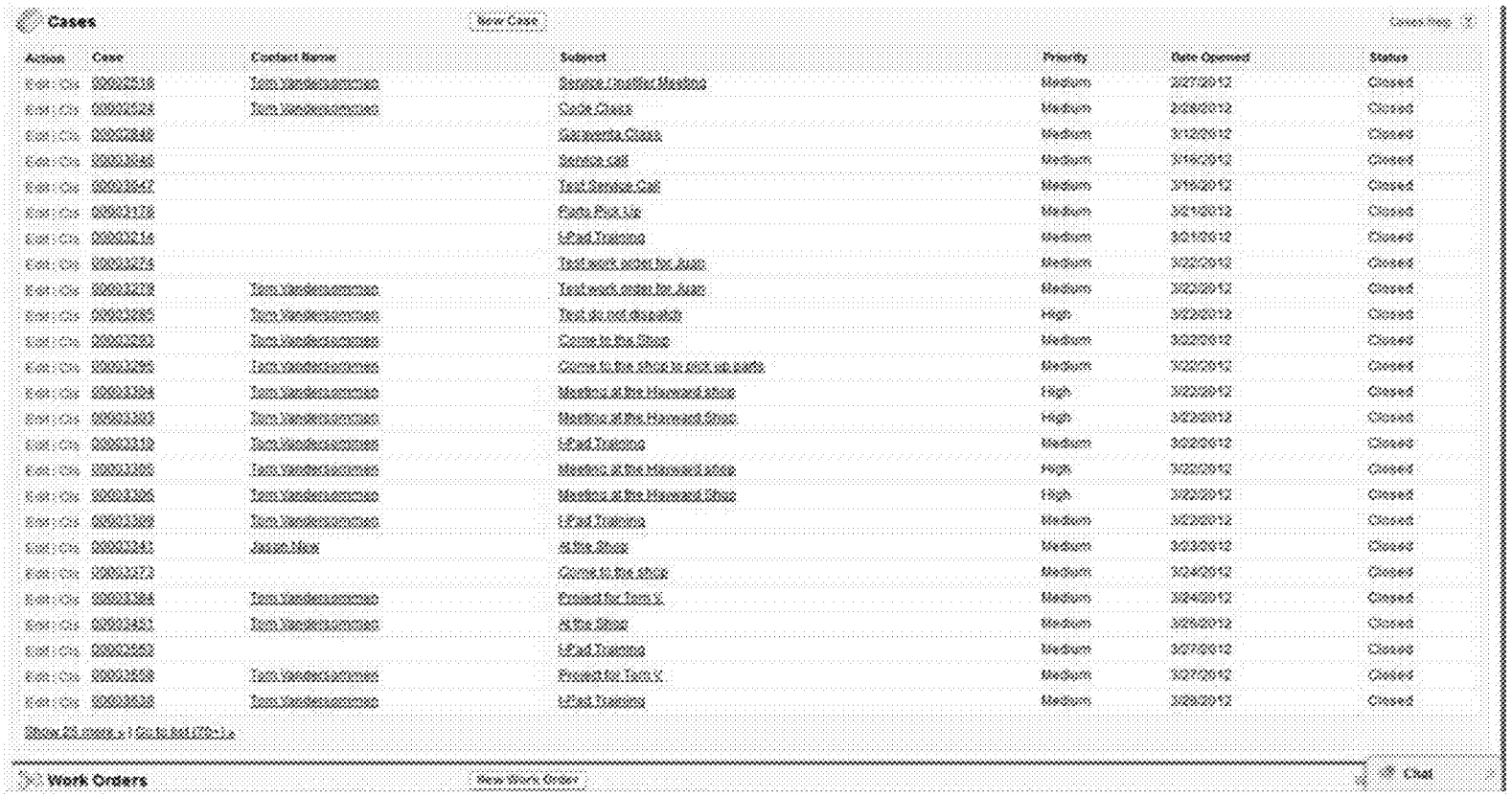
Figure 12:
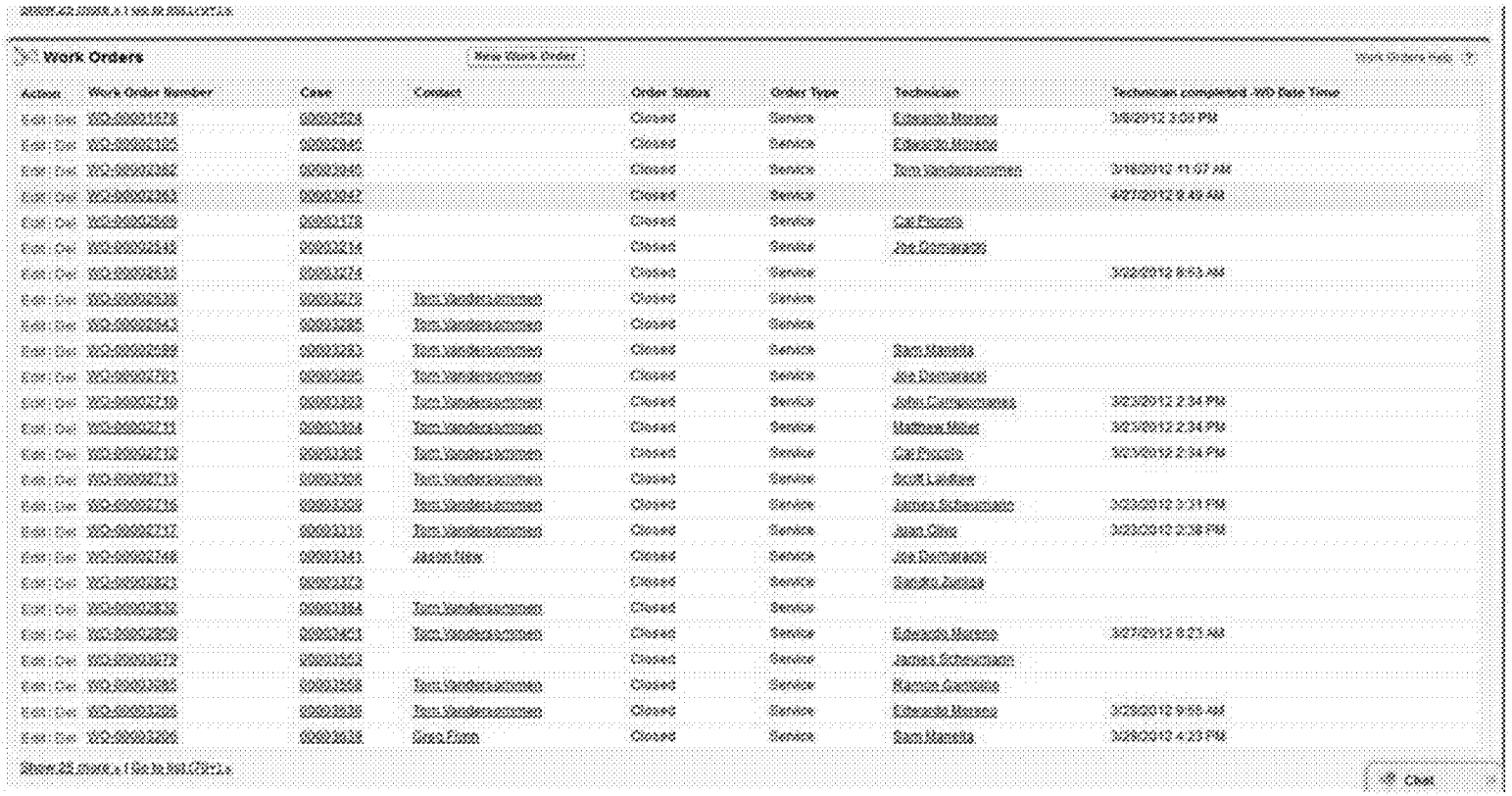

FIG. 10 shows an example embodiment user interface screen 10000 of which Installed Products are associated with an Account. An installed product field 10002 can indicate the actual Serial Number of the equipment that is installed at the location. Serial numbers can be unique to each piece of equipment and an Installed Product can be located at a single address since the Serial Number cannot be installed in two Locations. Also included in the installed product field 10002 are installed product identifiers, product names, manufacturers, product descriptions, locations, position numbers, building number/equipment locations and others. Service/Maintenance contracts field 10004 can include contract names/numbers, locations, contact names, active indicator, renewal dates, start dates, end dates, product count indicator, pricing information, cycle rate information and others.

Figure 11:
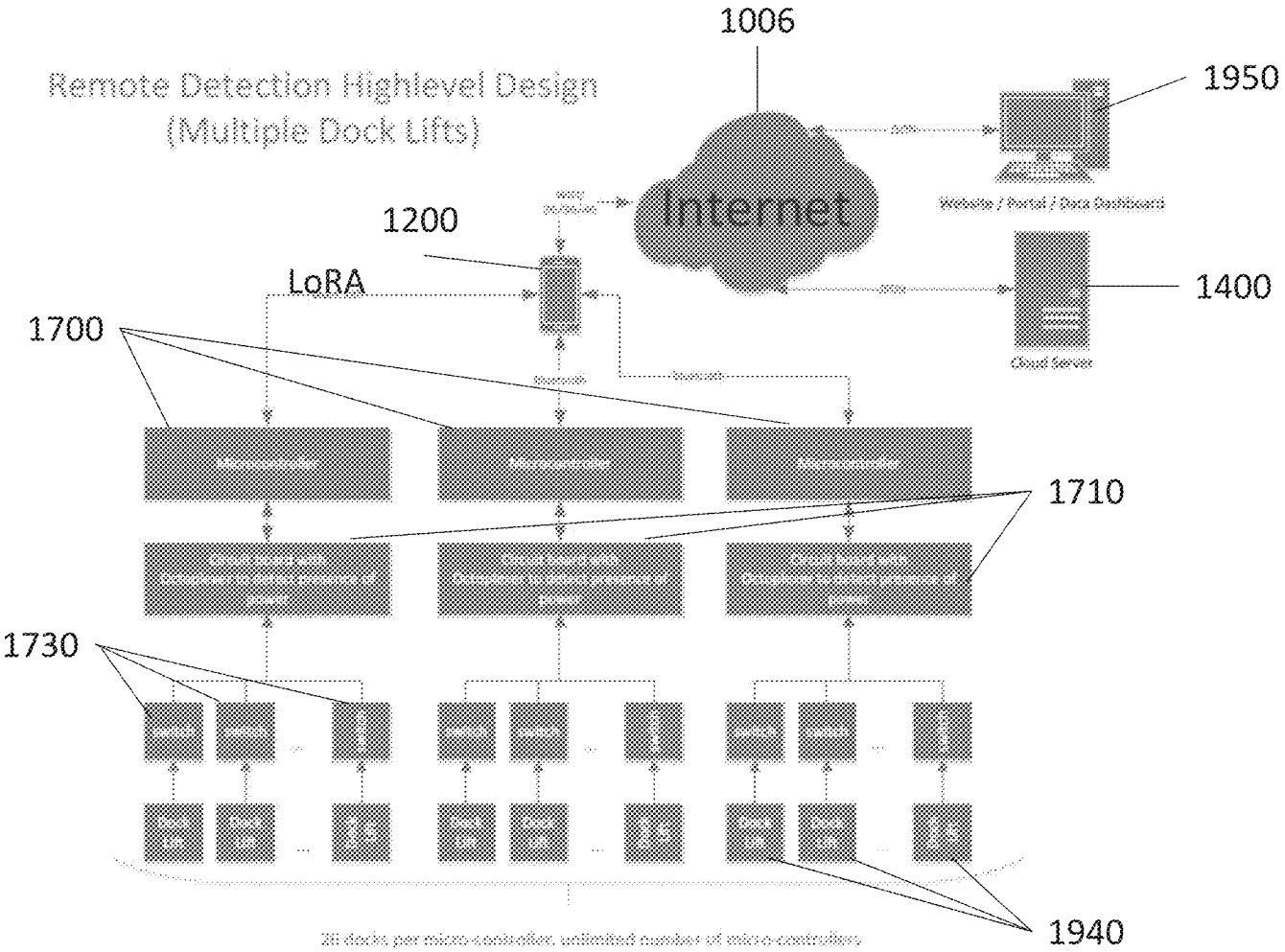
FIGS. 8-19 are depictions of example embodiments of user interface implementations according to the invention.

FIG. 11 shows an example embodiment of a cases screen 11000 which shows cases which are associated to a specific Installed Product. So for instance the first Case number is 00002518. This Case can be associated directly to the Installed Product of serial number 49997 from FIG. 10. Cases can be automatically directed to a Dispatcher's queue to contact the customer regarding the issue. For the example case, a service meeting is scheduled. Also included can be contact names, priority levels, date opened, date resolved, and statuses.

If a Case cannot be resolved over the phone a Work Order can be created for the Case. A Work Order can signify that there will be a technician dispatched to the Location. The Work Order can then be dispatched to a technician and at that point the technician can see all the details of the Work Order as shown in the work order screen 12000 example embodiment shown in FIG. 12. Work order information can include a work order number, case number, contact information, order status, order type, technician(s), technician completed work order date/time and other information.

Figure 13:
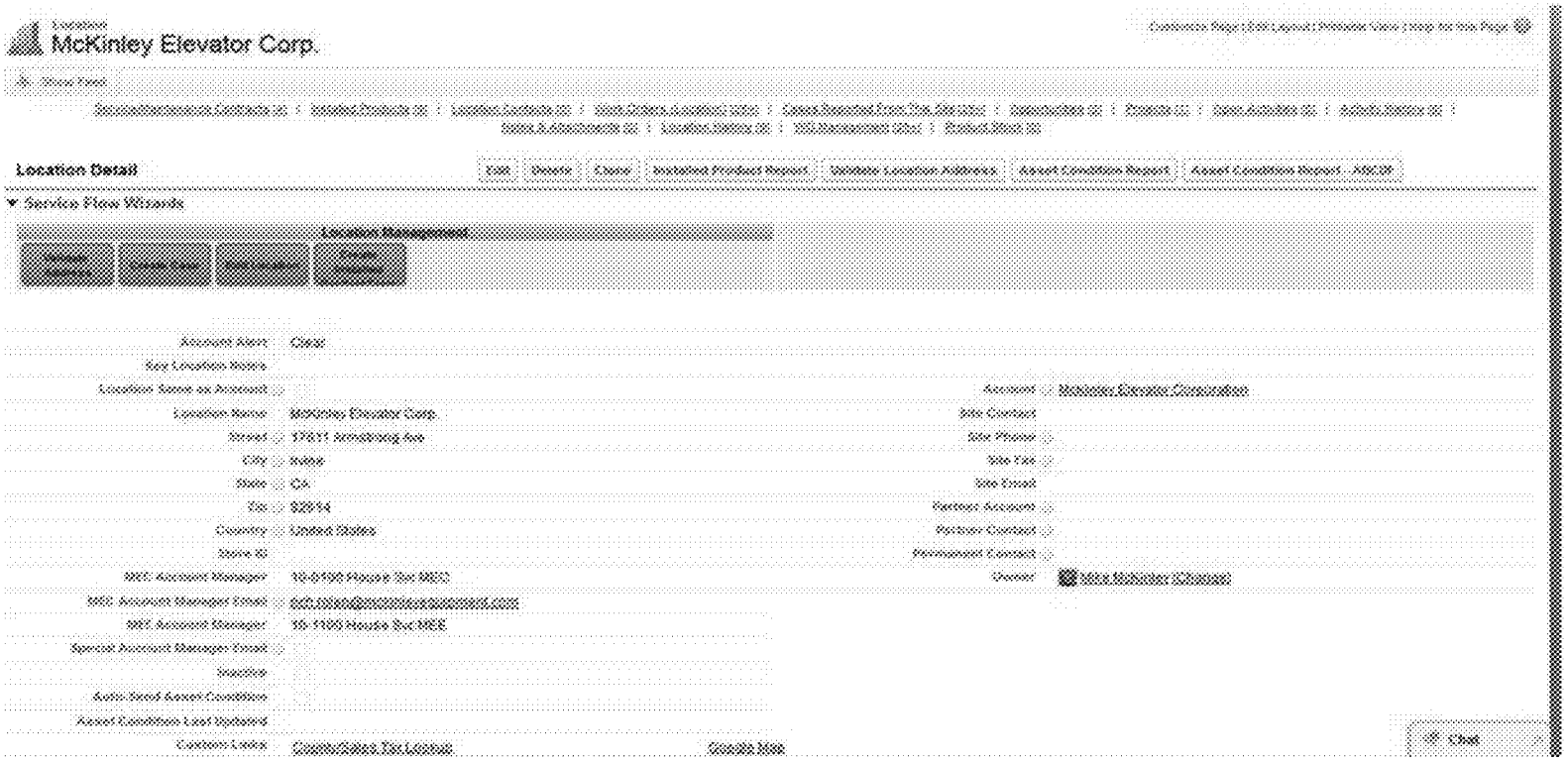

FIG. 13 shows an example embodiment of a location details screen 13000 for a customer. The Location Details can include all information regarding the Ship To address in addition to a customer address, phone, contact, account alert information, key location notes, location same as account indicator, store identifier, account manager name, account manager email, specialty information, inactivity indicators, auto-send asset condition identifier, asset condition last updated information, custom links, site contact identifier, site phone number, site fax, site email, partner account, partner contact information, permanent contacts and owner information in addition to other information. The installed product can be related to specific location.

Figure 14:
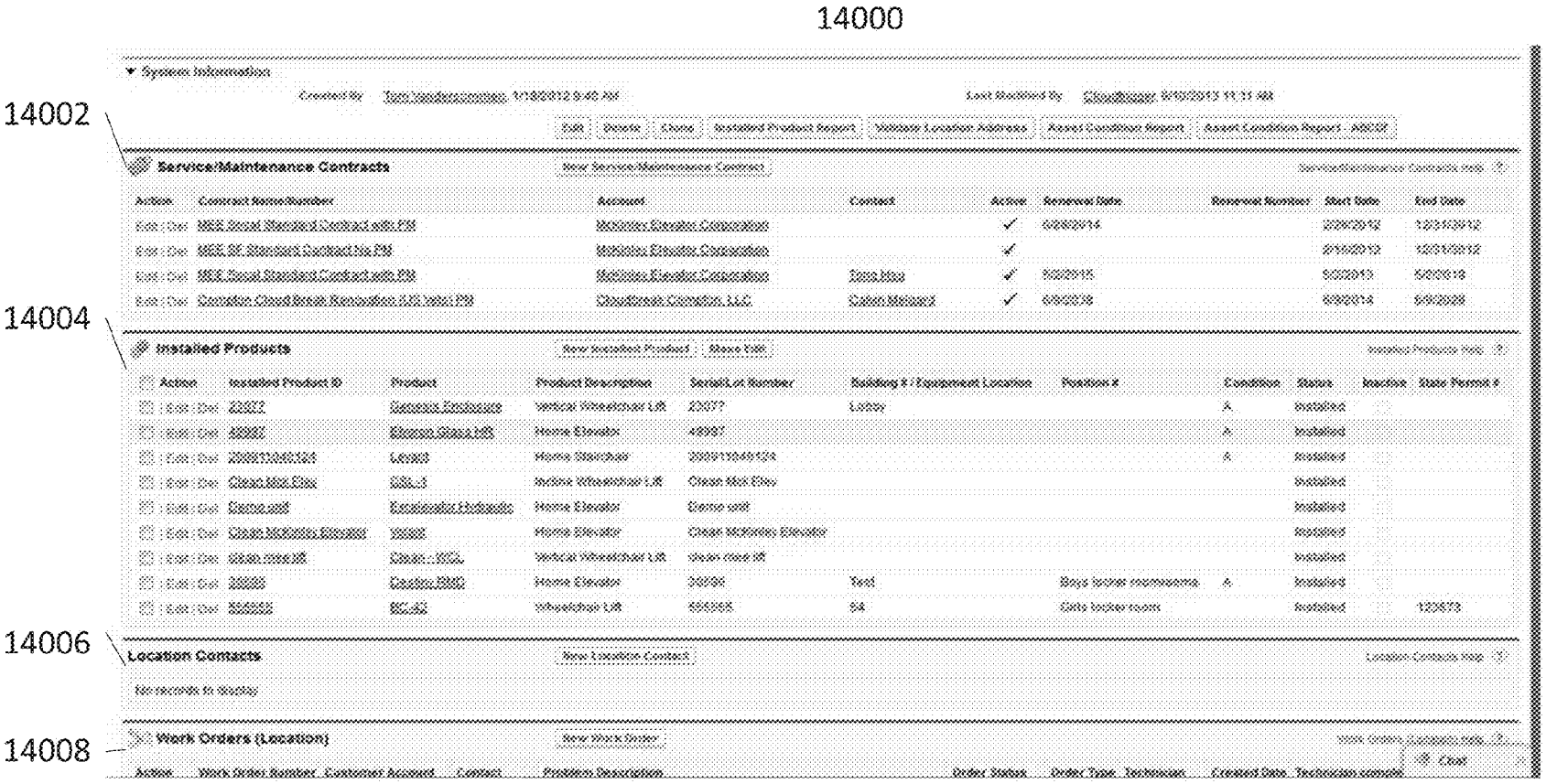

FIG. 14 shows an example embodiment of a details screen 14000 of all Service and Maintenance Contracts with a particular customer at a location. This can be important because these contracts can be associated to one or more Installed Products or equipment, meaning they determine the SLA's (Service Labor Agreements) a system operator may have with the Account and the hourly bill rate charged. A Service/Maintenance contracts field 14002 can include contract names/number, account names, contact information, active indicators, renewal dates, renewal numbers, start dates, end dates and other information. An installed products field 14004 can include installed product identifiers, product names, product descriptions, serial/lot numbers, building number/equipment, location information, position numbers, condition information, status information, activity indicator, state permit numbers, and other information. Location contacts field 14006 can include information for contacts at a particular location. Work orders field 14008 can include information such as work order numbers, customer accounts, actions, contacts, problem descriptions, order statuses, order types, technicians, created dates, technician complete date/time and other information.

Figure 15:
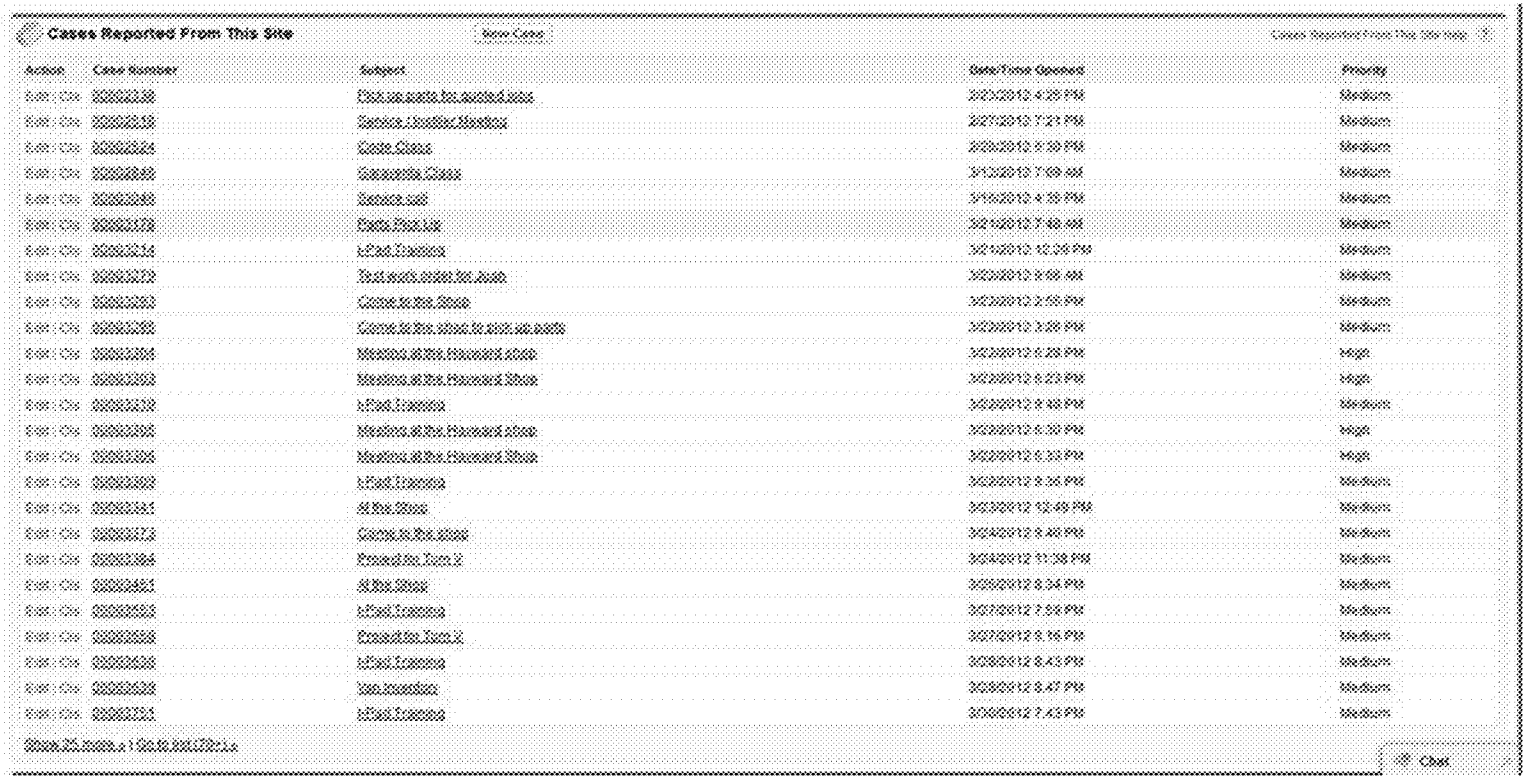
Figure 16:
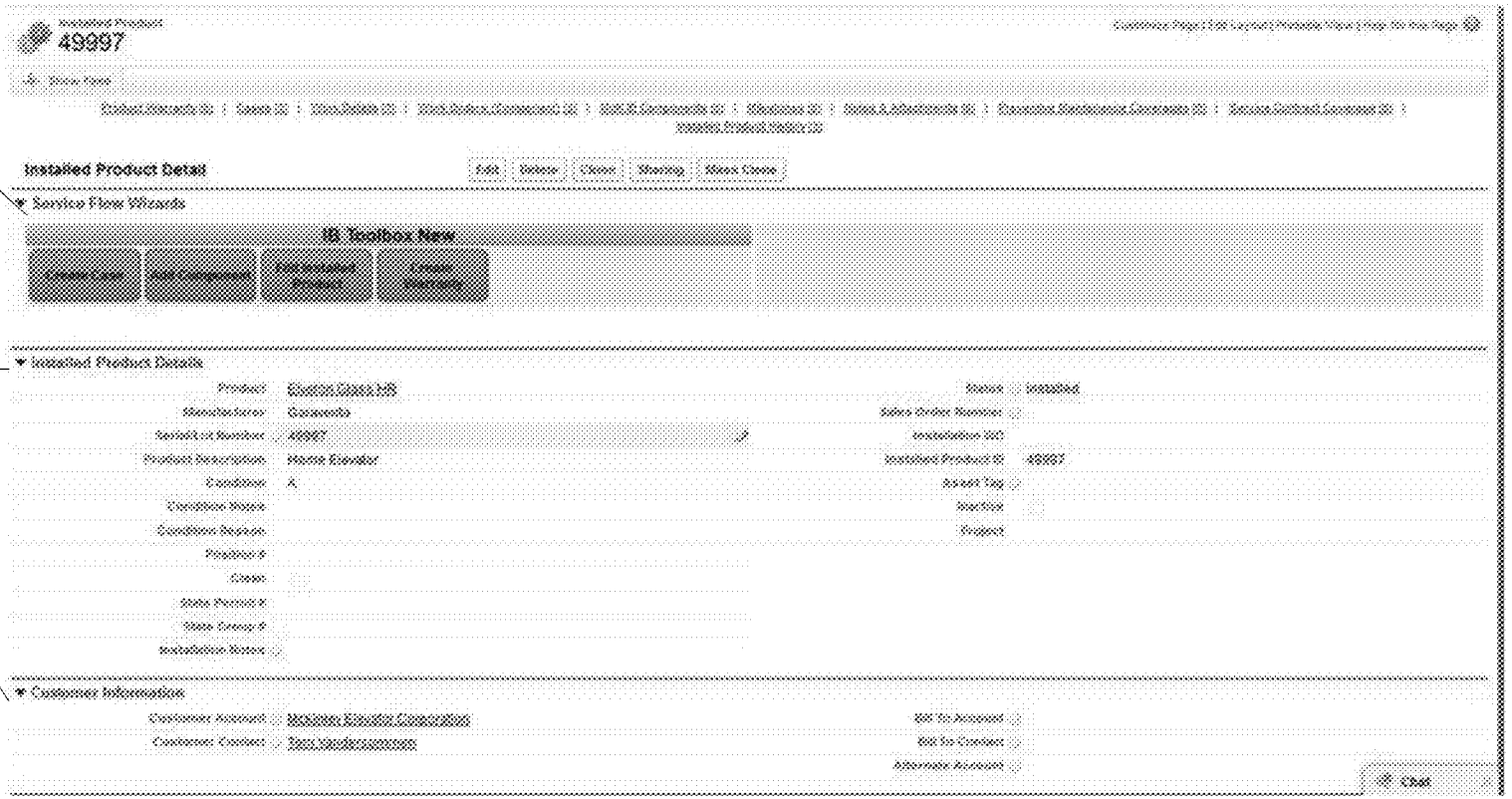

FIG. 15 shows an example embodiment of a case screen. Therefore, after a Case is created, all the details of the Installed Product can be displayed for a dispatcher, an example embodiment of which is shown in cases reported from this site screen 15000 of FIG. 16. Included information can be case numbers, subjects, date/time opened, priority and other information.

Figure 17:
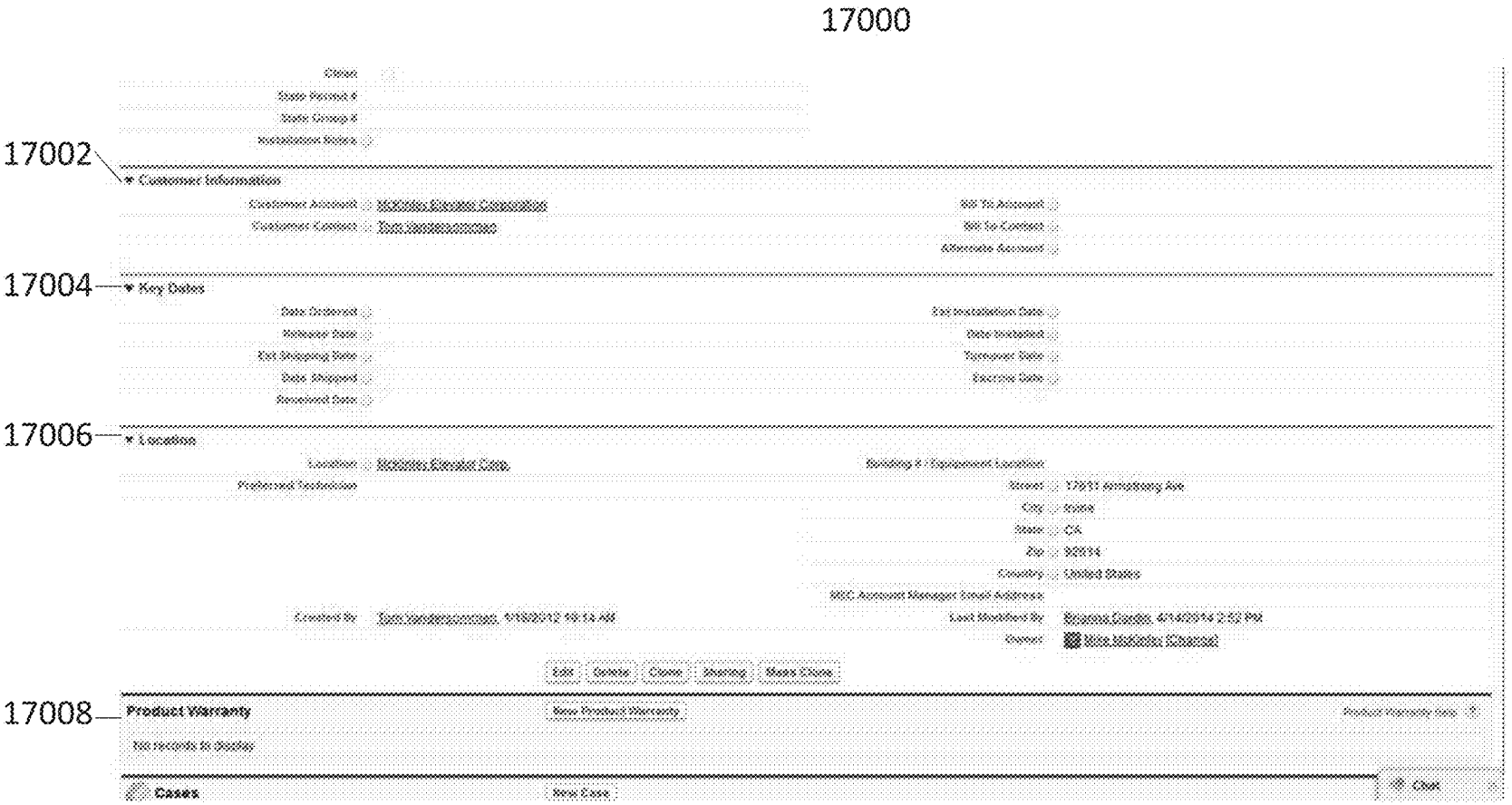

FIG. 17 shows an example embodiment of an Installed Product information screen 16000 which can show all details regarding the serial number. A service flow wizard field 16002 can include buttons such as create case, add component, edit installed product, create warranty and others. An installed product details field 16004 can include information such as product name, manufacturer, serial/lot number, product description, condition, condition notes, condition reason, position number, clean indicator, state permit number, state group number, installation notes, status, sales order number information, installation work order identifier, installed product identifier, asset tag, inactive identifier, product name and other information. Customer information field 16006 can include a customer account identifier, customer contact, bill to account, bill to contact, alternate account identifier, and others.

FIG. 17 shows an example embodiment of a Key Dates display 17000 which can be used to determine Entitlements (warranties). Product Warranty can be auto populated once Key Dates are inputted or downloaded and can provide a dispatcher with any warranty details. This can allow a system operator to invoice the appropriate party should there be a warranty or not. This can also can change the SLA's based on the contract if it is under warranty. A customer information field 17002 can include customer account identifier, customer contact, bill to account, bill to contact, alternate account and other information. Key dates field 17004 can include date ordered, release date, estimated shipping date, date shipped, received date, estimated installation date, date installed, turnover date, escrow date, and other information. Location information field 17006 can include a location identifier, a preferred technician, a created by line, a building number/equipment location, an address, an account manager email address, a last modified by, an owner and other information. A product warranty field 17008 can include product warranty information.

Figure 18:
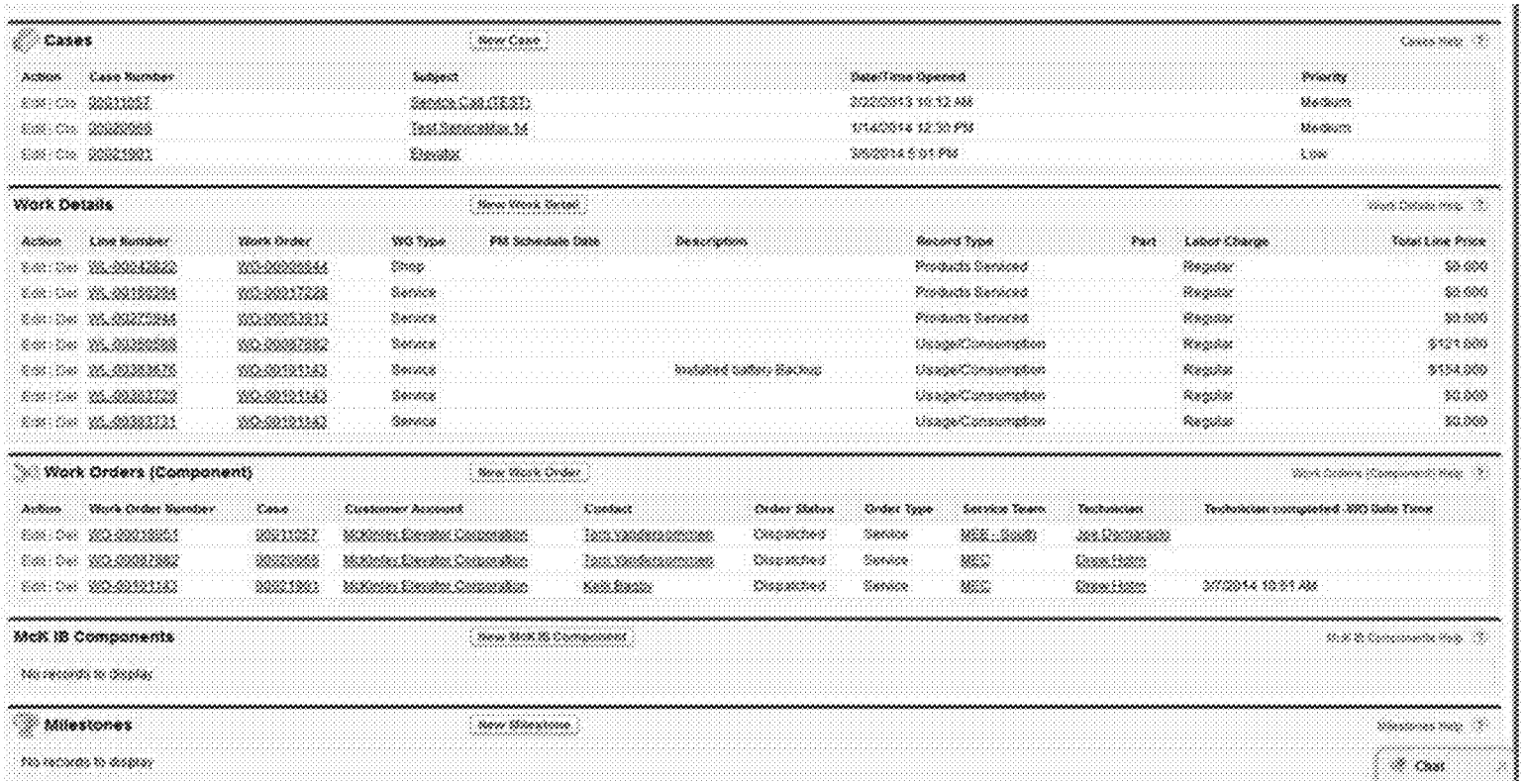
Figure 19:
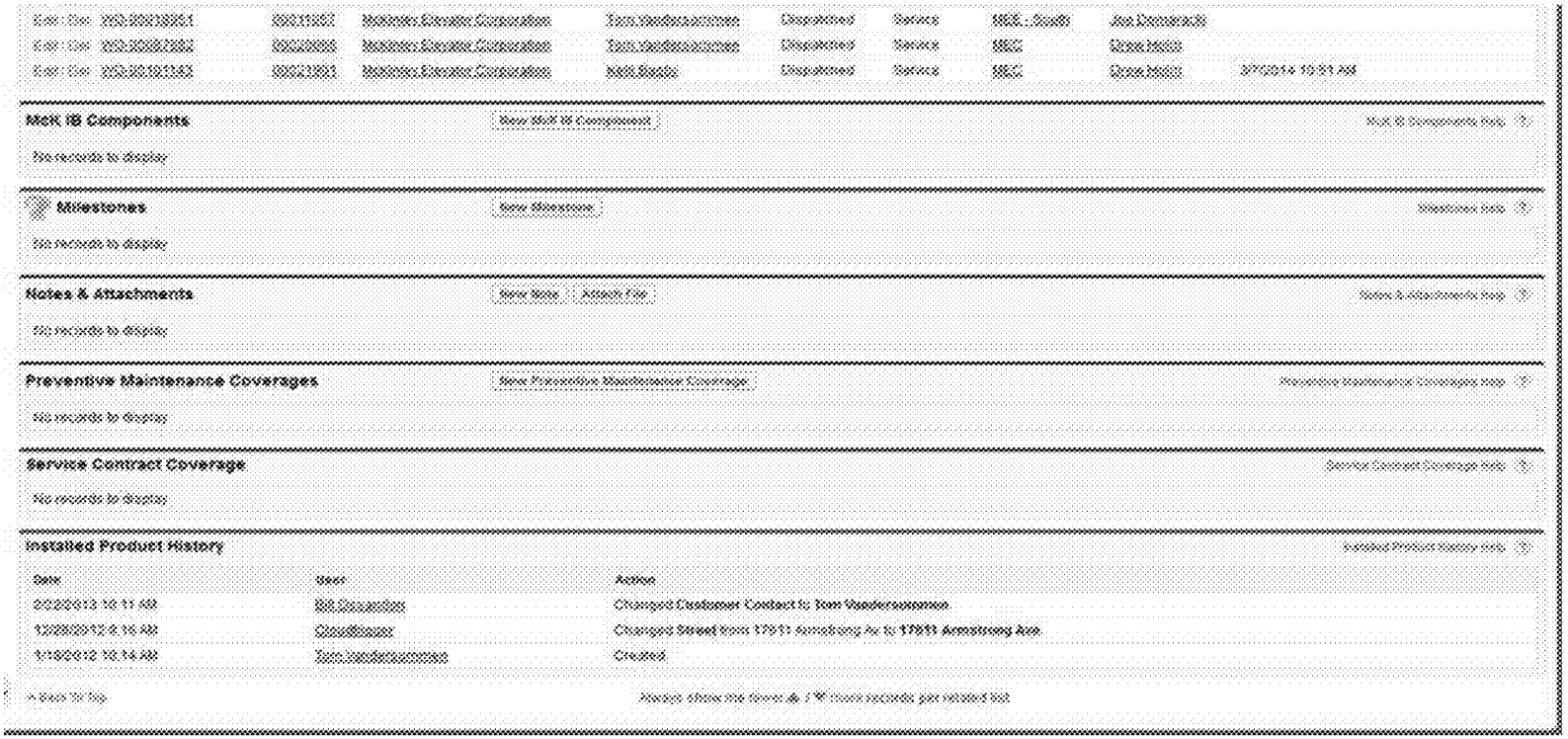

FIGS. 18-19 shows an example embodiment of Installed Product screens. If it is determined that a technician must be dispatched, a Work Order is created. Otherwise the case can be closed.

Figure 20A:
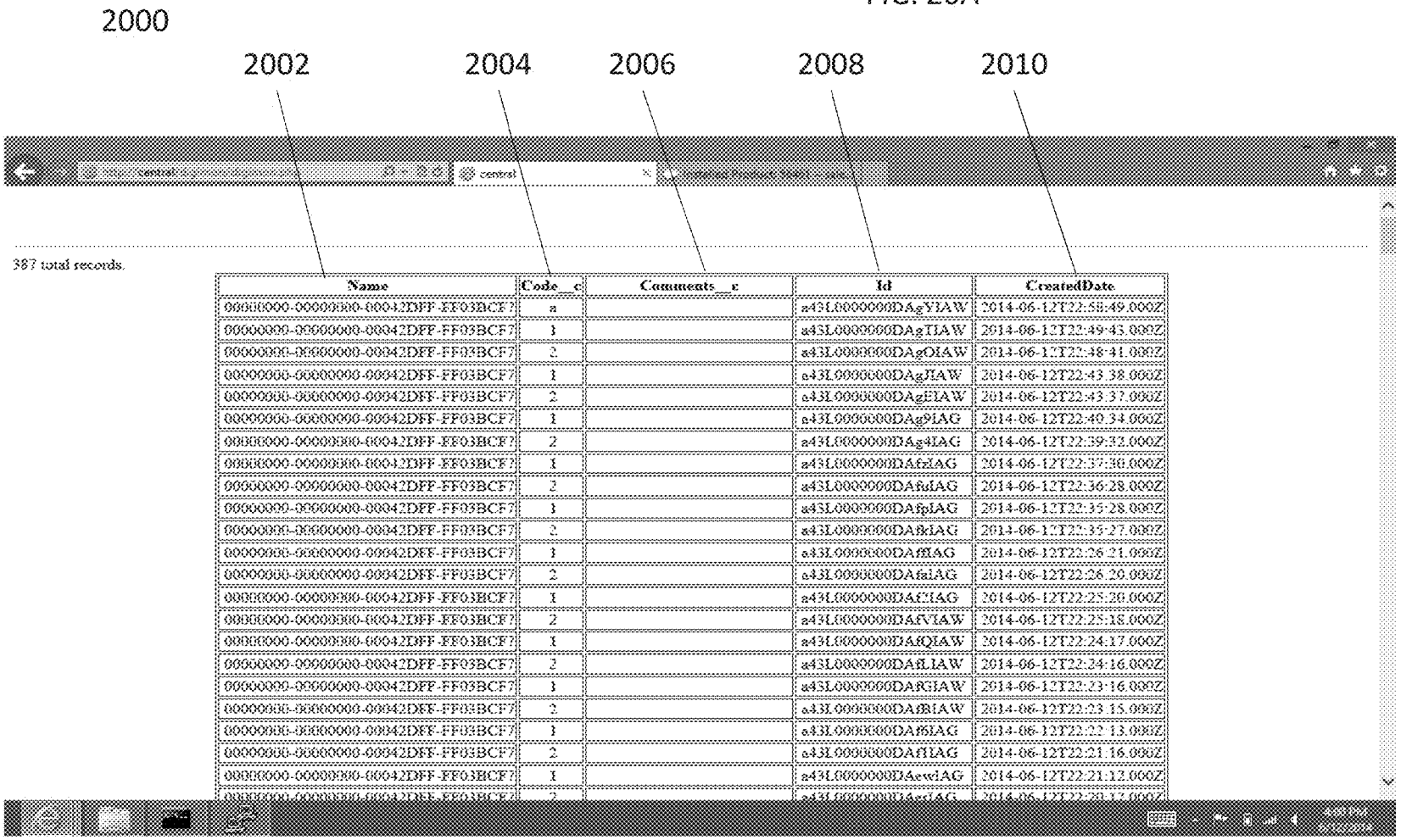

FIG. 20A shows an example embodiment of a data log screen 2000. In the example embodiment several columns are used to organize data including name 2002, code 2004, comments 2006, ID 2008 and CreatedDate 2010. Name 2002 information may be a unique serial or other code that particularly identifies a monitoring device and/or could be a phone number. In the example embodiment each name data entry is identical since event codes from a single monitoring device are being displayed. Code 2004 may be a particular code that is displayed by a PLC associated with the named piece of equipment. Code 2004 information may be standardized across a model, manufacturer or industry, may be unique to a particular model, manufacturer or industry, or may be a hybrid of the two. Code 2004 information may be displayed on a digital display on or near an associated piece of equipment when the piece of equipment is operating normally or when it has issues, problems or malfunctions and may be read by a technician and cross-referenced with a code key in order to diagnose the problem. Examples of codes for an example embodiment where a piece of equipment is an elevator may include floor numbers (1, 2, 10, etc.), door open/closed, stuck between floors, belt maintenance required, emergency generator activated and many others. In an example embodiment where letter codes are used: a=open car gate switches, b=open hall door locks, c=hall door not closed, d=bottom floor switch errors, e=operating on emergency power, f=operating in learn mode, g=encoder faults, h=shorted car gate switches, i=car safety circuit open, j=safety circuit is open, k=open car stop switch, l=stuck door zone relay, m=drive faults, o=elevator over speed, p=governor faults, q=PLC low battery, r=special reset sequence on, u=door zone switch failed to open and others. Many embodiments of the current invention do not require technicians to have firsthand knowledge or immediate access to code keys since monitoring equipment sends the information and the system is able to cross reference code keys and disclose the identity of the key to the technician.

In some embodiments comments 2006 may be automatically generated as part of a program to provide a user-friendly intuitive description of what event caused a particular code to be generated.

ID 2008 may be an identifier for a particular customer identifier and/or case in a service system and can identify a string of data.

CreatedDate 2010 is a timestamp including a date and time when a code 2004 was generated. In some embodiments CreatedDate 2010 may be indicated to a particular hour, minute and second in order to provide great specificity in when an event occurred.

In some instances when a piece of equipment is not functioning normally, an equipment owner and/or operator may call a servicer to diagnose the problem. However, when a service technician arrives the equipment may be functioning normally. Use of CreatedDate 2010 timestamps provides technicians with the ability to identify an event trigger and track similar event triggers in the same piece of equipment or across numerous pieces of equipment, product lines, etc.

in order to better understand equipment readings and provide improved service to customers in the form of higher quality service calls.

FIG. 20B shows an example embodiment of event data stored in a database. The 'user' column 2012 can be the user id that logged in and created the data. The 'name' column 2014 can uniquely identify the event. The 'details' column 2016 can include useful information for identifying the timing on the sensor and the sequence number that was generated for each data point so they can be ordered properly. The 'Timestamp' column 2018 can include information regarding when the data was created. The 'created_at' column 2020 can include information regarding when event data is received in the portal. The 'hardware_id' column 2022 can include a unique id for each piece of hardware being monitored. The 'Value' column 2024 can be related to the type of event (name) and allows system operators to chart the data received over time.

Figure 20C:
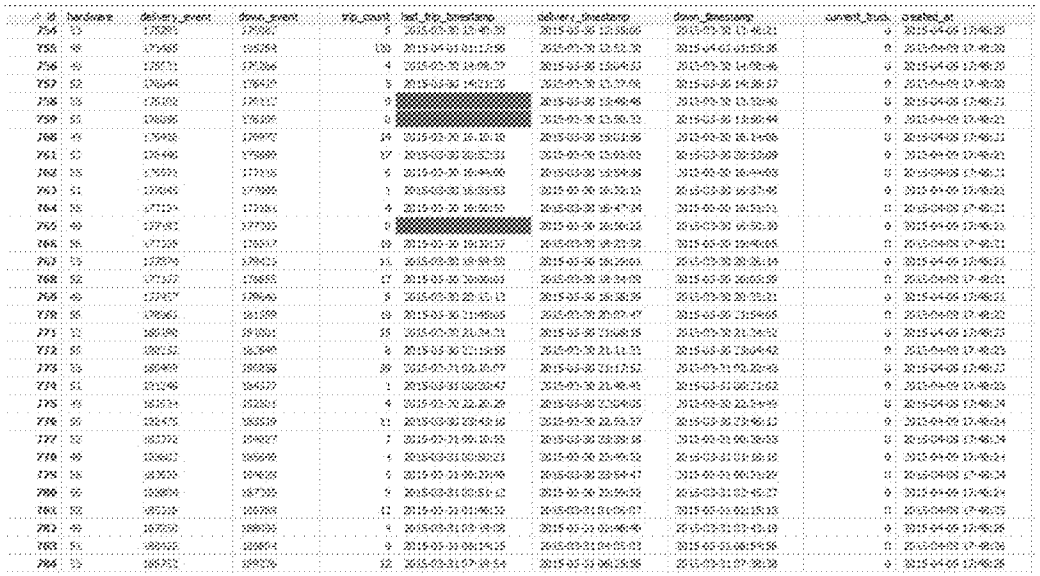

The information shown in the example embodiment of FIG. 20C includes an example database table where event data received can be aggregated into a summary table that describes a larger activity spanning multiple events. In the example embodiment, this data is storing references to key events and event times, and then a count of the number of 'trip' events. This data can be built in real-time as the event information is received at the server. A remote command that is stored in the server and retrieved by the monitoring device and then forwarded on to the PLC or sensors, as needed can also be used.

Figure 20D:
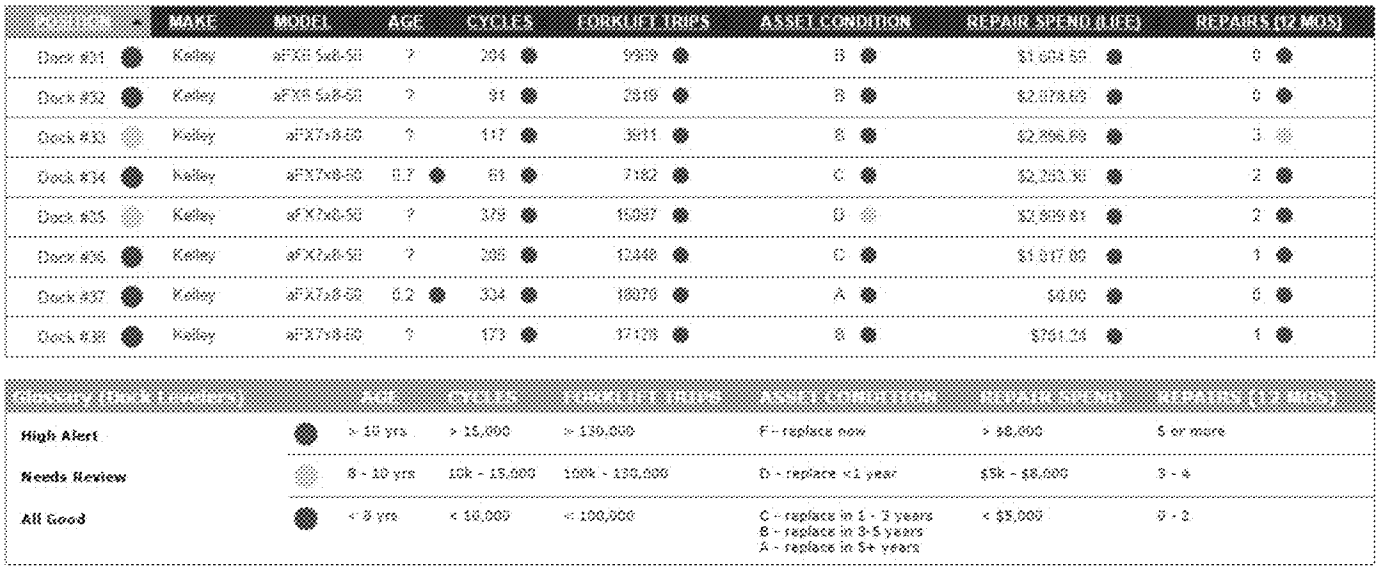

FIG. 20D shows an example embodiment of a comprehensive report or dashboard. In the example embodiment data from the event database 1400 is combined with data from the servicing database 1500 into a comprehensive report allowing real-time insight into the current condition of a piece of equipment so that management decisions can be made based on this information. As shown, trips, asset condition, amount spent on repairs, and number of repairs over a 12 month span are shown. Additionally shown are the age and number of cycles of the asset or equipment.

Figure 20E:
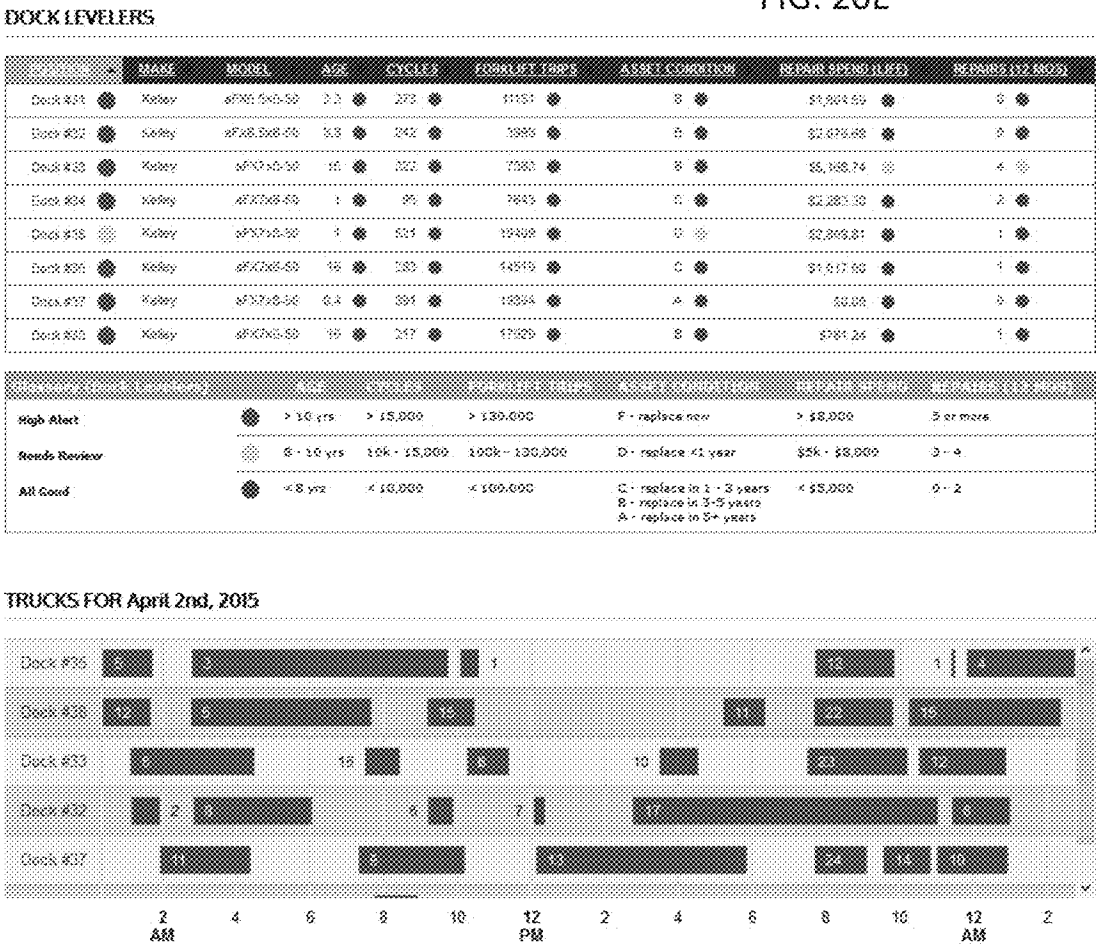

FIG. 20E shows an example embodiment of a truck tracking measurement for several docks at a location. In the example embodiment the individual times the trucks are docked are shown across a timeline. This can help operations and managers determine if resources are being used efficiently and recommendations can also be made by system calculations of how best to utilize resources.

FIG. 20F shows an example embodiment of work details for an individual dock at a location. Shown are descriptions of events, times and dates created, total amount per each order and causes of each event.

FIG. 20G shows an example embodiment of cases and work details as well as product warranties.

FIG. 21A shows an example embodiment of a first PLC output for a first piece of equipment in accordance with the present invention. In the example embodiment a piece of equipment may be an elevator. When an event occurs such as a floor movement event (elevator goes up or down by one or more floors), gate opened event or emergency stop event an associated PLC processes a code. A monitoring device, operable to monitor the PLC, may recognize numerous different values across serial port registers in the form of multiple data values making up a data set. When a piece of equipment moves or is in operation a data set may change. Identification of a consistent pattern is necessary in order to determine which discrete event of a set of events has occurred as recorded. In many embodiments distinct values which consistently relate to an event (such as the elevator stopping on floor one) are found in every test of such event. Other values in the data set associated with the event may be related to a state or other aspects or functions of the particular piece of equipment. For example, in the case of an elevator, values indicating an elevator moving up, down or stopping or having an open or closed door may be indicated in addition to the nearest floor that the elevator may stopped at or passing. Examples of value changes occurring in other equipment could include conveyor belt moving, doors or switches moving, arms moving, heating/cooling turning on/off and many others. About 80% of service calls on a residential elevator are related to the doors. If the doors are making intermittent contact, this information can be detected, trigger an event notification and be addressed by system operators to prevent unscheduled service calls by equipment operators.

In an example embodiment numerous data samples are shown as recorded. First is 184/7/0/9/0/0, second is 184/7/0/8/0/0, and third is 184/7/2/8/0/2. In the example embodiment numbers 184 are consistent over each of the data samples and indicate movement or position of an elevator at a first floor.

Turning to FIG. 21B, an example embodiment of a second PLC output for a second piece of equipment is shown in accordance with the present invention. In the example embodiment occurrence of an event such as "floor movement", "gate opened" and/or "emergency stop" may cause several different patterns of output. For this second PLC, repetition of a same code was recorded for "floor movement." As such, movement from floor one to two or two to one of an elevator elicited the same code on a serial output line. This code included periodic report in increments of one tenth of one second for a period of time (such as two seconds) followed by repetitive reporting of data from a step for a period of time when no dynamic action was occurring (such as six seconds). In the example embodiment the single valued repeating field 2222222222211111111111 indicates the elevator status as being on floor two and then floor one for periods of time. Letters "a" and "k" in repetition in the example embodiment show as series of repeating codes but could also be single codes in some embodiments. These codes repeat in much longer intervals than floor status codes. Event logging can occur and repeat in time intervals that range from microseconds to seconds. Reliability of the logging process, as well as timing, and consistency of the logged values are determined by the vendor and the implemented hardware. Different vendors implementing different hardware and programmers at different skill levels determine the accuracy, timing, and usefulness of the data.

In some cases an event may be a distinct value such as a '1' referring to an "Elevator currently stopped at Floor 1". Other vendors may implement the "intent" to stop at floor 1 meaning "The elevator has been called to floor 1—but is in the process of moving". Some vendors might send a single code to indicate a floor the elevator is moving to. While other vendors can send multiple codes, transitioning to the floor being called for repair purposes that might indicate: 1) Call Elevator to Floor 1, Code w; 2) Elevator begins moving, Code x; 3) Elevator is stopping, Code y; 4) Elevator has stopped, Code z; 5) No Errors detected, Code z1.

The transitioning process may occur in one register or multiple registers. In the example embodiment recognizable patterns were reported several seconds after the "Elevator Call" button was pressed resulting in reliable event defined by a "value change" from 184 to 254. The ability to predict service, repairs and parts failures is critical because the repair can then be scheduled, thus reducing or eliminating downtime for the equipment.

In some embodiments PLC output values may be monitored, recorded, analyzed, and standardized by a monitoring component in order to present a common output event structure for storage, notification or other purposes. Monitoring components include inputs, outputs, logic, software, memory and other appropriate equipment with appropriate connections, power and communicative couplings. After an output event structure has been standardized and aggregated, data may be transmitted to a cloud based or other network connected storage components such as databases using known wired and wireless data transmission means including Wi-Fi, Bluetooth, 3G, 4G LTE, cables, and many others. Once stored in a database, additional rule-based processing may be applied to the data such as reading and notifying users, compiling reports, querying, statistical analysis and processing. In various embodiments of the invention parts or whole portions of these processes may be performed manually or automatically. Additionally, in various embodiments different customer service levels may be set such that, for example, clients with premium subscription service level may receive reports on a regular basis, clients with a middle grade subscription service level may receive less frequent reports, and clients with a basic grade subscription service level may receive only reports of emergencies or regularly scheduled maintenance. In some embodiments services may be ordered on an a la carte basis. In some embodiments levels of service may impact technician response time. For example a premium level of service may receive a service call within an hour while a lower level may be within six, twelve, twenty-four hours or other time limits.

Statistical analysis as discussed in the previous paragraph may include determination that a part will fail at 8,500 hours of actual usage time with 95% certainty. In some embodiments, knowledge of statistical analysis may be provided back to manufacturers, sellers, resellers, other servicers, customers, and other individuals and entities which may find the information useful based on subscriptions or other transactions with a service operator and/or administrator.

The examples in FIGS. 21A and 21B are shown in part to illustrate that each PLC may process data differently and have different inputs and outputs. However, monitoring equipment which may monitor PLCs may be operable to monitor many different types of PLCs without the need for a unique piece of monitoring equipment for each unique manufacturer, model, and/or PLC line. Monitoring equipment has the ability to translate or understand and in some embodiments interpret data from PLCs.

FIGS. 22A-22C show an example embodiment of a payload including an array with data points and a time stamped message with an identifier and relevant values as may be transmitted by a monitoring component. The data shown is an example of data received while monitoring.

Figure 23A:
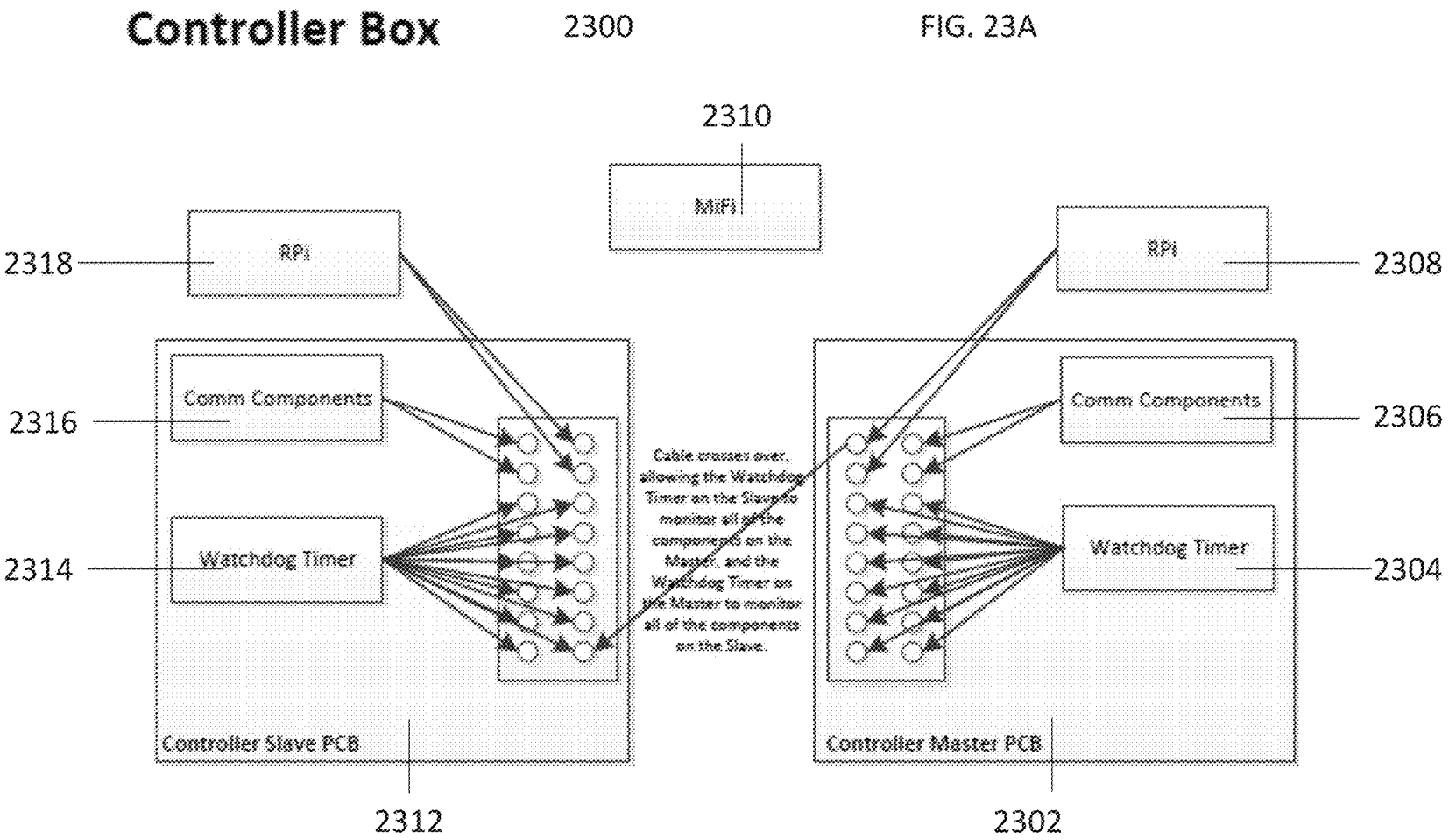
FIG. 23A is a diagram depicting an example embodiment of a controller box.

FIG. 23A shows an example embodiment of a controller box with included components. In the example embodiment an on board 2.4 GHz radio is included for communications. This can be a MiFi 2310 or WiFi connection. Other embodiments can function at 900 MHz, 433 MHz, or others. An example embodiment of flow of data can include communication components 2306 communicating to the sensor over 2.4 GHz radio, and RPi 2308 receiving data from controller master PCB 2302 via a serial interface. RPi 2308 then transmits data to MiFi 2310 via WiFi which then transmits data over a cellular network back to the servers. In-System Programming (ISP) of all micro controllers includes instructions stored in computer memory. The ISP allows the microcontrollers to be reprogrammed with newer software so the hardware doesn't have to be replaced as revisions are made. Connection for LED 4 character 14-segment display is provided for board diagnostics. DIP switches can be used to configure the radio settings. DIP switches for other configurations are provided on the microcontrollers for other configuration settings. Connections are provided for an external humidity sensor and other $I^2C$ devices. EEPROM is provided to store event information acquired by sensors and can retain data even through reboots of the controllers or loss of communication to the RPi. A Master/slave configuration allows for a complete backup system to take over if any components on the primary system suffer a malfunction or other failure. Watchdog timers are provided to detect and alert system operators if there are issues with the hardware. A cable can crossover from the master PCB 2302 to the slave PCB 2312 to allow a slave watchdog timer 2314 to monitor all components on the master PCB 2302 and the watchdog timer 2304 on the master PCB 2302 to monitor all of the components on the slave PCB 2312.

FIG. 23B shows an example embodiment of a PCB circuit configuration.

Figure 23C:
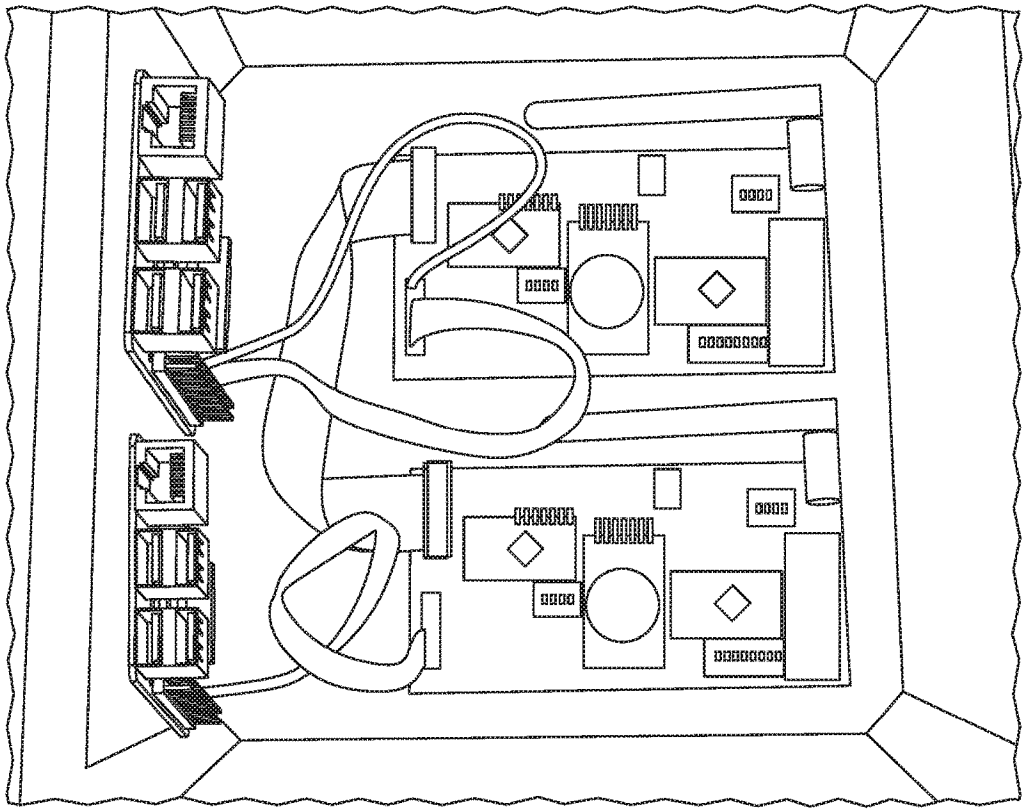
FIG. 23C is a diagram depicting an example embodiment of a controller box with transceiver.

FIG. 23C shows an example embodiment of a master/slave setup of two PCBs.

Figure 23D:
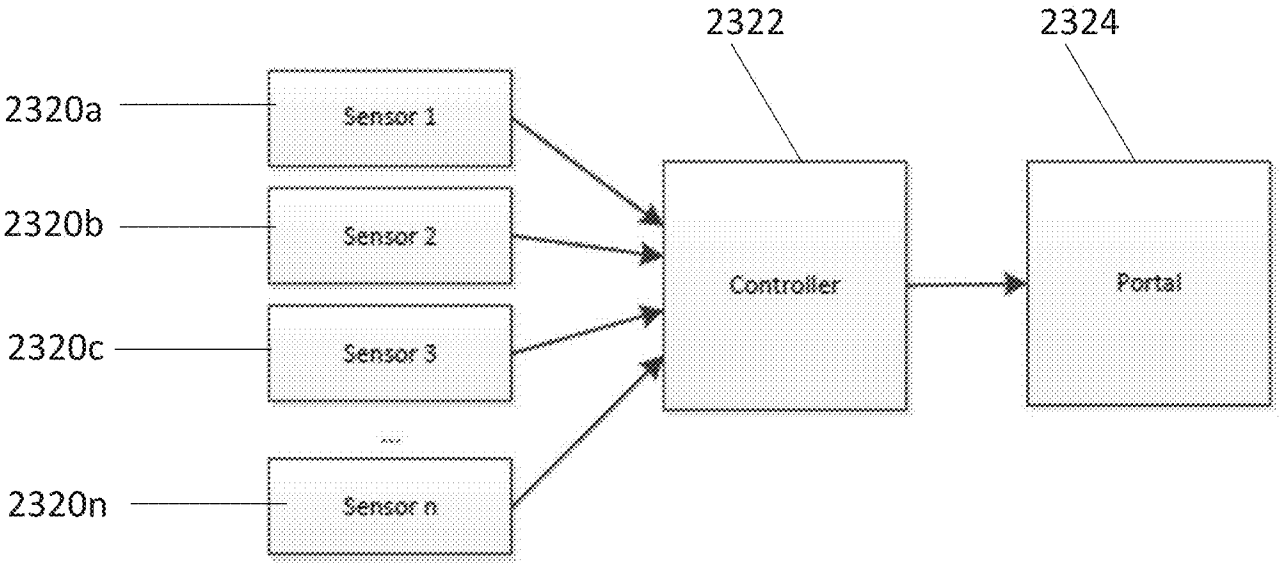
FIG. 23D is a diagram depicting an example embodiment of a sensor box.
Figure 23E:
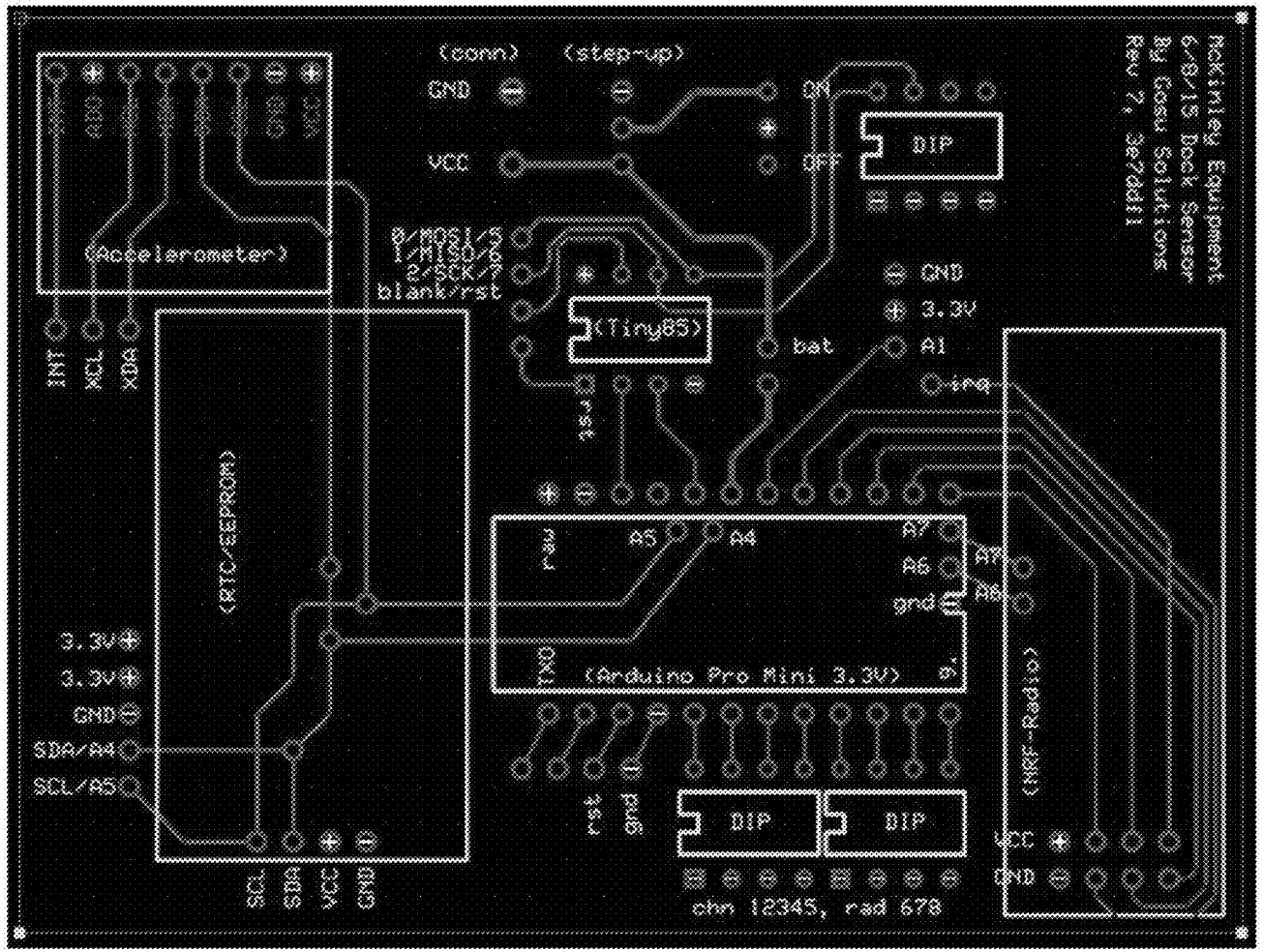
FIG. 23E is a diagram depicting an example embodiment of a circuit board for a sensor box.
Figure 23F:
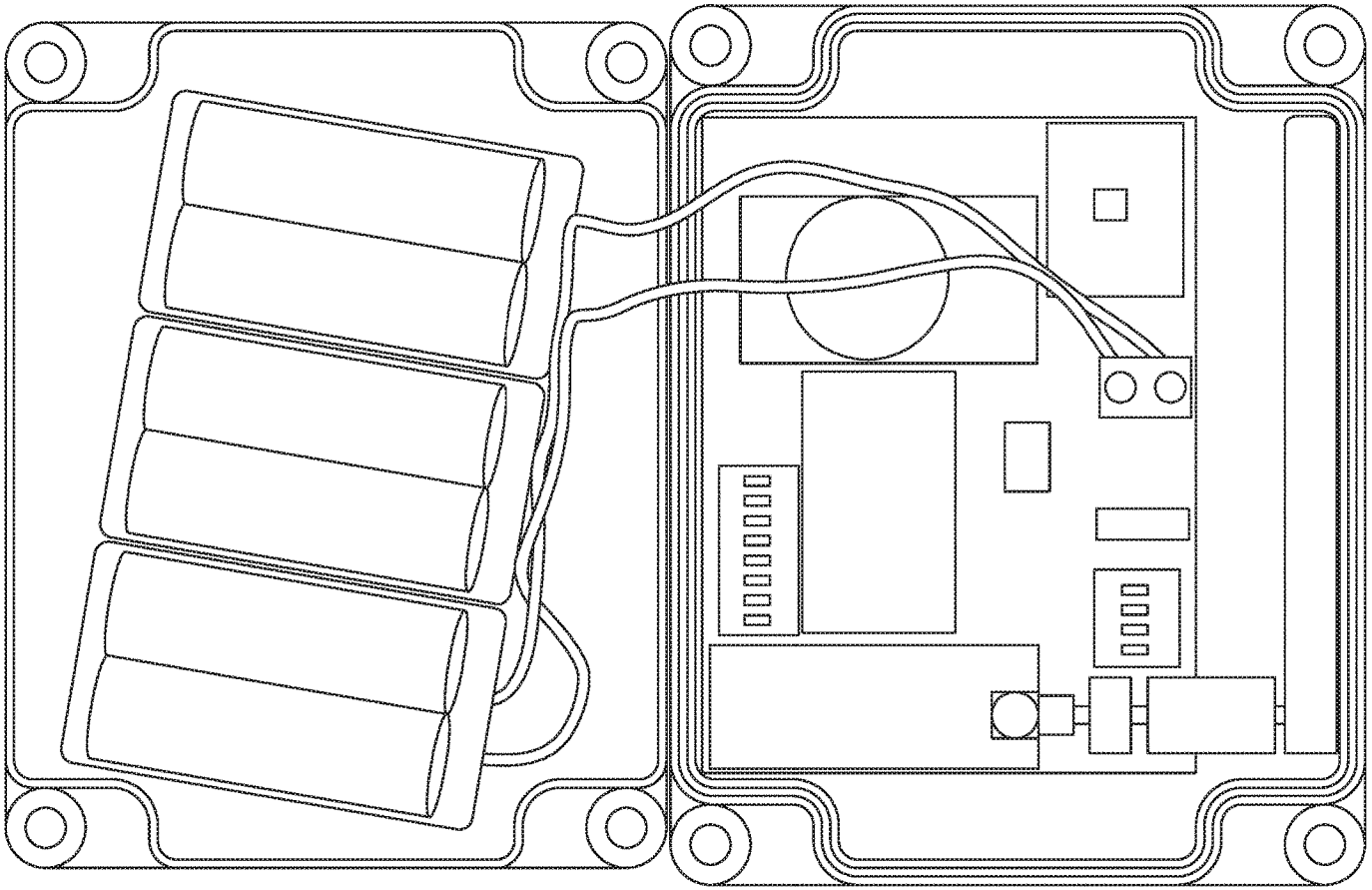
FIG. 23F is a diagram depicting an example embodiment of a sensor box.

FIG. 23D shows a diagram of an example embodiment of a sensor box with sensors 2320*a*-2320*n*, a controller 2322, and transmission to a portal 2324. An example embodiment of the sensor box can include an on-board accelerometer. In the example embodiment an on board 2.4 GHz radio is included for communications. Other embodiments can function at 900 MHz, 433 MHz, or others. In-System Programming (ISP) of all micro controllers includes instructions stored in computer memory. Connection for LED 4 character 14-segment display is provided for board diagnostics. DIP switches can be used to configure the radio settings. DIP switches for other configurations are provided on the microcontrollers for other configuration settings. Connections are provided for an external humidity sensor and other $I^2C$ devices. The sensor box can have an option to add a step-up regulator to be used with alkaline batteries or a jumper for lithium batters as shown in FIGS. 23E-23F below. Real time alkaline battery measurement can be achieved. Additionally, magnets can be provided for external mounting on metal surfaces without interfering with internal components. The enclosure is IP66 rated. EEPROM is also included to store event information for later transmission or recovery if the radio is not able to communicate due to malfunction or other problems.

Figure 24A:
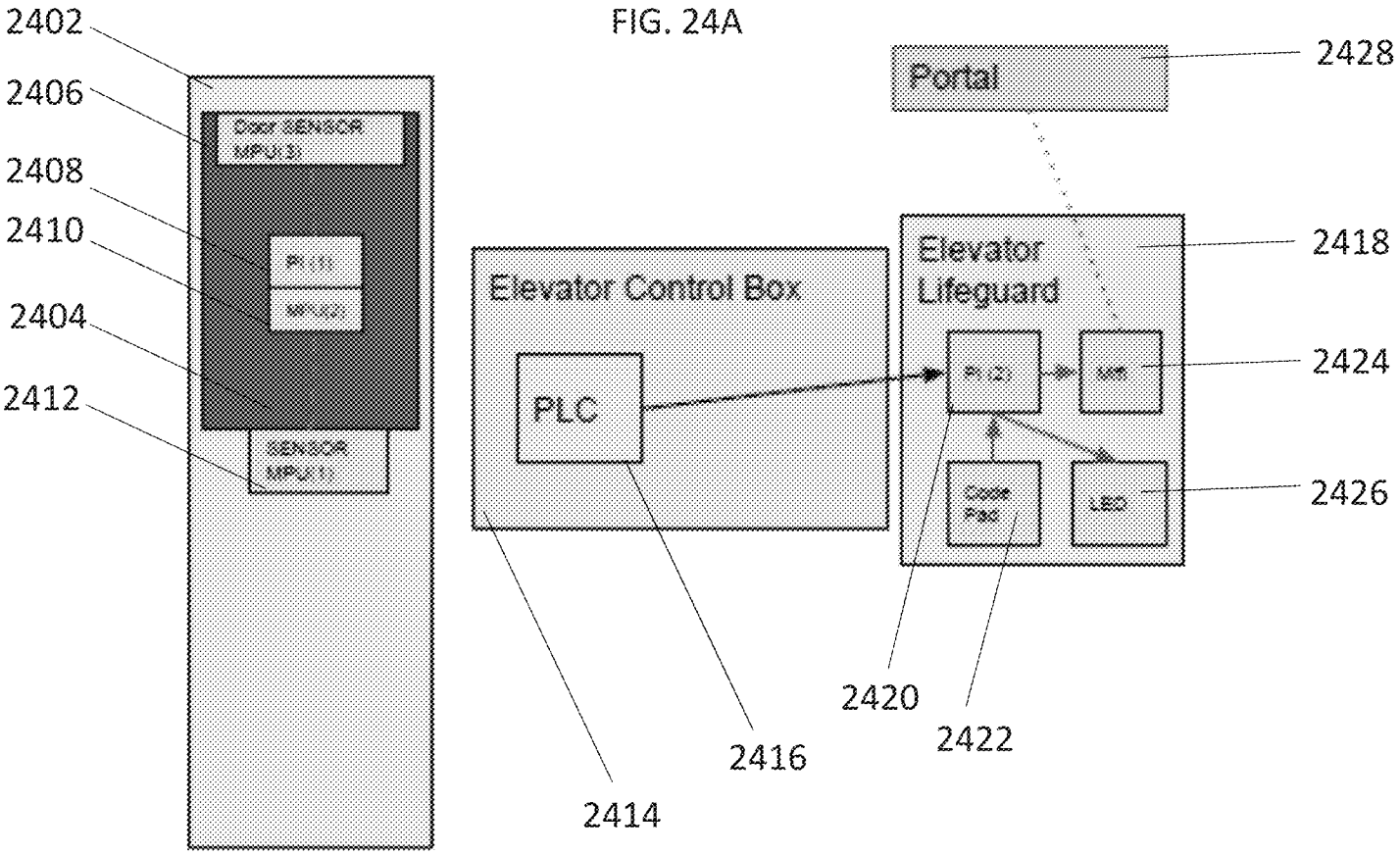
FIG. 24A is an example embodiment of a data flow for an elevator equipment monitor.

FIG. 24A is an example embodiment of a data flow for an elevator equipment monitor. In the example embodiment a sensor 2404 can detect a person and MPU 2412 and/or MPU 2406 can send a signal to MPU 2410 via wireless or wired communication. MPU 2410 can trigger an E-Btn and indicate to Pi 2408 what event triggered the signal. Next, Pi 2408 can create a Portal sensor event entry via mifi and Pi 2420 can see an e-button from the PLC 2416 and create a Portal event via miff. Portal 2428 can then send out an alert via email, text, or other means with a "clear" code for the control pad and indicate to Pi 2420 the code. A technician can arrive, solve the problem, for instance helping the person out of the elevator, and enter the "clear" code via code pad 2422. Pi 2420 can confirm the code, upload it to Portal 2428 via miff with an indication to enable the elevator. Portal 2428 can send the command to Pi 2408 to enable the elevator. Pi 2408 can receive the enable command from Portal 2428 and forward the command to MPU 2410 to indicate to MPU 2412 and/or MPU 2406 to enable the elevator. A heartbeat from MPU 2412, 2406, 2410 can be sent to Pi 2408.

Figure 24B:
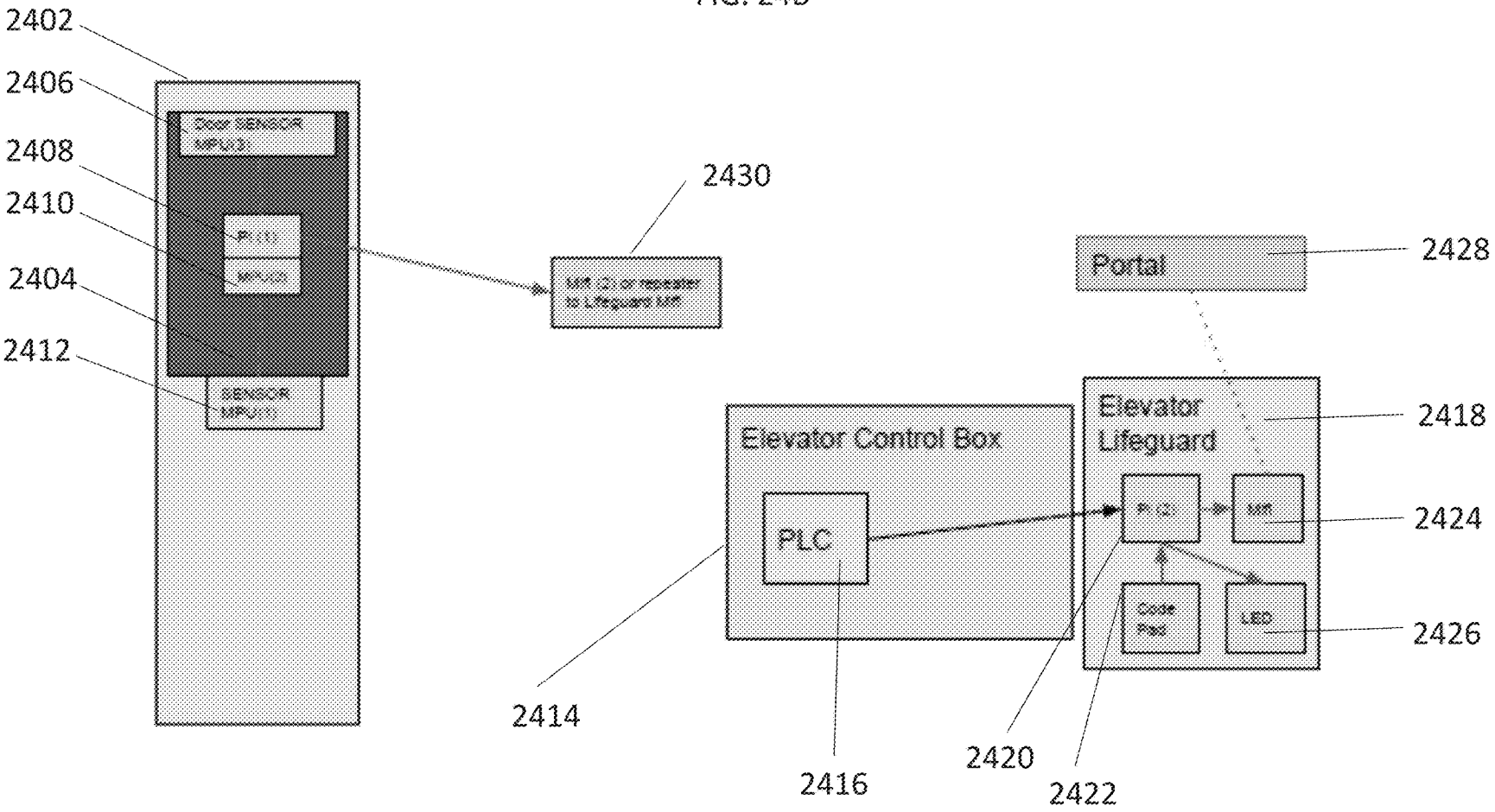
FIG. 24B is an example embodiment of a data flow for an elevator equipment monitor with remote location.

FIG. 24B is an example embodiment of a data flow for an elevator equipment monitor with remote location. Included is Mifi 2430 which can perform relays of information between equipment sensors and control boxes.

Figure 25A:
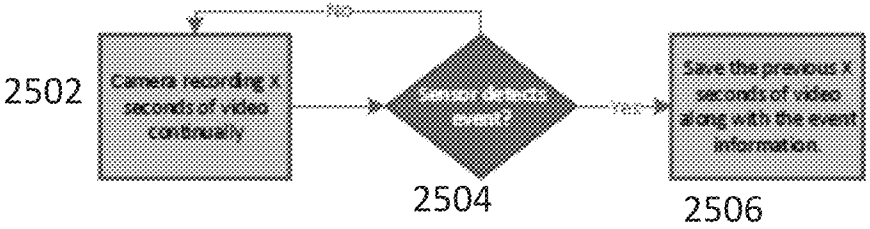
FIG. 25A is an example of video or image capture tied to event data where a camera is constantly operating.

FIG. 25A is an example of video or image capture tied to event data where a camera is constantly operating. In the example embodiment a camera can be recording a set period of video or continuous video feed in 2502. A processor can poll a sensor periodically to determine if the sensor has detected an event in 2504. If no event has been detected then the camera continues recording. If an event has been detected then the processor can direct the system to store a set amount of time of video along with the event information in memory such as a database and send an alert.

Figure 25B:
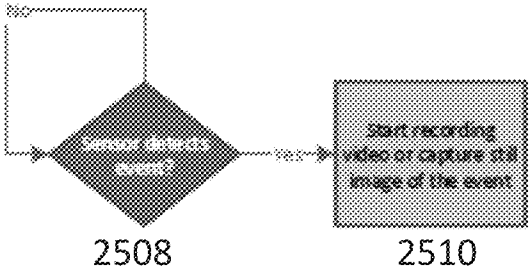
FIG. 25B is an example of video or image capture tied to event data where an event triggers a camera operation.

FIG. 25B is an example of video or image capture tied to event data where an event triggers a camera operation. In this scenario, a sensor detecting an event can cause the camera to begin recording video or capture a still image of the video in 2410. If no event is detected in 2408 then the cycle repeats.

As used herein and in the appended claims, the singular forms "a", "an", and "the" include plural referents unless the context clearly dictates otherwise.

The publications discussed herein are provided solely for their disclosure prior to the filing date of the present application. Nothing herein is to be construed as an admission that the present disclosure is not entitled to antedate such publication by virtue of prior disclosure. Further, the dates of publication provided may be different from the actual publication dates which may need to be independently confirmed.

It should be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

In many instances entities are described herein as being coupled to other entities. It should be understood that the terms "coupled" and "connected" (or any of their forms) are used interchangeably herein and, in both cases, are generic to the direct coupling of two entities (without any non-negligible (e.g., parasitic) intervening entities) and the indirect coupling of two entities (with one or more non-negligible intervening entities). Where entities are shown as being directly coupled together, or described as coupled together without description of any intervening entity, it should be understood that those entities can be indirectly coupled together as well unless the context clearly dictates otherwise.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

What is claimed is:

1. A unified method of equipment monitoring in order to predict parts failures, improve repair and replacement scheduling, enhance safety, provide insight and analysis into operational efficiency and prevent theft for a system of non-integrated pieces of equipment, comprising:

monitoring a set of first state signals created by a first PLC associated with a first piece of equipment using a monitoring device comprising hardware communicatively coupled to the first PLC and operative to transmit information over a communications network;

monitoring a set of second signals related to a second piece of equipment;

selectively transmitting the set of first state signals and the set of second state signals from the monitoring device over the communications network for storage in non-transitory memory of one or more databases stored on a server system comprising hardware and software communicatively coupled to the network;

a processor of the server analyzing the set of first state signals created by the first PLC to determine a first nature of the signals with respect to a status of the first piece of equipment;

the processor analyzing the set of second state signals to determine a second nature of the signals with respect to a status of the second piece of equipment;

the processor accessing the database and analyzing actual usage data for the first and second pieces of equipment and recommending an optimized service schedule; and the processor using the analyzed signals to selectively send alerts to one or more mobile service devices operated by technicians when emergency maintenance is required for one of the pieces of equipment.

2. The method of claim 1, wherein monitoring the set of second signals related to the second piece of equipment further comprises:

monitoring the second set of signals related to the second piece of equipment as generated by a pressure sensor.

3. The method of claim 1, wherein monitoring the set of second signals related to the second piece of equipment further comprises:

monitoring the second set of signals related to the second piece of equipment as generated by a motion sensor.

4. The method of claim 1, wherein monitoring the set of second signals related to the second piece of equipment further comprises:

monitoring the second set of signals related to the second piece of equipment as generated by a temperature sensor.

5. The method of claim 1, wherein monitoring the set of second signals related to the second piece of equipment further comprises:

monitoring the second set of signals related to the second piece of equipment as generated by a light sensor.

6. The method of claim 1, wherein monitoring the set of second signals related to the second piece of equipment further comprises:

monitoring the second set of signals related to the second piece of equipment as generated by a camera.

7. The method of claim 1, wherein monitoring the set of second signals related to the second piece of equipment further comprises:

monitoring the second set of signals related to the second piece of equipment as generated by a video camera.

8. A unified method of monitoring equipment in order to predict parts failures, improve repair and replacement scheduling, enhance safety, provide insight and analysis into operational efficiency and prevent theft for a system of non-integrated pieces of equipment, comprising:

monitoring a plurality of pieces of equipment using a monitoring system comprising at least one monitoring device operable to monitor a set of state signals unique to each piece of equipment, and comprising hardware communicatively coupled to a processor and operative to transmit information over a communications network;

selectively transmitting signals from the monitoring system over the communications network for storage in one or more databases stored in non-transitory memory on a server system comprising hardware and software and communicatively coupled to the network;

a processor of the server analyzing the sets of state signals created by the monitoring system to determine a nature of the state signals with respect to each piece of equipment;

the processor accessing the one or more databases and analyzing actual usage data for the first and second pieces of equipment and recommending an optimized service schedule; and the processor using the analyzed sets of state signals to selectively send alerts to one or more mobile service devices operated by technicians when emergency maintenance is required for one of the plurality of pieces of equipment.

9. The method of claim 8, wherein the monitoring device further monitors a pressure sensor associated with one of the pieces of equipment for secondary state information.

10. The method of claim 8, wherein the monitoring device further monitors a motion sensor associated with one of the pieces of equipment for secondary state information.

11. The method of claim 8, wherein the monitoring device further monitors a temperature sensor associated with one of the pieces of equipment for secondary state information.

12. The method of claim 8, wherein the monitoring device further monitors a light sensor associated with one of the pieces of equipment for secondary state information.

13. The method of claim 8, wherein the monitoring device further monitors a camera associated with one of the pieces of equipment for secondary state information.

14. The method of claim 8, wherein the monitoring device further monitors a video camera associated with one of the pieces of equipment for secondary state information.

15. A system for remote equipment monitoring in order to predict parts failures, improve repair and replacement scheduling, enhance safety, provide insight and analysis into operational efficiency and prevent theft, comprising:

a plurality of pieces of non-integrated equipment located at a client location;

a communications network;

a monitoring device comprising hardware, non-transitory computer memory, and a processor communicatively coupled to the communications network;

a server comprising a database stored in non-transitory computer memory, communicatively coupled to the communications network; and a plurality of communications devices communicatively coupled to the communications network, wherein a processor of the server is operable to:

receive a set of signals uniquely associated with one of the pieces of equipment from the monitoring device via the network that is related to a state of the associated piece of equipment, analyze the set of signals to determine the state of the associated piece of equipment and store state-related data in the database;

access and analyze actual usage data for the plurality of pieces of equipment stored in the database; and based on the state of one of the pieces of equipment, selectively prepare a report on at least that piece of equipment and transmit the report to at least one of the plurality of communications devices via the communications network when that piece of equipment requires emergency maintenance.

16. The system of claim 15, wherein the monitoring device is coupled with a sensor to monitor the electrical state of a programmable logic controller (PLC) that is operable to control one of the pieces of equipment.

17. The system of claim 15, wherein the monitoring device is coupled with a sensor to monitor the state of one of the pieces of equipment and wherein the piece of equipment does not include a programmable logic controller (PLC) that is operable to control the piece of equipment.

18. The system of claim 17, wherein the sensor is used to monitor electrical signals associated with the piece of equipment.

19. The system of claim 15, wherein the server is operable to selectively schedule and perform remote tests on at least one of the pieces of equipment.

20. The system of claim 15, wherein the server is further operable to:

determine the state of at least one additional piece of equipment located at the client location and based on the state of each of the pieces of equipment include individual recommendations for each piece of equipment in the report.

* * * * *